US010842288B2

(12) United States Patent
Bedel et al.

(10) Patent No.: US 10,842,288 B2
(45) Date of Patent: Nov. 24, 2020

(54) PERSON SUPPORT SYSTEMS WITH COOLING FEATURES

(71) Applicant: Hill-Rom Services, Inc., Batesville, IN (US)

(72) Inventors: David Lawrence Bedel, Oldenburg, IN (US); Andrew David Clark, Waltham, MA (US); Kirsten Emmons, Batesville, IN (US); Charles A. Lachenbruch, Batesville, IN (US); David Lance Ribble, Indianapolis, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 238 days.

(21) Appl. No.: 15/880,131

(22) Filed: Jan. 25, 2018

(65) Prior Publication Data

US 2018/0213944 A1 Aug. 2, 2018

Related U.S. Application Data

(60) Provisional application No. 62/452,697, filed on Jan. 31, 2017.

(51) Int. Cl.
*A47C 21/04* (2006.01)
*A61G 7/05* (2006.01)
(Continued)

(52) U.S. Cl.
CPC ..... *A47C 21/046* (2013.01); *A47C 21/044* (2013.01); *A61G 1/04* (2013.01);
(Continued)

(58) Field of Classification Search
CPC ... A47C 21/046; A47C 21/042; A47C 21/044; A47C 19/12; A61G 7/05784;
(Continued)

(56) References Cited

U.S. PATENT DOCUMENTS 2,186,142 A * 1/1940 Lieberman ..... A47C 21/044 5/284
4,057,861 A 11/1977 Howorth
(Continued)

FOREIGN PATENT DOCUMENTS

TW 201407164 A 2/2014
WO 2012051628 A1 4/2012
(Continued)

OTHER PUBLICATIONS

Appelboom et al. "The Promise of Wearable Activity Sensors to Define Patient Recovery", Journal of Clinical Neuroscience, 2013, pp. 1-5, Elsevier Ltd., Accessed: ResearchGate.
(Continued)

*Primary Examiner* — David R Hare
*Assistant Examiner* — Adam C Ortiz
(74) *Attorney, Agent, or Firm* — Dinsmore & Shohl LLP

(57) ABSTRACT

A person support system is disclosed that includes cooling features to provide focal cooling to a subject supported by the person support system. Embodiments of the person support system include a longitudinal frame having at least one side rail, a deck position on the longitudinal frame, a support pad positioned on the deck, and a cooling source thermally coupled to the deck. The deck is a thermally conductive material. The cooling source draws heat from a portion of the support pad, through the top surface of the deck, and through the deck thereby cooling the portion of the support pad. The cooling source may be positioned in the side rail or directly to a bottom surface of the deck. Cooling systems that are removeably coupleable to person support systems are also disclosed.

20 Claims, 28 Drawing Sheets

(51) Int. Cl.

| | |
|---|---|
| ***A61G 13/10*** | (2006.01) |
| ***A61G 1/04*** | (2006.01) |
| ***A61G 5/10*** | (2006.01) |
| ***A61G 13/02*** | (2006.01) |
| ***A61G 7/057*** | (2006.01) |
| ***A47C 19/12*** | (2006.01) |

(52) U.S. Cl.
CPC ..... *A61G 5/10* (2013.01); *A61G 7/057* (2013.01); *A61G 7/0524* (2016.11); *A61G 7/05784* (2016.11); *A61G 13/02* (2013.01); *A61G 13/10* (2013.01); *A47C 19/12* (2013.01); *A61G 2203/20* (2013.01); *A61G 2203/46* (2013.01); *A61G 2210/70* (2013.01); *A61G 2220/00* (2013.01)

(58) Field of Classification Search
CPC .... A61G 13/10; A61G 13/108; A61G 7/0524; A61G 1/04; A61G 5/10; A61G 7/057; A61G 13/02; A61G 2203/20; A61G 2203/46; A61G 2210/70; A61G 2220/00
See application file for complete search history.

(56) References Cited

U.S. PATENT DOCUMENTS

| | | | | |
|---|---|---|---|---|
| 5,837,002 | A | 11/1998 | Augustine et al. | |
| 6,210,427 | B1 | 4/2001 | Augustine et al. | |
| 6,840,955 | B2 | 1/2005 | Ein | |
| 7,273,490 | B2 | 9/2007 | Lachenbruch | |
| 7,727,267 | B2 | 6/2010 | Lachenbruch | |
| 7,784,126 | B2 | 8/2010 | Meissner et al. | |
| 7,857,507 | B2 | 12/2010 | Quinn et al. | |
| 7,942,825 | B2 | 5/2011 | Ranganathan et al. | |
| 8,087,254 | B2 | 1/2012 | Arnold | |
| 8,328,420 | B2 | 12/2012 | Abreu | |
| 8,475,368 | B2 | 7/2013 | Tran et al. | |
| 8,606,344 | B2 | 12/2013 | DiMaio et al. | |
| 8,620,625 | B2 | 12/2013 | Sing et al. | |
| 8,663,106 | B2 | 3/2014 | Stivoric et al. | |
| 8,716,629 | B2 | 5/2014 | Klewer et al. | |
| 8,800,078 | B2 | 8/2014 | Lachenbruch et al. | |
| 8,907,287 | B2 | 12/2014 | Vanderpohl | |
| 8,939,912 | B2 | 1/2015 | Turnquist et al. | |
| 9,089,462 | B1 | 7/2015 | Lafleche | |
| 9,132,031 | B2 | 9/2015 | Levinson et al. | |
| 9,596,944 | B2 | 3/2017 | Makansi et al. | |
| 2005/0149153 | A1 | 7/2005 | Nakase | |
| 2005/0168941 | A1 | 8/2005 | Sokol et al. | |
| 2006/0202816 | A1 | 9/2006 | Crump et al. | |
| 2007/0135878 | A1 | 6/2007 | Lachenbruch et al. | |
| 2008/0018480 | A1 | 1/2008 | Sham | |
| 2008/0077201 | A1* | 3/2008 | Levinson | A61B 5/411 607/96 |
| 2009/0069642 | A1 | 3/2009 | Gao et al. | |
| 2010/0011502 | A1* | 1/2010 | Brykalski | A47C 21/04 5/423 |
| 2010/0193498 | A1* | 8/2010 | Walsh | F28F 3/025 219/217 |
| 2010/0274331 | A1 | 10/2010 | Williamson et al. | |
| 2010/0298658 | A1 | 11/2010 | McCombie et al. | |
| 2011/0107514 | A1 | 5/2011 | Brykalski et al. | |
| 2011/0289684 | A1* | 12/2011 | Parish | A47C 21/044 5/421 |
| 2013/0066237 | A1 | 3/2013 | Smotrich et al. | |
| 2013/0090571 | A1 | 4/2013 | Nourani et al. | |
| 2014/0047646 | A1* | 2/2014 | Lachenbruch | A47C 21/042 5/726 |
| 2014/0237719 | A1* | 8/2014 | Brykalski | A47C 21/044 5/421 |
| 2014/0260331 | A1 | 9/2014 | Lofy et al. | |
| 2014/0323816 | A1 | 10/2014 | Soderberg et al. | |
| 2015/0051673 | A1 | 2/2015 | Rivas Tapia | |
| 2015/0230974 | A1 | 8/2015 | Pistor et al. | |
| 2015/0290065 | A1 | 10/2015 | Augustine et al. | |
| 2015/0313370 | A1* | 11/2015 | Rawls-Meehan | A47C 19/025 5/423 |
| 2015/0323388 | A1 | 11/2015 | Kostic et al. | |
| 2016/0338500 | A1 | 11/2016 | Malzl | |
| 2017/0135884 | A1 | 5/2017 | Lachenbruch et al. | |

FOREIGN PATENT DOCUMENTS

| | | | |
|---|---|---|---|
| WO | 2014047310 | A1 | 3/2014 |
| WO | 2015074007 | A1 | 5/2015 |
| WO | 2015148225 | A2 | 10/2015 |
| WO | 2015164456 | A2 | 10/2015 |

OTHER PUBLICATIONS

Bard Medical, Arctic Sun® 5000 Temperature Management System, 2017, 3 pages, C. R. Bard, Inc., Accessed: www.bardmedical.com.

CSZ, "Gelli-Roll® Reusable Warming and Cooling Gel Pad", 2016, pp. 1-3, Accessed: http://www.bardmedical.com.

Doty et al. "The Wearable Multimodal Monitoring System: A Platform to Study Falls and Near-Falls in the Real-World", 2015 pp. 412-422, Springer International Publishing, Switzerland, Accessed: ResearchGate.

Du Bois, "The Basal Metabolism In Fever", Journal of the American Medical Association, 1921, vol. 77, No. 5, pp. 352-357.

Extended European Search Report dated Apr. 13, 2017 relating to EP Patent Application No. 16198283.0.

Hill-Rom, "VersaCare® Med Surg Bed", pp. 1-3, http://www.hill-rom/com/usa/products/category/hospital-beds/versacare-med-surg-beds.

Iaizzo, "Temperature Modulation of Pressure Ulcer Formation: Using a Swine Model," Wounds, 2004, 16(11), Accessed: http://www.medscape.com.

Jiang, "A Smart and Minimum-intrusive Monitoring Framework Design for Health Assessment of the Elderly", University of Cincinnati, Doctoral dissertation, 2015, pp. 1-124.

Kokate et al., "Temperature-Modulated Pressure Ulcers: A Porcine Model", American Congress of Rehabilitation Medicine and the American Academy of Physical Medicine and Rehabilitation, 1995, vol. 76, pp. 666-673.

Lachenbruch et al., "Relative Contributions of Interface Pressure, Shear Stress, and Temperature on Ischemic-induced, Skin-reactive Hyperemia in Healthy Volunteers: A Repeated Measures Laboratory Study", Ostomy Wound Management, 2015, pp. 16-25, 61(2).

Lachenbruch, "Skin Cooling Surfaces: Estimating the Importance of Limiting Skin Temperature", 2005, vol. 51 Issue 2, Ostomy Wound Management, Accessed: http://www.o-wm.com/content/skin-cooling-surfaces-estimating-importance-limiting-skin-temperature.

Laird Wireless Connectivity Blog, "Penn Medicine Tests Wearable Patient Monitor in Hospital", 2015, pp. 1-2, Accessed: http://www.summitdata.com/blog/penn-medicine-tests-wearable-patient-monitor-hospital.

Lanata et al. "Complexity Index From a Personalized Wearable Monitoring System for Assessing Remission in Mental Health", Journal of Latex Class Files, 2012, vol. 11, No. 4, Accessed: ResearchGate.

Non-Final Office Action issued in U.S. Appl. No. 15/348,080 dated May 29, 2019 (24 pages).

Notice of Allowance issued in U.S. Appl. No. 15/348,080 dated Oct. 15, 2019 (16 pages).

* cited by examiner

PERSON SUPPORT SYSTEMS WITH COOLING FEATURES

CROSS-REFERENCE TO RELATED APPLICATION

This application claims the benefit of U.S. Provisional Application Ser. No. 62/452,697 filed Jan. 31, 2017, which is incorporated by reference herein in its entirety.

TECHNICAL FIELD

The present specification generally relates to person support systems, and more specifically, to person support systems having cooling features.

BACKGROUND

Conventionally, a subject may be positioned on a support surface during a medical procedure. The support surface is generally the upper surface of a surgical table, such as a spine table or standard operating room (OR) table, and may include a number of pads to provide support to the subject. The pads provide cushioning to the subject and may facilitate positioning the subject so as to provide access to a portion of the subject's anatomy that is to be operated on. For example, in the case of a spine table, the pads of the support surface may be used to position the subject on the spine table such that the subject's spine is curved or arched, thereby separating the vertebrae.

During a surgical operation the subject may be maintained in one position on the support surface for an extended period of time. As such, certain areas of the subject's anatomy in contact with the surface may be subject to relatively high, localized pressure. For example, when a subject is in a supine position on the surface, portions of the subject's posterior skin, such as the subject's sacral area, buttocks, scapular areas, and/or heels, may be subject to relatively high, localized pressure due to the subject's own body weight. These areas of localized pressure may be different depending on the orientation of the subject on the surface. For example, when the subject is in the prone position on the surface, the areas of localized pressure may be along the anterior skin of the subject. The localized pressure of contact of the skin with the surface deforms the tissue of the subject, which may cause deformation of blood vessels. If serious enough, it may result in a reduction in blood flow, reducing the amount of oxygen in the tissue. Lack of oxygen causes ischemia, which kills the tissue. Thus, the areas of relatively high localized pressure may be prone to the development of pressure injuries, also known as pressure ulcers, due to the localized pressure.

The development of pressure injuries may be further exacerbated by heat and the presence of moisture, such as perspiration, trapped between the skin and the surface for extended periods of time. In addition to subjecting the skin to pressure, the surface provides resistance to the flow of heat and moisture away from the skin. Therefore, contact of the skin with the surface results in an increased temperature and humidity environment of the skin in contact with the surface. As temperature increases, the metabolic demands of the tissue also increases (for example, it has been reported that each degree in temperature increase may increase the metabolic demands of tissue by about 10%—see Du Bois, E. F. "The Basal Metabolism in Fever," The Journal of the American Medical Association, (1921), 77(5), pp. 352-55). As the temperature of skin tissue increases, resulting in an increase in the oxygen demand (metabolic demand), ischemia caused by reduced blood flow due to deformation of blood vessels in the tissue is enhanced, which increases the rate of development of pressure injuries. Thus, the combination of increased temperature of the skin tissue and the localized pressure of contact with the support surface further accelerates formation of pressure injuries in the subject.

SUMMARY

Accordingly, a need exists for alternative person support systems, such as surgical tables or the like, which mitigate the development of pressure injuries in subjects positioned on the person support systems. According to one embodiment, A person support system may include a longitudinal frame comprising at least one side rail, a deck positioned on the longitudinal frame, the deck comprising a thermally conductive material, and a cooling source thermally coupled to the deck. The cooling source may draw heat from at least a portion of a top surface of the deck and through the deck thereby cooling the at least a portion of the top surface of the deck.

According to another embodiment, a cooling system for a person support system may include a reservoir or a heat transfer conduit thermally coupleable to a deck or a support pad of the person support system, a heat exchanger, a first fluid conduit in fluid communication with a heat exchanger inlet and a reservoir outlet or an outlet of the heat transfer conduit, and a second fluid conduit in fluid communication with a heat exchanger outlet and a reservoir inlet or an inlet of the heat transfer conduit. The reservoir or heat transfer conduit, the heat exchanger, the first fluid conduit, and the second fluid conduit may form a cooling circuit such that when a cooling fluid is disposed in the cooling circuit and the heat exchanger is positioned vertically higher than the reservoir of the heat transfer conduit, the cooling fluid may absorb heat from the deck or the support pad of the person support system, flow through the first fluid conduit to the heat exchanger, release heat in the heat exchanger, and flow through the second fluid conduit back to the reservoir or the heat transfer conduit.

Additional features and advantages will be set forth in the detailed description which follows, and in part will be readily apparent to those skilled in the art from that description or recognized by practicing the embodiments described herein, including the detailed description which follows, the claims, as well as the appended drawings.

It is to be understood that both the foregoing general description and the following detailed description describe various embodiments and are intended to provide an overview or framework for understanding the nature and character of the claimed subject matter. The accompanying drawings are included to provide a further understanding of the various embodiments, and are incorporated into and constitute a part of this specification. The drawings illustrate the various embodiments described herein, and together with the description serve to explain the principles and operations of the claimed subject matter.

BRIEF DESCRIPTION OF THE DRAWINGS

Referring now to the illustrative examples in the drawings, wherein like numerals represent the same or similar elements throughout.

DETAILED DESCRIPTION

Figure 1:
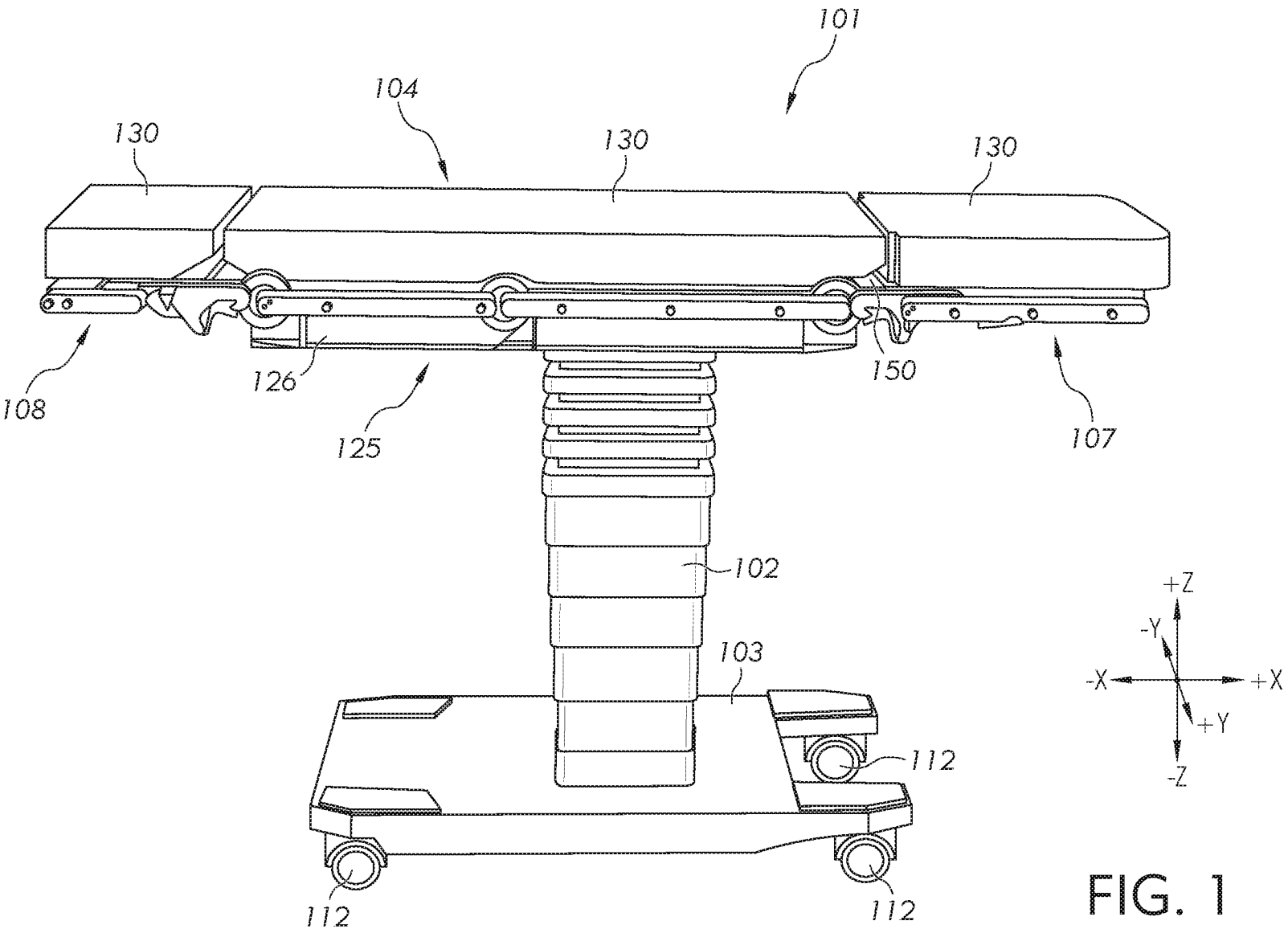
FIG. 1 is a perspective view of a person support system, in accordance with one or more embodiments described herein.

FIG. 1 generally depicts one embodiment of a person support system including cooling features for cooling at least a portion of the support pad of the person support system. According to one embodiment, the person support system may include a longitudinal frame comprising at least one side rail and a deck positioned on the longitudinal frame and in contact with the side rail. The deck comprises a thermally conductive material. The person support system also optionally includes a support pad, mattress, mat, accessory, or other component positioned on the deck. The person support system also includes a cooling source thermally coupled to the deck. The cooling source draws heat from at least a portion of the top surface of the deck and through the deck thereby cooling the portion of the top surface of the deck. Focal cooling of the portion of the top surface of the deck by the cooling source reduces the formation of pressure injuries in areas of a subject supported by the person support system. Embodiments of the person support system, deck, cooling sources, and methods of use will be described in more detail herein.

Referring to FIG. 1, one embodiment of a person support system 101 is schematically depicted. In this embodiment, the person support system 101 may be, for example and without limitation, a single column operating table (i.e., surgical table) such as the TruSystem® 7000 series or 7500 series of operating room tables manufactured by TRUMPF Medizin Systeme GmbH+Co. KG of Saalfeld, Germany or a MARS™ OR Table or SATURN® OR Table, each of which is also manufactured by TRUMPF Medizin Systeme GmbH+Co. KG of Saalfeld, Germany. The person support system 101 includes a single support column 102, a base 103, and a table top assembly 104. The base 103 may include a plurality of casters 112 such that the person support system 101 may be moved along a surface, such as a floor. The support column 102 is positioned on and supported by the base 103. The table top assembly 104 is positioned on and supported by the support column 102. In embodiments, the support column 102 may include an adjustment system (not shown) for raising and lowering the table top assembly 104 relative to the base 103 and/or tilting the table top assembly 104 relative to the base 103. For example, in some embodiments the adjustment system may facilitate rotating the table top assembly 104 about an axis generally parallel with the +/−Z axis of FIG. 1 and/or rotating the table top assembly 104 about an axis generally parallel with the +/−Y axis of FIG. 1. In embodiments, the adjustment system may be a mechanical adjustment system, an electro-mechanical adjustment system, a hydraulic adjustment system or combinations thereof.

In embodiments, the table top assembly 104 generally includes a longitudinal frame 125, a foot frame 107, and a head frame 108. The foot frame 107 may be pivotally and removably attached to the longitudinal frame 125. Similarly, the head frame 108 may be pivotally and removably attached to the longitudinal frame 125 opposite the foot frame 107 in the +/−X direction of the coordinate axes of FIG. 1. Each of the longitudinal frame 125, foot frame 107, and head frame 108 may include a deck 150. In some embodiments, a support pad 130 may be removably positioned on and supported by the deck 150.

The longitudinal frame 125 of the person support system 101 depicted in FIG. 1 may include a first side rail 126 and a second side rail 127 (not shown in FIG. 1), where the first side rail 126 and the second side rail 127 extend substantially parallel to each other in the longitudinal direction (i.e., the +/−X direction of the coordinate axes depicted in the figures). In embodiments, the first side rail 126 and the second side rail 127 may be coupled to one another with cross rails and/or the deck 150. While the structure of the longitudinal frame 125 has been described herein, it should be understood that the foot frame 107 and the head frame 108 may have similar structures.

While FIG. 1 generally depicts the person support system 101 as comprising a single support column 102 supporting the longitudinal frame 125, it should be understood that other embodiments are contemplated and possible. For example, in an alternative embodiment, the longitudinal frame may be supported by a plurality of support columns. Examples of such person support systems having a plurality of support columns include, without limitation, the ALLEN® Advance Table manufactured by Allen Medical Systems, Inc. of Acton, Mass. While reference has been made herein to specific embodiments of person support systems 101, it should be understood that the embodiments of the longitudinal frame 125 and deck 150 having the cooling features of the person support systems described in further detail herein may also be used in conjunction with other person support systems including, without limitation, spine tables, stretchers, procedural stretchers, gurneys, cots, beds, wheelchairs, hospital beds, and the like.

Figure 2:
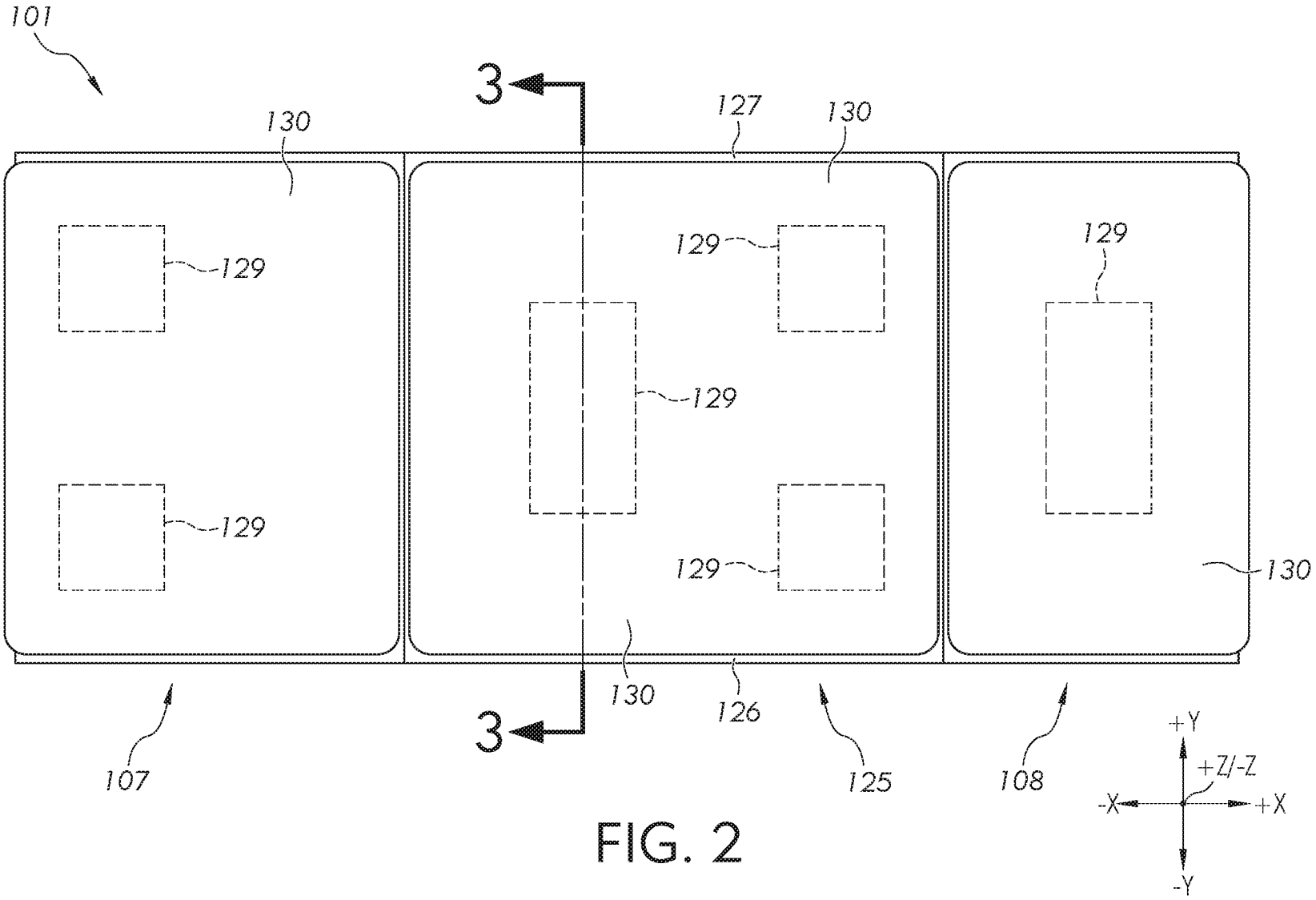
FIG. 2 schematically depicts a top view of the person support system of FIG. 1, in accordance with one or more embodiments described herein.

Referring to FIG. 1, during a medical procedure, such as a surgical procedure or the like, a subject may be positioned on the person support system 101 such that the subject is in contact with the person support system 101. The subject may be supported by the deck 150 or support structure, such as the support pad 130 or a blanket, mat, mattress or other structure, for example, which is supported by the deck 150. The subject may be in a static position on the person support system 101 for an extended period of time. As such, certain areas of the subject's anatomy in contact with the person support system 101 may be subject to relatively high, localized pressure. For example, when a subject is in a supine position on the person support system 101 (e.g., supported by the deck 150 or support pad 130 for example), portions of the subject's posterior skin, such as the subject's head, sacral area, buttocks, scapular areas, and heels, may be subject to relatively high, localized pressure due to the subject's own body weight. These areas of relatively high localized pressure in conjunction with increase in temperature of the skin caused by local heat build-up, may lead to the increased development of pressure injuries in the tissue of the subject. Increased moisture in the localized pressure areas may also play a role in development of pressure injuries. Increased temperature of the skin tissue in contact with the support pad 130 may increase the rate of perspiration of the skin, and contact of the skin with the support pad 130 may prevent transfer of moisture away from the skin tissue. Moisture reduces the mechanical strength of the skin, which may make the skin susceptible to tearing. Additionally, moisture may reduce the load-bearing capacity of the skin. FIG. 2 schematically depicts a top view of the person support system 101. The regions 129 of the support pad 130 identified in FIG. 2 contact areas of the subject's anatomy and experience local build-up of heat from contact with the subject.

Mild skin cooling has been shown to reduce the susceptibility of skin to breakdown. For example, mild skin cooling may be particularly effective in reducing skin breakdown in operating rooms and other applications in which relatively immobile subjects are placed on relatively firm surfaces for extended periods. (See, Du Bois, E. F., "The basal metabolism in fever," *Journal of the American Medical Association*, (1921), 77(5), pp. 352-5. See also, Kokate, J. Y., Leland, K. J., Held, A. M., et al., "Temperature-Modulated Pressure Ulcers: A Porcine Model," *Arch Phys Med Rehabil*, (1995), 76, pp. 666-673. See also, Iaizzo, P., "Temperature Modulation of Pressure Ulcer Formation: Using a Swine Model," *Wounds*, (Dec. 20, 2004), 16(11). See also, Lachenbruch, C., Tzen, Y., Brienza, D., Karg, T., and Lachenbruch, P. A., "The relative contributions of interface pressure, shear stress, and skin temperature on ischemic induced reactive hyperemic response," *Ostomy Wound Management*, (February 2015), 61(2), pp. 16-25.) Approximately 25% to 33% of reported pressure injuries acquired in the hospital are caused by care in the operating room during surgery. Of all facility-acquired pressure injuries not caused by medical devices (i.e., catheters and the like), about 57% of the ulcers form in pelvic region and 30% form in the heels of the subject. Thus, the pelvic (i.e., sacral and/or buttocks regions of the subject) and heel areas of the subject are a primary focus for the cooling the skin of the subject. It may not be necessary to cool other areas of the subject. Higher temperatures in the remainder of the subject's body may make cooling the heels and pelvic areas more comfortable or tolerable. The cushioned surfaces (i.e., support pad 130) of person support systems 900, such as an operating table for example, are designed to manage pressure on the areas of the body contacting the person support system 900, but the cushioned surfaces typically do not decrease the temperature of the skin. Often, the cushioned surfaces insulate the skin, which actually causes the temperature of the skin to increase.

The embodiments described herein provide person support systems 101 having cooling features for cooling the deck 150 of the person support system 101. Cooling the deck 150 of the person support system 101 may cool the skin of the subject supported thereon, which may assist in mitigating the development of pressure injuries in subjects supported by the person support system 101. The cooling features described herein may cool the skin of the subject to prevent pressure injuries without changing the current support surface cushions (i.e., support pad 130) of existing person support systems 900, such as the TRUMF operating tables previously described in this disclosure. Thus, incorporation of the cooling features for cooling the deck 150 of the person support system 101 does not require modification to the support pad 130 or other surgical surface directly under the subject. The cooling features described herein cool the deck 150, and thus the support pad 130 or other support structure on the deck 150, by incorporating active cooling sources to the support members (e.g., the side rails 126, 127, deck 150, of both) of the person support system 900 and, optionally, incorporating temperature sensing and control systems to create a closed-loop solution. Using the cooling features to cool the subject's skin to a safe temperature decreases the likelihood of skin breakdown at the highest peak pressures (i.e., in regions of the skin contacting the support pad 130, deck, or other part of the person support system 900). The cooling features described herein may reduce the occurrence of pressure injuries that occur in operating rooms.

Figure 3:
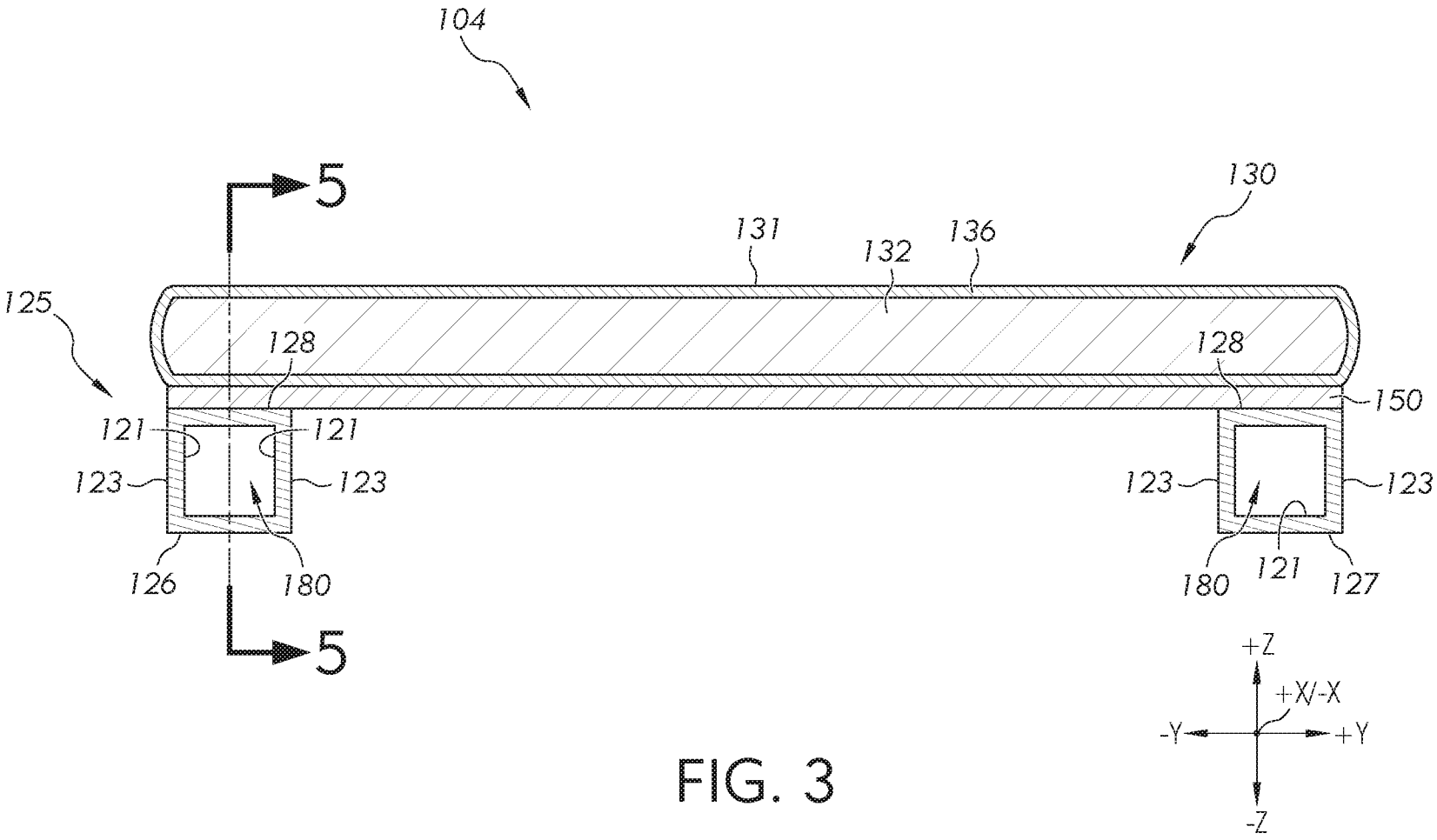
FIG. 3 schematically depicts a cross-section of a table top assembly of the person support system of FIG. 1, in accordance with one or more embodiments described herein.

Referring to FIG. 3, by way of example, a cross section through the Y-Z plane of one embodiment of the longitudinal frame 125, deck 150, and support pad 130 of the person support system 101 (FIG. 1) is schematically depicted showing the side rails 126, 127 of the longitudinal frame 125, a deck 150 supported on the side rails 126, 127, and a support pad 130 positioned on and supported by the deck 150. Additionally, the deck 150 may be thermally coupled to the side rails 126, 127 such that heat may be transferred from the deck 150 to the side rails 126, 127 through thermal conduction. The support pad 130 may be thermally coupled to the deck 150 such that heat may be transferred from the support pad 130 to the deck 150 through thermal conduction.

The support pad 130 may include a cover 136 which, in some embodiments, envelopes and encloses a core part 132 of the support pad 130. The cover 136 may be, for example and without limitation, a woven or non-woven fabric which, in some embodiments, includes a coating, such as a urethane coating, polyurethane coating, or the like, which seals at least the top surface 131 of the support pad 130 from moisture permeation and facilitates cleaning of the support pad 130. Alternatively, the cover 136 may be an elastomer, gel, or other protective material to protect the core part 132 of the support pad 130 from fluids and/or biological materials. For example, in embodiments, the cover 136 may be fluid impermeable, such that water and/or biological fluids do not pass through the cover 136 and contaminate the core part 132 of the support pad 130. Suitable materials for the cover 136 may include, for example, urethane, vinyl, nylon, Lycra material, other elastomeric materials, or combinations of these materials. It is contemplated that other materials may be used as a cover 136, provided that they do not degrade the radiolucency of the support pad 130. In some embodiments, the cover 136 may be removable and/or washable, enabling it to be changed and/or washed.

The core part 132 of the support pad 130 is disposed within the cover 136. The core part 132 may be formed from any type of material suitable for providing support to the subject support by the top surface 131 of the support pad 130 without producing unnecessarily high pressures on the subject. For example, the core part 132 can be a foam, gel, other material, or combinations thereof. Foam materials suitable for use as the core part 132 may include, but are not limited to, urethane foam, polyurethane foam, or the like. The core part 132 may also include a combination of different foam materials. For example, the core part 132 may include urethane foam or polyurethane foam with an additional layer of memory foam disposed over the urethane foam or the polyurethane foam. In some embodiments, the core part 132 may include a fluid-filled bladder. The fluid may be, for example, a liquid or gas. In still other embodiments, the core part 132 may include multiple layers of material. The layers may include the same materials or different materials, depending on the particular embodiment. For example, a layer of foam and a layer of gel may be employed, or two layers of foam may be employed. As with the cover 136, in various embodiments, the core part 132 may be made of radiolucent materials.

The core part 132 may be planar or contoured, depending on the specific use of the support pad 130. For example, the core part 132 may have a uniform thickness, as depicted in FIG. 3, or it may have a thickness that varies along the length and/or width of the support pad 130. In some embodiments, the variation in the thickness of the core part 132 may be based on the anatomy of the subject supported by the support pad 130. For example, a support pad intended for use in supporting a hip may have a first thickness profile, while a support pad intended for use in supporting a shoulder may have a second thickness profile. In addition to varying thicknesses of the core part 132, the shape of the core part 132 may also vary depending on the particular use of the support pad 130. For example, the core part 132 may be rectangular, annular, hexagonal, or other shape.

Although the person support system 101 is depicted in FIGS. 1-3 as having the support pad 130 supported by the deck 150, in some embodiments, other support structures, such as blankets, mattresses, pillows, mats, linens, bolsters, or combinations of these for example, may be supported by the deck 150 and thermally coupleable to the deck 150 so that these support structures may be cooled by the cooling features 140 described herein. In some embodiments, the subject may be directly supported by the top surface 154 of the deck 150.

Still referring to FIG. 3, in embodiments, the deck 150 may be formed from thermally conductive materials that are suitable for use in load bearing applications such as, without limitation, metals, polymers, carbon fiber, and/or combinations thereof. For example, the deck 150 may be formed from a metal or metal alloy having a relatively high thermal conductivity (e.g., greater than about 40 W/m*K), such as, but not limited to aluminum alloys, steel, titanium alloys, copper-containing alloys, other metal or metal alloy, or combinations thereof. In some embodiments, the deck 150 may be in the form of a metal plate. Alternatively, in embodiments, the deck 150 may be formed from a polymer material having a relatively high thermal conductivity (e.g., greater than about 40 W/m*K) such as, without limitation, ultra-high molecular weight polyethylene, polypropylene, liquid crystalline polymer, polyphthalamide, polycarbonate, or the like. In these embodiments, the deck 150 may be in the form of a polymer plate. As yet another alternative, in some embodiments, the deck 150 may be formed of carbon fiber having a relatively high thermal conductivity (e.g., greater than about 40 W/m*K). In these embodiments, the deck 150 may be in the form of a carbon fiber plate.

Alternatively, in other embodiments, the deck 150 may be formed from a material suitable for load bearing applications having thermally conductive elements incorporated therein. The thermally conductive elements may be particles, fibers, strips, nanotubes, or other structures. The thermally conductive elements may have a relatively high thermal conductivity (e.g., greater than about 40 W/m*K). The thermally conductive elements may include for example and without limitation, the following: metal particles or metal fibers formed from copper, alloys of copper, silver, alloys of silver, gold, alloys of gold, and the like; polymer fibers or strips, such as polymer fibers or strips formed from ultra-high molecular weight polyethylene, polypropylene, liquid crystalline polymer, polyphthalamide, polycarbonate, or the like; carbon nanotubes, fibers, filaments, particles, or the like; or combinations thereof. For example, in embodiments, the deck 150 may be in the form of a polymer plate having metal particulates or woven or non-woven metallic fibers disposed therein.

The deck 150 may be formed from carbon fiber composites when radiolucency is desired. More specifically, in various embodiments provided herein, the materials of various components of the person support systems 101 are radiolucent, or transparent to x-rays. Radiolucency, particularly in the area of the support pads 130 and the deck 150 enables x-ray and fluoroscopic imaging to be performed during surgical procedures without interference from the person support system. X-ray or fluoroscopic images may be taken with a device having a C-arm that includes portions above and below the subject on the person support system 101. The use of non-radiolucent materials can cause shadows or even obstructions in the x-ray or fluoroscopic images. Accordingly, in some embodiments, portions of the person support systems 101 described herein, such as the support pads 130, deck 150, side rails 126, 127, or the like, are formed from radiolucent materials. The deck 150 may include a bottom surface 152 and a top surface 154. The bottom surface 152 may be a bottom exterior surface of the deck 150. In some embodiments, the support pad 130 may be supported by and thermally coupled to the deck 150 through contact of the support pad 130 with the top surface 154 of the deck 150. Additionally, in some embodiments, a portion of the bottom surface 152 of the deck 150 may be supported by and thermally coupled to the side rails 126, 127.

The side rails 126, 127 may also be formed from thermally conductive materials that are suitable for use in load bearing applications such as, without limitation, metals, polymers, carbon fiber, and/or combinations thereof. For example, the side rails 126, 127 may be formed from a metal or metal alloy having a relatively high thermal conductivity (e.g., greater than about 40 W/m*K), such as, but not limited to aluminum alloys, steel, titanium alloys, copper-containing alloys, other metal or metal alloy, or combinations thereof. In some embodiments, the side rails 126, 127 may be in the form of metal channels. Alternatively, in embodiments, the side rails 126, 127 may be formed from a polymer material having a relatively high thermal conductivity (e.g., greater than about 40 W/m*K) such as, without limitation, ultra-high molecular weight polyethylene, polypropylene, liquid crystalline polymer, polyphthalamide, polycarbonate, or the like. In these embodiments, the side rails 126, 127 may be in the form of polymer channels. As yet another alternative, in some embodiments, the side rails 126, 127 may be formed of carbon fiber or carbon fiber composites having a relatively high thermal conductivity (e.g., greater than about 40 W/m*K). In these embodiments, the side rails 126, 127 may be in the form of carbon fiber channels. The side rails 126, 127 may be formed from carbon fiber composites when radiolucency is desired.

Alternatively, in other embodiments, the side rails 126, 127 may be formed from a material suitable for load bearing applications having thermally conductive elements incorporated therein. The thermally conductive elements may be particles, fibers, strips, nanotubes, or other structures. The thermally conductive elements may have a relatively high thermal conductivity (e.g., greater than about 40 W/m*K). The thermally conductive elements may include for example and without limitation, the following: metal particles or metal fibers formed from copper, alloys of copper, silver, alloys of silver, gold, alloys of gold, and the like; polymer fibers or strips, such as polymer fibers or strips formed from ultra-high molecular weight polyethylene, polypropylene, liquid crystalline polymer, polyphthalamide, polycarbonate, or the like; carbon nanotubes, fibers, filaments, particles, or the like; or combinations thereof.

Each of the side rails 126, 127 may be a U-shaped channel, square channel, rectangular channel, or other-shaped channel. In embodiments such as the embodiment depicted in FIG. 3, the side rails 126, 127 are square channels. Alternatively, in some embodiments, the side rails 126, 127 may be U-shaped channels. Each side rail 126, 127 may have a plurality of internal surfaces 121 defining an interior channel 180 of the side rails 126, 127. Each side rail 126, 127 may also have a plurality of external surfaces 123 facing generally outward away from the interior channel 180. The plurality of external surfaces 123 may include an upper surface 128 of the side rails 126, 127. In some embodiments, the deck 150 is supported by and thermally coupled to the side rails 126, 127 through contact of the deck 150 with the upper surface 128 of the side rails 126, 127.

Figure 4A:
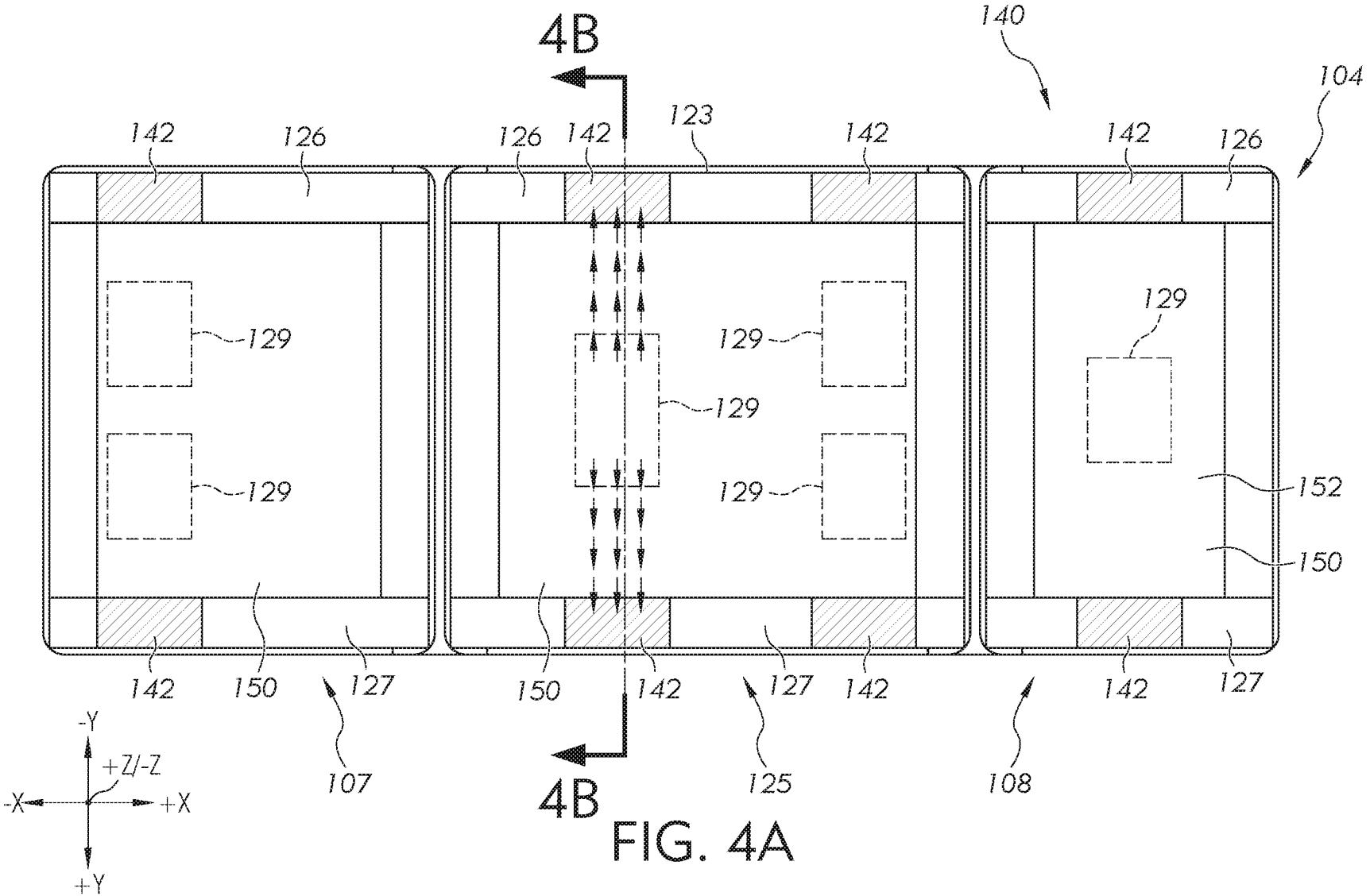
FIG. 4A schematically depicts a bottom view of the underside of a table top assembly of the person support system of FIG. 1, according to one or more embodiments described herein.
Figure 4B:
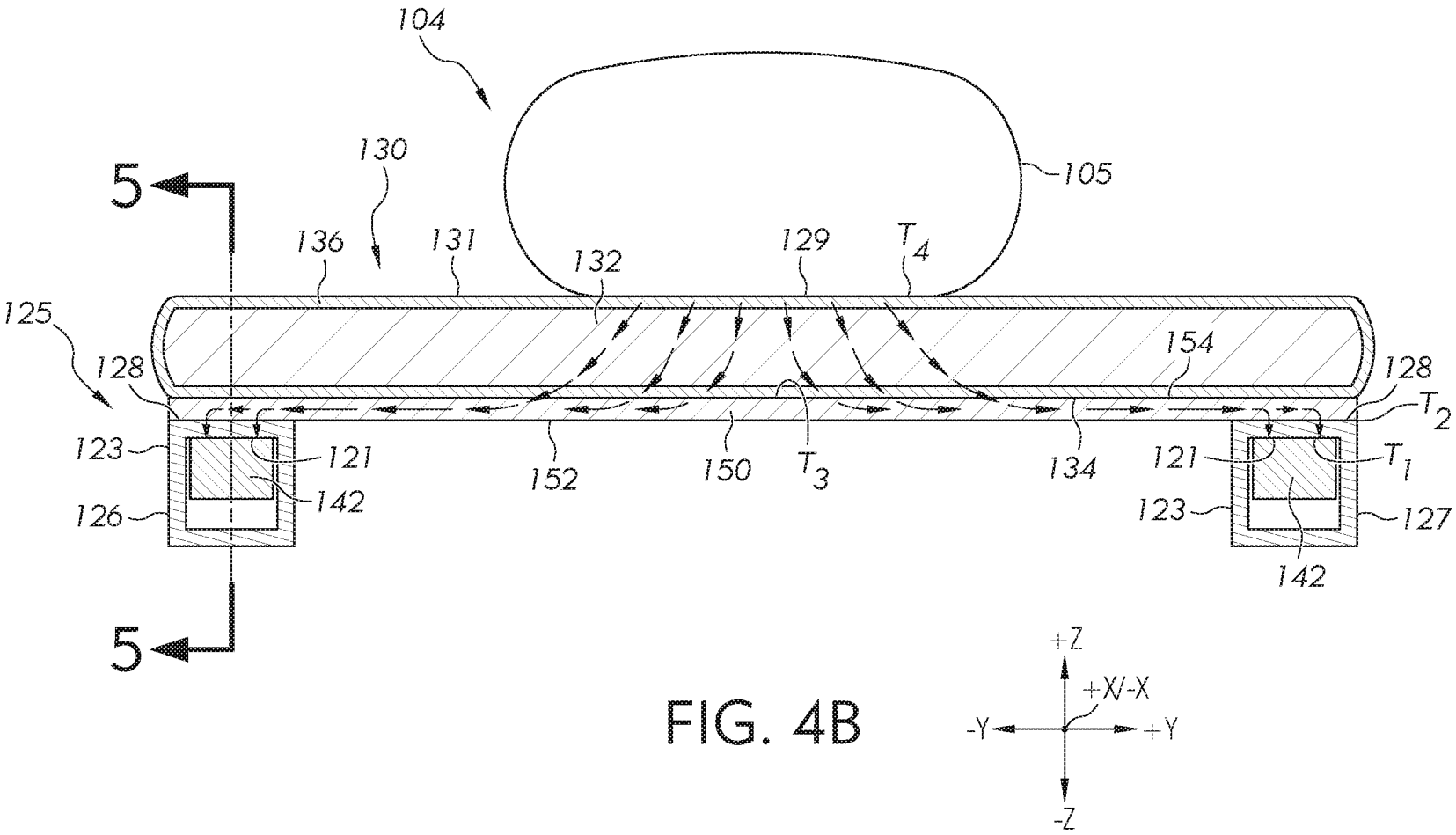
FIG. 4B schematically depicts a cross-section of the table top assembly of FIG. 4A, in accordance with one or more embodiments described herein.

The person support system 101 includes one or a plurality of cooling features to provide focal cooling of portions of the deck 150 that support targeted areas (e.g., the scapular areas, the sacral areas, the buttocks, the heals, the head, and the like) of a subject positioned on the person support system 101. In some embodiments, focal cooling of portions of the deck 150 provide focal cooling to the regions 129 of the support pad 130 that are in contact with the targeted areas of a subject. In embodiments, the targeted area of the subject may be cooled to a temperature that is from about 3° F. (1.7° C.) to about 25° F. (13.9° C.) less than body temperature. Referring to FIGS. 4A and 4B, embodiments of the cooling features 140 are depicted. FIG. 4A schematically depicts a bottom view of the longitudinal frame 125 of the person support system 101, and FIG. 4B schematically depicts a cross-section taken along section line 4B-4B in FIG. 4A. The cooling features 140 of the embodiments depicted in FIGS. 4A and 4B include one or a plurality of cooling sources 142 thermally coupled to the side rails 126, 127.

As shown in FIG. 4A, the cooling sources 142 may be positioned in the side rails 126, 127 of the longitudinal frame 125, foot frame 107, and/or head frame 108. The cooling features 140 also include the deck 150 supported by and thermally coupled to the side rails 126, 127 and the support pad 130 supported by and thermally coupled to the deck 150. In some embodiments, the cooling sources 142 may be positioned within the side rails 126, 127 such that the cooling sources 142 are thermally coupled to an internal surface 121 of the side rails 126, 127, as depicted in FIGS. 4A and 4B. Alternatively, in other embodiments, the cooling sources 142 may be positioned external to the side rails 126, 127 and thermally coupled to an external surface 123 of the side rails 126, 127. The cooling sources 142 may be positioned in the first side rail 126, the second side rail 127, or both the first and second side rails 126, 127. The cooling sources 142 may be positioned along the side rails 126, 127 at positions that are generally aligned with the portions of the deck 150 or regions 129 of the support pad 130 contacting the subject 105 (FIG. 4B) to provide focal cooling to these portions of the deck 150, which in turn may provide focal cooling to these regions 129 of the support pad 130. In embodiments, the cooling sources 142 may be aligned with the portions of the deck 150 and/or regions 129 of the support pad 130 in the +/−Y directions of the coordinate axes of FIGS. 4A and 4B. Alternatively, in other embodiments, the cooling sources 142 may be positioned to provide cooling to portions of the side rails 126, 127 that are aligned with the portions of the deck 150 and/or regions 129 of the support pad 130 in the +/−Y directions of the coordinate axes of FIGS. 4A and 4B.

The cooling sources 142 positioned along the side rails 126, 127 may be at a lower temperature than a deck top surface temperature $T_3$, which is measured at the top surface 154 of the deck 150 at portions of the deck 150 corresponding to the regions 129 of the support pad 130 contacting the subject, such that an overall temperature gradient between the top surface 154 of the deck 150 and the cooling source 142 promotes active conduction of heat away from the top surface 154 of the deck 150, through the deck 150, through the side rails 126, 127, and to the cooling source 142. This temperature gradient in turn causes conduction of heat away from the regions 129 of the top surface 131 of the support pad or away from portions of other support structures contacting the subject.

Referring still to FIGS. 4A and 4B, the cooling sources 142 actively remove heat from the internal surface 121 or external surface 123 of the side rails 126, 127. The removal of heat from the side rails 126, 127 reduces the temperature $T_1$ of the internal surface 121 or external surface 123 of the side rails 126, 127 thereby creating a temperature gradient between the internal surface 121 or external surface 123 of the side rails 126, 127 and the upper surface 128 of the side rails 126, 127. The temperature gradient causes heat conduction through the side rail 126, 127 from the upper surface 128 of the side rail 126, 127 towards the internal surface 121 or external surface 123 of the side rail 126, 127 being cooled by the cooling source 142. Removal of heat from the upper surface 128 of the side rails 126, 127 reduces a side rail upper surface temperature $T_2$.

The deck 150 is thermally coupled to the side rails 126, 127 through contact of the bottom surface 152 of the deck 150 with the upper surface 128 of the side rails 126, 127. The side rail upper surface temperature $T_2$ of the upper surface 128 of the side rails 126, 127 may be less than the deck top surface temperature $T_3$ measured at the top surface 154 of the deck 150 at portions of the deck 150 that support the subject 105. For example, $T_3$ may be measured at the top surface 154 of the deck 150 directly vertically below (i.e., in the −Z direction of the coordinate axes of FIG. 4B) the region 129 of contact between the subject 105 and the top surface 131 of the support pad 130. The difference between the side rail upper surface temperature $T_2$ and the deck top surface temperature $T_3$ creates a temperature gradient in the deck 150 that causes conductive heat flow from the top surface 154 of the deck 150, through the deck 150, to the upper surface 128 of the side rails 126,127. Conduction of heat from the top surface 154 of the deck 150, through the deck 150, to the upper surface 128 of the side rails 126, 127 reduces the deck top surface temperature $T_3$.

In embodiments in which the support pad 130 is supported by and thermally coupled to the deck 150 through contact of a bottom surface 134 of the support pad 130 with the top surface 154 of the deck 150, the deck top surface temperature $T_3$ may be less than a support pad top surface temperature $T_4$ measured at the top surface 131 of the support pad 130 in the region 129 of the support pad 130 in contact with the subject 105. In the region 129 of the support pad 130 contacting the subject 105, the top surface 131 of the support pad 130 absorbs body heat from the subject. The temperature difference between the support pad top surface temperature $T_4$ and the deck top surface temperature $T_3$ creates a temperature gradient in the support pad 130 that causes conductive heat flow from the top surface 131 of the support pad 130, through the support pad 130, to the top surface 154 of the deck 150. Conduction of heat from the top surface 131 of the support pad 130, through the support pad 130, to the top surface 154 of the deck 150 reduces the support pad top surface temperature $T_4$ in the regions 129 of the support pad 130 in contact with the subject supported by the person support system 101. Although FIG. 4B shows the subject 105 supported by the support pad 130 on the deck 150, it is understood that the subject 105 may also be supported directly by the top surface 154 of the deck 150 and cooled directly thereby.

As shown by the arrows in FIGS. 4A and 4B, by way of the previously described temperature gradients, heat from a subject 105 supported by the person support system 101 is conducted from the top surface 131 of the support pad 130, through the support pad 130 to the top surface 154 of the deck 150, through the deck 150 to the upper surface 128 of the side rails 126, 127, and through the side rails 126, 127 to the cooling source 142. The cooling source(s) 142 removes the heat from the side rails 126, 127 and absorbs and/or disperses the heat in a heat sink. Heat conduction through the support pad 130 may be generally downward (i.e., in the −Z direction of the coordinate axes in the figures) and slightly outward (i.e., in the +/−Y directions of the coordinate axes in the figures). Heat conduction through the deck may be generally outward (i.e., generally in the +/−Y direction of the coordinate axes in the figures and towards the side rails 126, 127) and slightly downward. In embodiments in which the subject 105 is supported directly on the top surface 154 of the deck, heat from the subject 105 is conducted from the top surface 154 of the deck 150, through the deck 150 to the upper surface 128 of the side rails 126, 127, and through the side rails 126, 127 to the cooling source 142. The cooling source(s) 142 removes the heat from the side rails 126, 127 and absorbs and/or disperses the heat in a heat sink.

Heat conduction from the top surface 131 of the support pad 130, through the support pad 130, deck 150, and side rails 126, 127, to the cooling source 142 may reduce the heat stored in the support pad 130. The heat conduction from the top surface 131 of the support pad 130 to the cooling source 142 may reduce the support pad top surface temperature $T_4$ to a temperature sufficient to maintain the skin temperature of the subject 105 at the point of contact of the subject 105 with the top surface 131 of the support pad 130 in a range of from 70° F. to 95° F., from 70° F. to 85° F., or about 75° F. The support pad top surface temperature $T_4$ may be maintained in a range of from 65° F. to 85° F., from 65° F. to 75° F., or about 70° F. To maintain the support pad top surface temperature $T_4$ at the desired temperature, the cooling source 142 may maintain the side rail internal surface temperature $T_1$ in a range of from 35° F. to 65° F., or from 40° F. to 60° F., or about 50° F. The cooling source 142 may maintain the deck top surface temperature $T_3$ in a range of from 45° F. to 75° F., from 50° F. to 70° F., or about 60° F. The temperatures $T_1$, $T_2$, $T_3$, and $T_4$ may vary depending upon external factors, such as the presence and type of an accessory 590 (FIG. 16) used with the person support system 101, the overall thickness of the support pad 130, the type of materials used in the support pad 130, the type of material used for the deck 150, the type of material used for the side rails 126, 127, the weight and metabolism of the subject, the ambient temperature, other factor, or combinations of these, for example.

In embodiments in which the subject 105 is supported directly by the top surface 154 of the deck 150, the heat conduction from the top surface 154 of the deck 150 to the cooling source 142 may reduce the deck top surface temperature $T_3$ to a temperature sufficient to maintain the skin temperature of the subject 105 at the point of contact of the subject 105 with the top surface 154 of the deck 150 in a range of from 70° F. to 95° F., from 70° F. to 85° F., or about 75° F. To maintain the deck top surface temperature $T_3$ at the target temperature, the cooling source 142 may maintain the side rail internal surface temperature $T_1$ in a range of from 55° F. to 85° F., from 60° F. to 75° F., from 65° F. to 70° F., or about 70° F. The temperatures $T_1$, $T_2$, and $T_3$ may vary depending upon external factors, such as the presence and type of an accessory 590 (FIG. 16) used with the person support system 101 or any other support structure (e.g., blanket, mattress, matt, bolster, linen, or other structure) positioned between the top surface 154 of the deck 150 and the subject 105.

Figure 5:
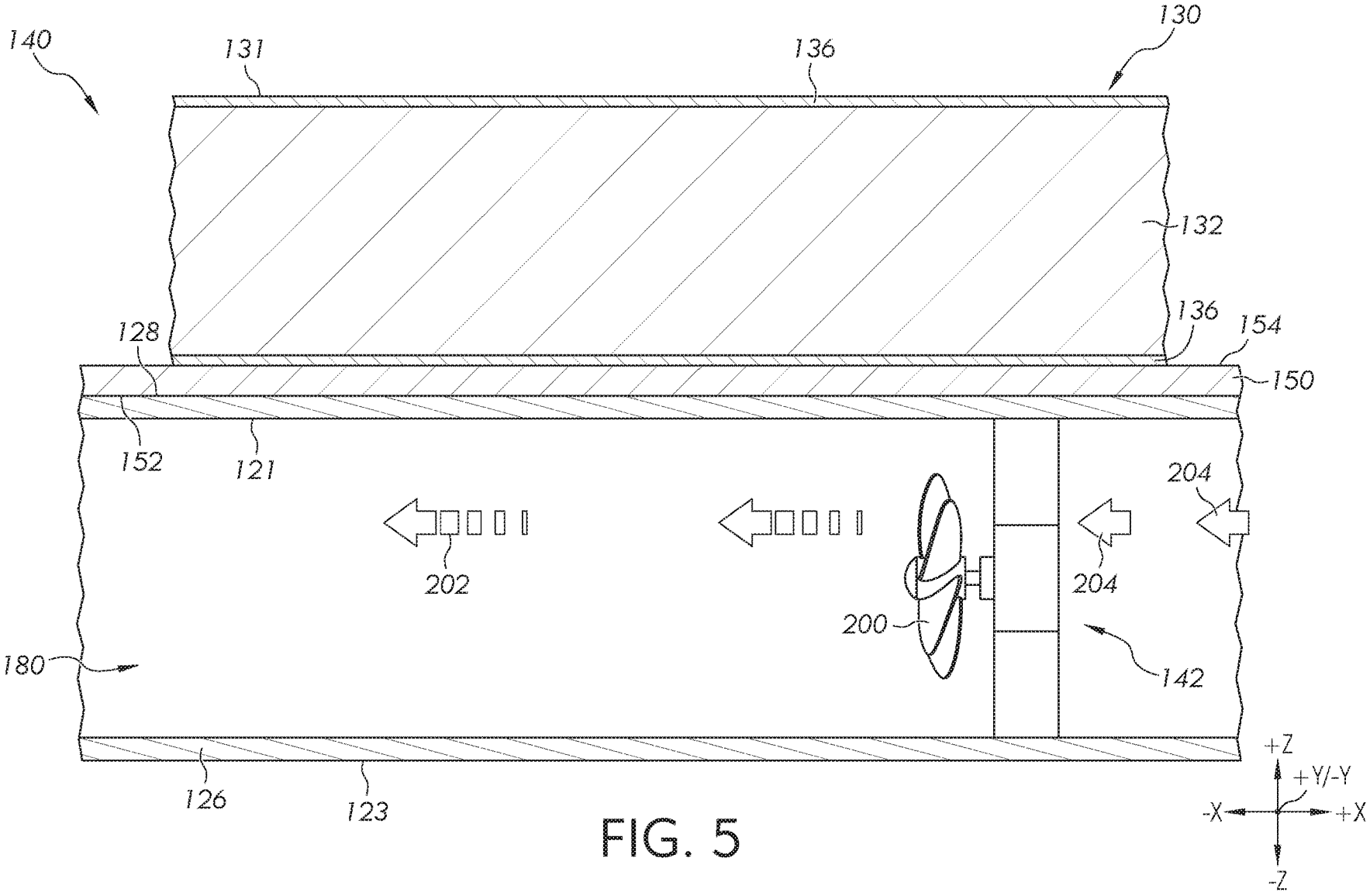
FIG. 5 schematically depicts an embodiment of a cooling feature of the table top assembly of FIG. 4B, in accordance with one or more embodiments described herein.

Various embodiments of the cooling sources 142 will now be described in detail with specific reference to the figures. Referring now to FIGS. 4A, 4B and 5, FIG. 5 schematically depicts one embodiment of a cross-section of the side rail 126, deck 150, and support pad 130 of FIGS. 4A and 4B in which the side rail 126 contains a cooling source 142. In this embodiment, the cooling source 142 comprises a blower 200 disposed within the interior channel 180 of the side rail 126. While FIG. 5 schematically depicts the blower 200 as a conventional bladed fan, it should be understood that other blowers are contemplated and possible, including without limitation, centrifugal blowers and the like. Further, while FIG. 5 depicts the blower 200 positioned within the interior channel 180, it should be understood that other configurations are contemplated and possible, including configurations in which the blower 200 is located external to the side rail 126 and the output fluid 202 (e.g., air, schematically depicted with a block arrow) is coupled into the side rail 126 with a conduit (not shown).

In the embodiment depicted in FIG. 5, the internal surfaces 121 of the side rail 126 are thermally coupled to the cooling source 142, specifically the blower 200, with the output fluid 202 directed through interior channel 180 of the side rail 126. Specifically, the blower 200 draws in feed fluid 204 (e.g., air, schematically depicted by a block arrow) and outputs the output fluid 202 to create a flow of the output fluid 202 through the side rail 126. As the output fluid 202 passes through the side rail 126 and across the internal surfaces 121 of the side rail 126, heat conducted from the support pad 130, through the deck 150, and through the side rail 126 to the internal surface 121 of the side rail 126 is dissipated into the interior channel 180 of the side rail 126 by forced convection, thereby cooling at least a portion of the support pad 130.

While the feed fluid 204 and the output fluid 202 are described as air in the embodiment depicted in FIG. 5, it should be understood that other fluids are possible and contemplated. For example, in some embodiments the feed fluid 204 may be, for example, an inert gas, such as nitrogen. Alternatively, the feed fluid 204 may be a combination of gases. In embodiments, the temperature of the feed fluid 204 may be reduced by conditioning the feed fluid 204 to increase convection of heat from the internal surface 121 of the side rail 126 and, hence, increase the extraction of heat from the support pad 130. In such embodiments, the temperature of the feed fluid 204 may be conditioned by passing the feed fluid 204 over or through dry ice such that the feed fluid 204 is a mixture of, for example, atmospheric air and $CO_2$ or nitrogen and $CO_2$. As another example, the feed fluid 204 may be conditioned by injecting liquid nitrogen into the feed fluid 204 such that the feed fluid 204 is a mixture of, for example, atmospheric air and $N_2$ vapor or nitrogen and $N_2$ vapor. As still another example, the feed fluid 204 may be passed through a heat exchanger (not shown) in which a phase change of a working fluid flowing through a cooling element draws heat out of the feed fluid 204 flowing past the cooling element to reduce the temperature of the feed fluid 204.

In still other embodiments, the temperature of the feed fluid 204 may be increased to reduce convection of heat from the internal surfaces of the side rail 126 and, hence, reduce the extraction of heat from the deck 150. For example, in embodiments, the feed fluid 204 may be passed over or through a heater, such as an electrical resistance heater or the like, which increases the temperature of the feed fluid 204 and reduces the convection of heat from the internal surfaces 121 of the side rail 126.

In still other embodiments, the convection of heat from the internal surfaces 121 of the side rail 126 may be controlled by controlling the volume flow rate of output fluid 202 flowing through the interior channel 180 of the side rail 126. For example, when more heat extraction from the internal surfaces 121 of the side rail 126 is desired (i.e., when more cooling of the deck 150 is desired), the volume flow rate of output fluid 202 directed through the interior channel 180 of the side rail 126 may be increased, by, for example, increasing the rotational velocity of the blower 200. Conversely, when less heat extraction from the internal surfaces 121 of the side rail 126 is desired (i.e., when less cooling of the deck 150 is desired), the volume flow rate of the output fluid 202 directed through the interior channel 180 of the side rail 126 may be decreased, by, for example, decreasing the rotational velocity of the blower 200.

While FIG. 5 schematically depicts convection of heat directly from the internal surfaces 121 of the side rail 126, it should be understood that other embodiments are contemplated and possible. For example, referring to FIGS. 6A and 6B, at least one internal surface 121 of the side rail may be thermally coupled to a heat transfer plate 210 comprising a plurality of fins 212 (FIG. 6B). The fins 212 of the heat transfer plate 210 provide greater surface area for convective heat transfer. The heat transfer plate 210, including the fins 212 may be made from a thermally conductive material, such as copper or copper alloys for example, such that the heat transfer plate 210 conducts heat from the internal surface 121 of the side rail 126 out to the outer surfaces 214 (FIG. 6B) of the fins 212. The heat transfer plate 210 and/or fins 212 may be made from other thermally conductive materials, such as the thermally conductive metals, polymers, and/or carbon fibers discussed herein in relation to the deck 150 and side rail 126.

The heat transfer plate 210 may be physically coupled to the internal surface 121 of the side rail 126 so that heat can be transferred from the side rail 126 to the heat transfer plate 210 through conduction. In some embodiments, the heat transfer plate 210 may be physically coupled to the internal surface 121 of the side rail 126 using one or more fasteners such as screws, clips, rivets, hook-and-loop fasteners (e.g., Velcro® brand hook and loop fasteners), other fasteners, or combinations of fasteners. Alternatively, in other embodiments, the heat transfer plate 210 may be coupled to the internal surface 121 of the side rail 126 using a thermally conductive adhesive, thermally conductive grease, other thermally conductive material, or combinations thereof. In still other embodiments, the heat transfer plate 210 may be received in a bracket (not shown) coupled to the internal surface 121 of the side rail 126. In some embodiments, the heat transfer plate 210 may be formed integral with the side rail 126. The outer surfaces 214 of the fins 212 are thermally coupled to the output fluid 202 from the blower 200 through convective heat transfer.

The heat transfer plate 210 thermally couples the internal surface 121 of the side rail 126 to the output fluid 202 from the blower 200. In operation, the blower 200 draws in feed fluid 204 (e.g., air, schematically depicted by a block arrow) and outputs output fluid 202 to create a flow of fluid through the side rail 126. As the output fluid 202 flows through the side rail 126, the output fluid 202 flows between the fins 212 of the heat transfer plate. As the output fluid 202 passes between the fins 212 of the heat transfer plate, heat conducted from the top surface 154 of the deck 150, through the deck 150, through the side rail 126, and through the heat transfer plate to the outer surface 214 of the fins 212 is dissipated into the interior channel 180 of the side rail 126 by forced convection, thereby cooling at least a portion of the support pad 130.

While the feed fluid 204 has been described herein as being a gas directed through the interior channel 180 of the side rail 126, it should be understood that other embodiments are contemplated and possible. For example, in an alternative embodiment, the feed fluid 204 may be a liquid, such as water, liquid nitrogen, or a coolant, directed through the interior channel 180 of the side rail 126 with a pump rather than a blower.

Figure 7A:
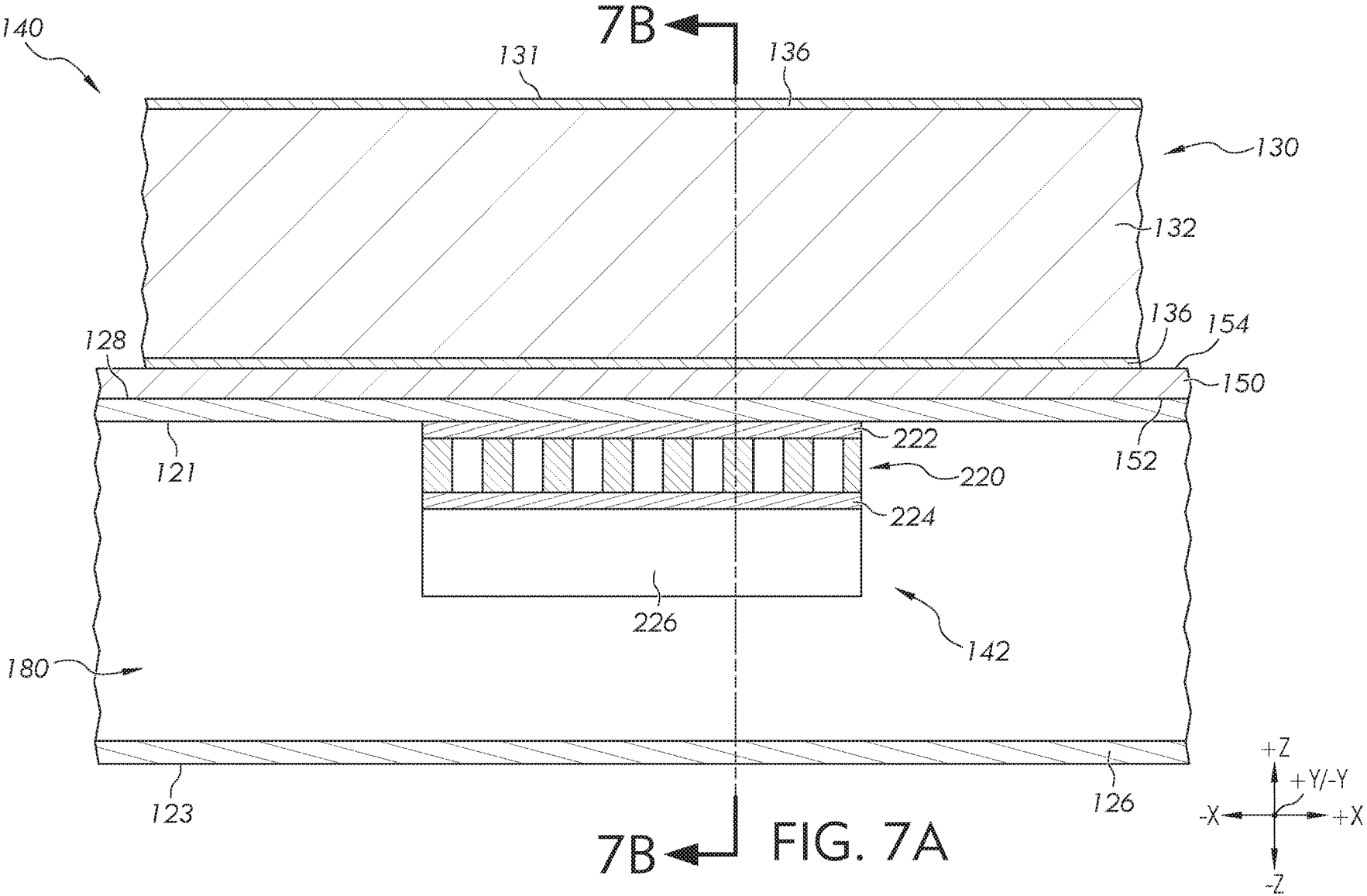
FIG. 7A schematically depicts yet another embodiment of a cooling feature of the table top assembly of FIG. 4B, in accordance with one or more embodiments described herein.
Figure 7B:
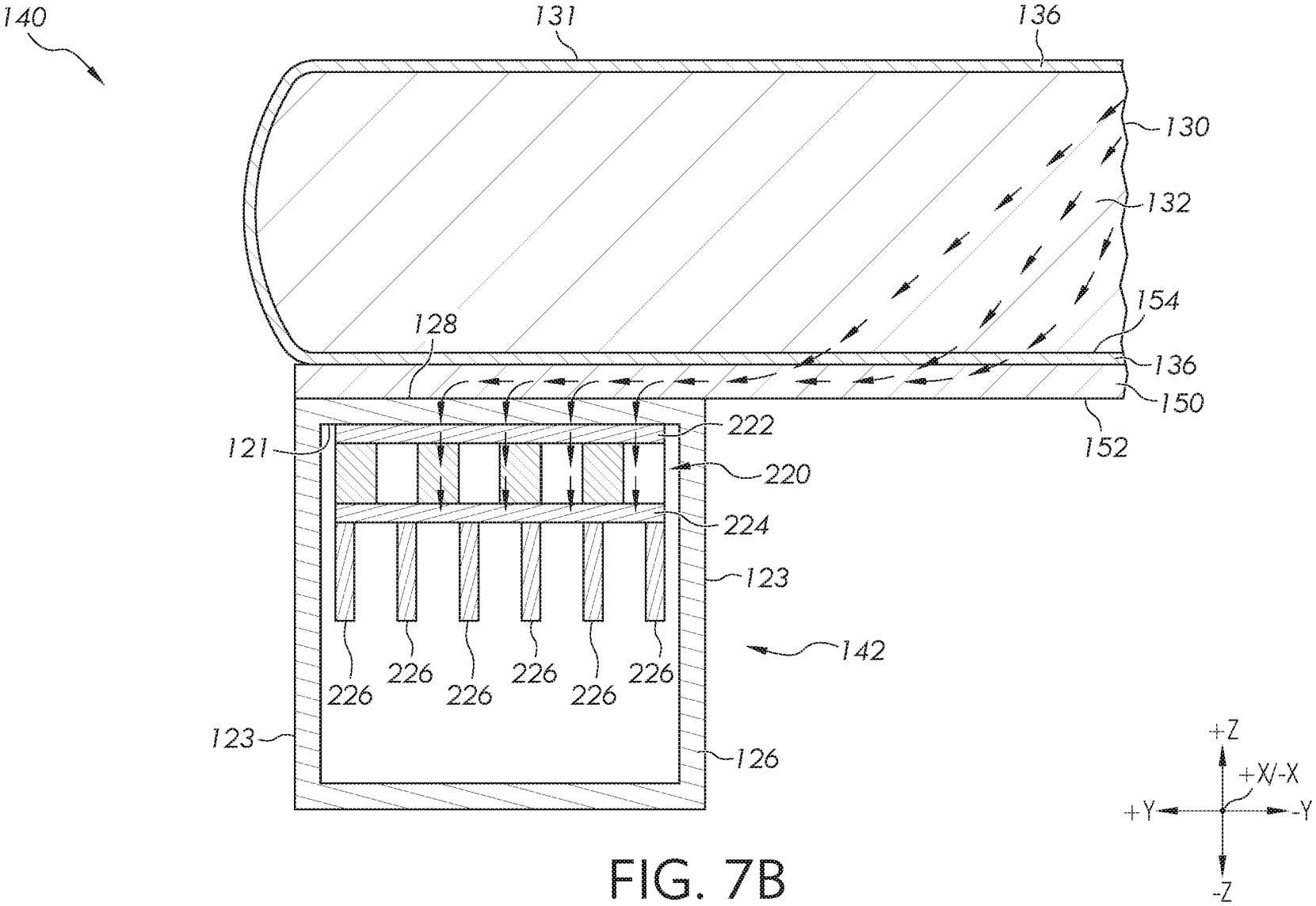
FIG. 7B schematically depicts a cross-section of the cooling feature of FIG. 7A, in accordance with one or more embodiments described herein.

Referring now to FIGS. 4A, 4B, 7A, and 7B, FIG. 7A schematically depicts one embodiment of a cross-section of the side rail 126, deck 150, and the support pad 130 of FIG. 4A in which the side rail 126 contains a cooling source 142. In this embodiment, the cooling source 142 comprises a thermoelectric cooler 220, such as a Peltier cooler, disposed within the interior channel 180 of the side rail 126. While FIGS. 7A and 7B depict the thermoelectric cooler 220 positioned within the interior channel 180, it should be understood that other configurations are contemplated and possible, including configurations in which the thermoelectric cooler 220 is located external to the side rail 126, such as when the thermoelectric cooler 220 is mounted to an external surface 123 of the side rail 126.

As shown in FIG. 7A, a cooling plate 222 of the thermoelectric cooler 220 may be thermally coupled to an internal surface 121 of the side rail 126. The thermoelectric cooler 220 may be operatively coupled to a power source (e.g., DC current or other power source). When the thermoelectric cooler 220 is operatively coupled to a power source and powered on, a temperature differential is created between the cooling plate 222 and a heating plate 224 of the thermoelectric cooler 220 resulting in heat input into the cooling plate 222 being pumped to the heating plate 224 where it may be dissipated. For example, as shown in FIG. 7B, in some embodiments, the heating plate 224 of the thermoelectric cooler 220 may include cooling fins 226 to aid in the dissipation of heat from the heating plate 224. In embodiments, the cooling fins 226 may be made from a thermally conductive material, such as copper or copper alloys for example, such that the cooling fins 226 conduct heat from the heating plate 224 of the thermoelectric cooler 220 out to the outer surfaces of the cooling fins 226. The cooling fins 226 may be made from other thermally conductive materials, such as the thermally conductive metals, polymers, and/or carbon fibers discussed herein in relation to the deck 150 and side rail 126. The heat may be dissipated from the heating plate 224 and/or the cooling fins 226 by, for example, radiation or a combination of radiation and convection, such as when a fan or blower is used to direct an output fluid over the heating plate 224 and/or cooling fins 226. Accordingly, it should be understood that, in some embodiments, the thermoelectric cooler 220 may further include a fan or blower (e.g., such as blower 200 in FIGS. 5, 6A and 6B) to assist with the dissipation of heat from the heating plate 224.

The thermoelectric cooler 220 may be physically coupled to the internal surface 121 of the side rail 126 with the cooling plate 222 thermally coupled to the internal surface 121 of the side rail 126 so that heat can be transferred from the side rail 126 to the cooling plate 222 of the thermoelectric cooler 220 through conduction. In some embodiments, the thermoelectric cooler 220 may be physically coupled to the internal surface 121 of the side rail 126 using one or more fasteners such as screws, clips, rivets, hook-and-loop fasteners (e.g., Velcro® brand hook and loop fasteners), other fasteners, or combinations of fasteners. Alternatively, in other embodiments, the thermoelectric cooler 220 may be coupled to the internal surface 121 of the side rail 126 using a thermally conductive adhesive, thermally conductive grease, other thermally conductive material, or combinations thereof. In still other embodiments, the thermoelectric cooler 220 may be received in a bracket (not shown) coupled to the internal surface 121 of the side rail 126.

Alternatively, the thermoelectric cooler 220 may be positioned external to the side rail 126. For example, in embodiments, the cooling plate 222 of the thermoelectric cooler 220 may be thermally coupled to an external surface 123 of the side rail 126. In some embodiments, the cooling plate 222 of the thermoelectric cooler 220 may be physically and thermally coupled directly to an external surface 123 of the side rail 126. In these embodiments, the cooling plate 222 of the thermoelectric cooler 220 may be physically coupled to the external surface 123 of the side rail 126 using fasteners, thermally conductive adhesive, thermally conductive grease, or other thermally conductive materials as discussed herein.

As shown in FIG. 7B, in operation, heat conducted from the top surface 154 of the deck 150 is conducted through the deck 150 to the side rail 126, and through the side rail 126 to the cooling plate 222 of the thermoelectric cooler 220. The heat is then pumped from the cooling plate 222 to the heating plate 224 of the thermoelectric cooler 220 and, thereafter, dissipated. The flow of heat from the top surface 154 of the deck 150 to the heating plate 224 of the thermoelectric cooler 220 results in cooling of at least a portion of the top surface 154 of the deck 150, which may thereby cool at least a portion of the support pad 130 or other support structure supported by the deck 150.

In the embodiments depicted in FIGS. 7A and 7B, the amount of heat extracted from the deck 150 and/or the rate of heat extracted from the deck 150 may be controlled by, for example, adjusting the input voltage and/or current into the thermoelectric cooler 420. In embodiments in which a blower (e.g., blower 200 of FIG. 5) is used to dissipate heat from the heating plate 224, the amount of heat extracted from the deck 150 and/or the rate of heat extracted from the deck 150 may additionally be controlled by, for example, controlling the volume of output fluid 202 flowing through the interior channel 180 of the side rail 126 by controlling a speed of the blower. Alternatively, the amount of heat extracted from the deck 150 and/or the rate of heat extracted from the deck 150 may be controlled by controlling the temperature of the output fluid 202 (FIG. 5).

Further, while FIGS. 7A and 7B depict a single thermoelectric cooler 220, it should be understood that other embodiments are contemplated and possible. In alternative embodiments, for example, a plurality of thermoelectric coolers 220 may be thermally coupled to a plurality of internal surfaces 121 and/or external surfaces 123 of the side rail 126.

Referring now to FIGS. 4A, 4B, 8A, and 8B, FIG. 8A schematically depicts one embodiment of a cross-section of the side rail 126, deck 150, and support pad 130 of FIG. 4B in which the side rail 126 contains a cooling source 142. In this embodiment, the cooling source 142 comprises a canister 240 containing thermally absorptive material 242. The canister 240 is disposed within the interior channel 180 of the side rail 126. In the embodiment depicted in FIG. 8A, the canister 240 may be constructed from a thermally conductive metal, such as, without limitation, copper or a copper alloy. The thermally absorptive material 242 contained in the canister 240 may include, without limitation, phase change materials, oils having relatively high heat capacities, dry ice, water ice, liquid nitrogen, or the like. Suitable phase change materials include, without limitation, alkanes having a melting temperature greater than or equal to about 5° C. and less than or equal to about 35° C. Examples of suitable alkanes include, without limitation, tetradecane, pentadecane, hexadecane, heptadecane, octadecane, and nonadecane. Suitable high heat capacity oils include, without limitation, mineral oils, silicon oils, fluorocarbon oils, and the like.

The canister 240 may be thermally coupled to the side rail 126. In some embodiments, the canister 240 may be positioned in the side rail 126 such that an outer surface 246 of the canister 240 contacts an internal surface 121 of the side rail 126. In embodiments, the canister 240 may be physically coupled to the internal surface 121 of the side rail 126 such that heat is transferred from the side rail 126 to the canister 240 through conduction. In some embodiments, the canister 240 may be physically coupled to the internal surface 121 of the side rail 126 using one or more fasteners such as screws, clips, rivets, hook-and-loop fasteners (e.g., Velcro® brand hook and loop fasteners), other fasteners, or combinations of fasteners. Alternatively, in other embodiments, the canister 240 may be coupled to the internal surface 121 of the side rail 126 using a thermally conductive adhesive, thermally conductive grease, other thermally conductive material, or combinations thereof. In still other embodiments, the canister 240 may be received in a bracket (not shown) coupled to the internal surface 121 of the side rail 126.

Figure 8A:
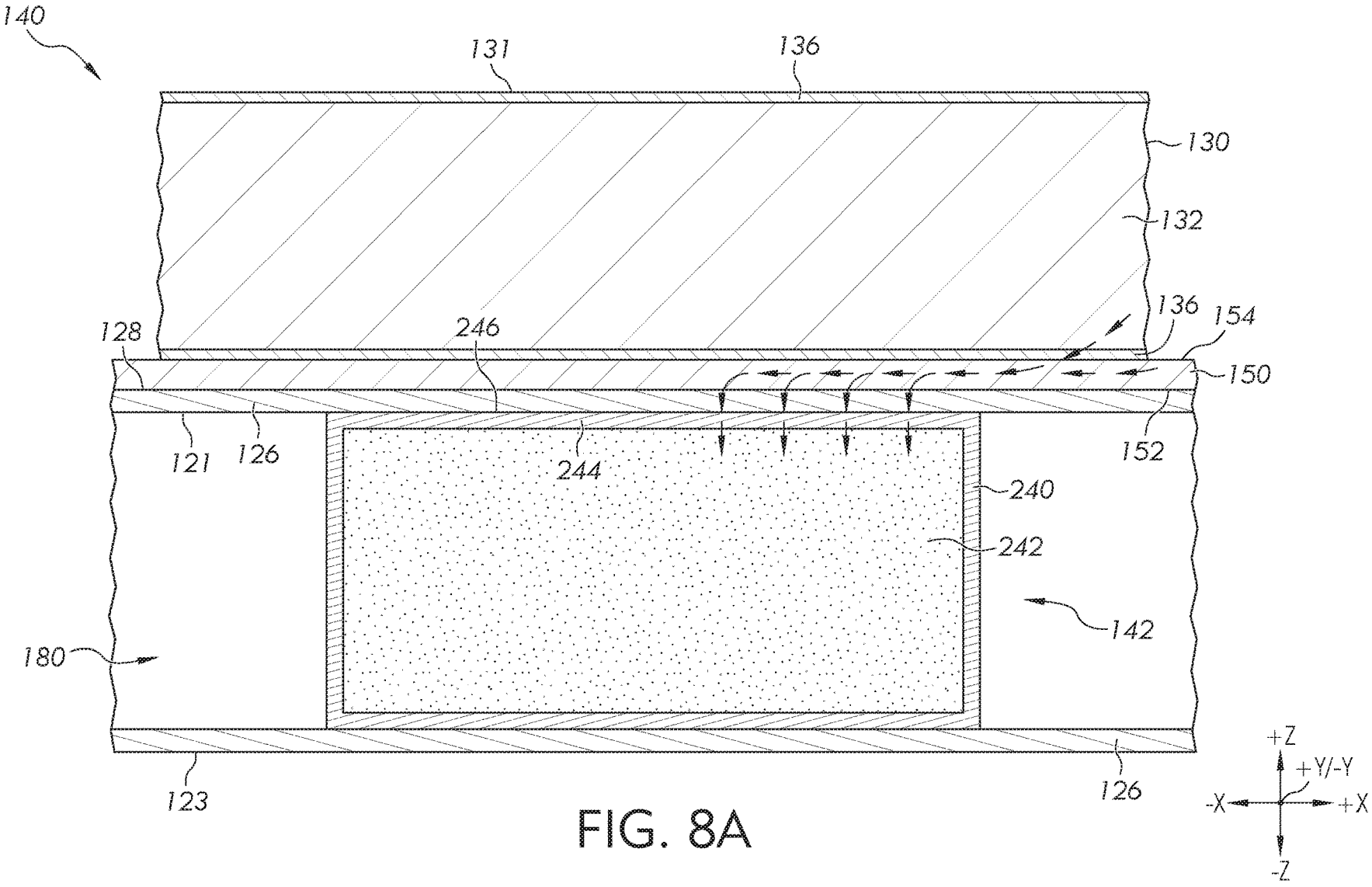
FIG. 8A schematically depicts still another embodiment of a cooling feature of the table top assembly of FIG. 4B, in accordance with one or more embodiments described herein.

While FIG. 8A depicts the canister 240 as being located within the side rail 126, it should be understood that other embodiments are contemplated and possible, such as embodiments in which the canister 240 is mounted external to the side rail 126. For example, the canister 240 may be mounted to an external surface 123 of the rail 126 such that the outer surface 246 of the canister 240 contacts and is thermally coupled to the external surface 123 of the rail 126.

In operation, heat conducted from the deck 150 is conducted through the deck 150 to the side rail 126, and through the side rail 126 to the outer surface 246 of the canister 240. From there, the heat is conducted through the wall 244 of the canister 240 and into the thermally absorptive material 242 contained within the canister 240. The heat is absorbed by the thermally absorptive material 242. The flow of heat from the top surface 154 of the deck, through the deck 150, side rail 126, and canister 240, to the thermally absorptive material 242 of the canister 240 results in cooling of at least a portion of the top surface 154 of the deck 150.

In embodiments, heat conduction from the top surface 154 of the deck 150 to the thermally absorptive material 242 may continue until the heat capacity of the thermally absorptive material 242 is reached and/or an equilibrium temperature is reached between the thermally absorptive material 242 and the top surface 154 of the deck 150, more specifically, between the thermally absorptive material 242 and the subject positioned on the person support system 101. When this occurs, and further cooling is desired, the canister 240 may be removed and replaced with a fresh canister of thermally absorptive material to continue the conduction of heat from the top surface 154 of the deck 150.

Figure 8B:
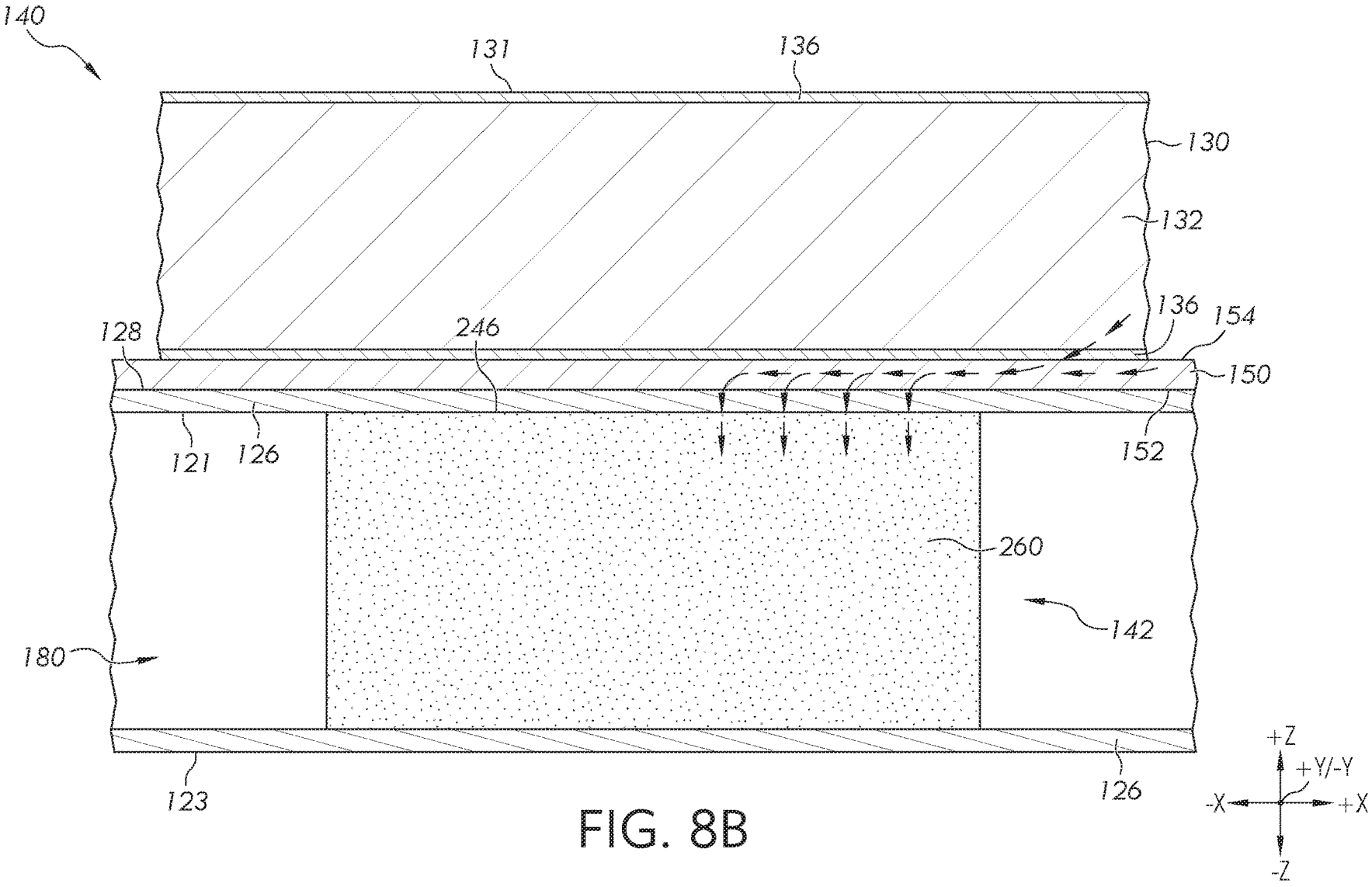
FIG. 8B schematically depicts another embodiment of a cooling feature of the table top assembly of FIG. 4B, in accordance with one or more embodiments described herein.

Referring now to FIG. 8B, a phase change material 260, such as dry ice or liquid nitrogen for example, may be positioned within the side rail 126. In embodiments, the phase change material 260 may be thermally coupled to an internal surface 121 of the side rail 126. The phase change material 260 may be directly thermally coupled to the side rail 126 without the canister 240 depicted in FIG. 8A.

Figure 9A:
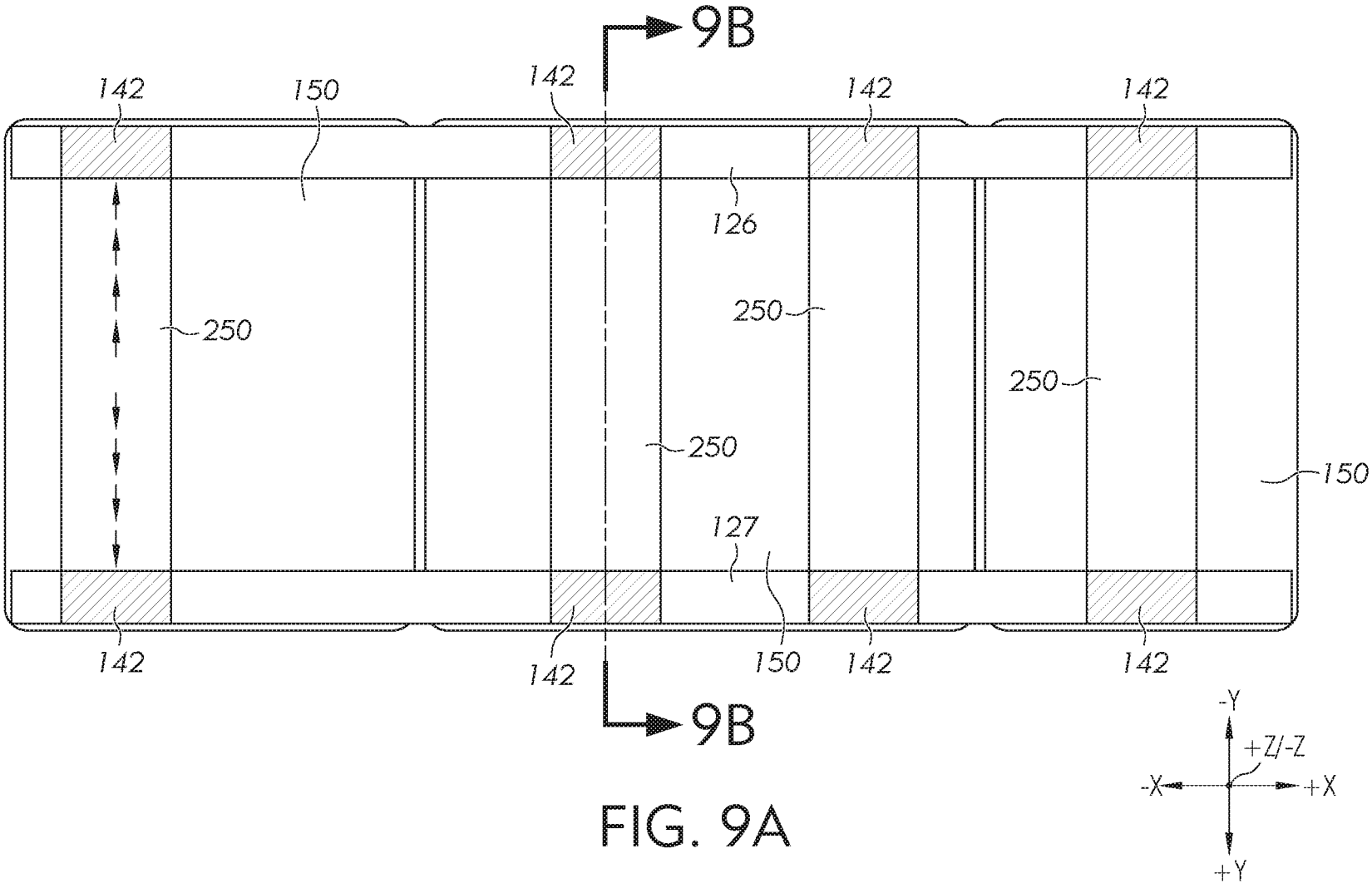
FIG. 9A schematically depicts a bottom view of another embodiment of a table top assembly of the person support system of FIG. 1 having a cooling feature, in accordance with one or more embodiments described herein.
Figure 9B:
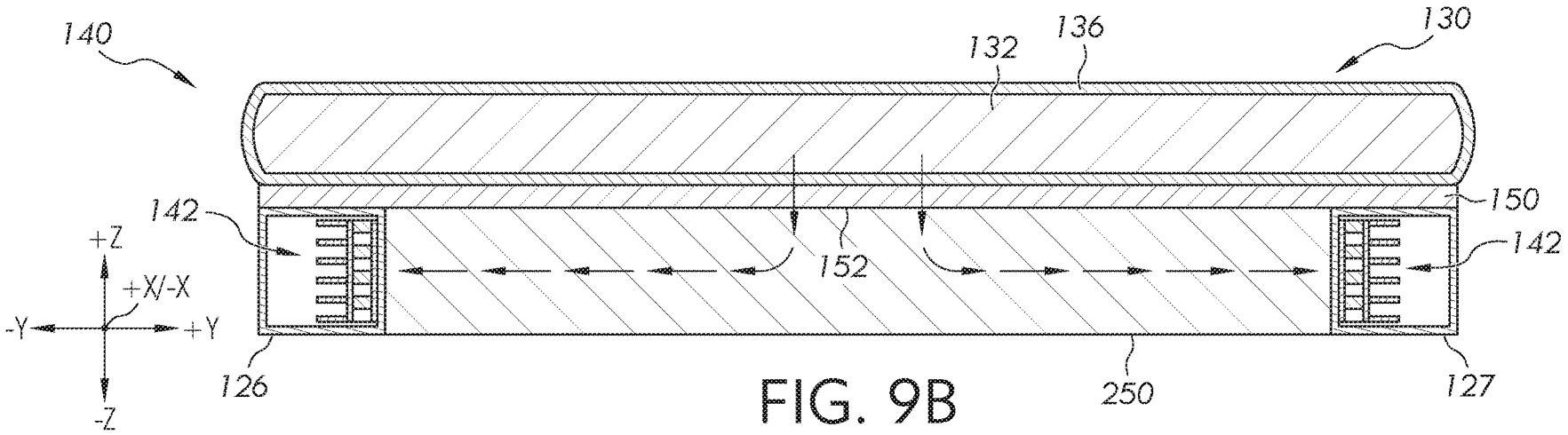
FIG. 9B schematically depicts a cross-section of the cooling feature of the table top assembly of FIG. 9A, in accordance with one or more embodiments described herein.

Referring to FIGS. 9A and 9B, one embodiment of the side rails 126, 127, deck 150, and support pad 130 is schematically depicted in which the cooling sources 142 are disposed in the side rails 126, 127 and thermally conductive cross-members 250 extend between the cooling sources 142. In the embodiment of FIG. 9A, the side rails 126, 127 each contain a cooling source 142. One or more thermally conductive cross-members 250 extend from the first side rail 126 to the second side rail 127 in the +/−Y direction of the coordinate axes of FIG. 9A. The thermally conductive cross-members 250 may be aligned with the cooling sources 142 in the +/−X direction of the coordinate axes of FIG. 9A. The thermally conductive cross-members 250 may extend between a cooling source 142 in the first side rail 126 to a cooling source 142 in the second side rail 127. The thermally conductive cross-members 250 may be thermally coupled to the deck 150 and the side rails 126, 127.

The thermally conductive cross-members 250 may be physically coupled to the bottom surface 152 of the deck 150, external surfaces 123 of the first side rail 126 and second side rail 127, or both so that heat can be transferred from the deck 150 to the thermally conductive cross-members 250 and from the thermally conductive cross-members 250 to the side rails 126, 127 through conduction. In some embodiments, the thermally conductive cross-members 250 may be physically coupled to the bottom surface 152 of the deck 150, external surfaces 123 of the first side rail 126 and second side rail 127, or both using one or more fasteners such as screws, clips, rivets, hook-and-loop fasteners (e.g., Velcro® brand hook and loop fasteners), other fasteners, or combinations of fasteners. Alternatively, in other embodiments, the thermally conductive cross-members 250 may be coupled to the bottom surface 152 of the deck 150, external surfaces 123 of the first side rail 126 and second side rail 127, or both using a thermally conductive adhesive, a thermally conductive grease, other thermally conductive materials, or combinations thereof. In still other embodiments, the thermally conductive cross-members 250 may be received in one or more brackets (not shown) coupled to the bottom surface 152 of the deck 150, external surfaces 123 of the first side rail 126 and second side rail 127, or both.

The thermally conductive cross-members 250 may be made from a thermally conductive material, such as copper or copper alloys for example, such that the thermally conductive cross-members 250 conduct heat from the bottom surface 152 of the deck 150 outward (i.e., in the +/−Y direction of the coordinate axes of FIG. 9A) to the side rails 126, 127. The thermally conductive cross-members 250 may be made from other thermally conductive materials, such as the thermally conductive metals, polymers, and/or carbon fibers discussed herein in relation to the deck 150 and side rail 126. In some embodiments, the thermally conductive cross-members 250 may be made from a thermally conductive material that is also a radiolucent material.

Referring to FIG. 9B, in operation, heat from the top surface 154 of the deck 150 may be conducted generally downward (i.e., −Z direction of the coordinate axes in FIG. 9B) through the deck 150, and into the thermally conductive cross-members 250. The heat is thermally conducted outward through the thermally conductive cross-members 250 towards the side rails 126, 127 in the +/−Y direction of the coordinate axes of FIG. 9B. The heat from the is conducted from the thermally conductive cross-members 250, through the side rails 126, 127, to the cooling sources 142. Although the cooling sources 142 are depicted as thermoelectric coolers in FIG. 9B, it is understood that the cooling sources 142 may be any of the cooling sources 142 described herein, such as the canister 240 of thermally absorptive material 242 of FIG. 8A, the blower 200 of FIG. 5, or the blower 200 and heat transfer plate 210 of FIGS. 6A and 6B. The flow of heat from the top surface 154 of the deck 150, through the deck 150, through the thermally conductive cross-members 250, through the side rails 126, 127, to the cooling source 142 results in cooling of at least a portion of the top surface 154 of the deck 150.

Figure 10:
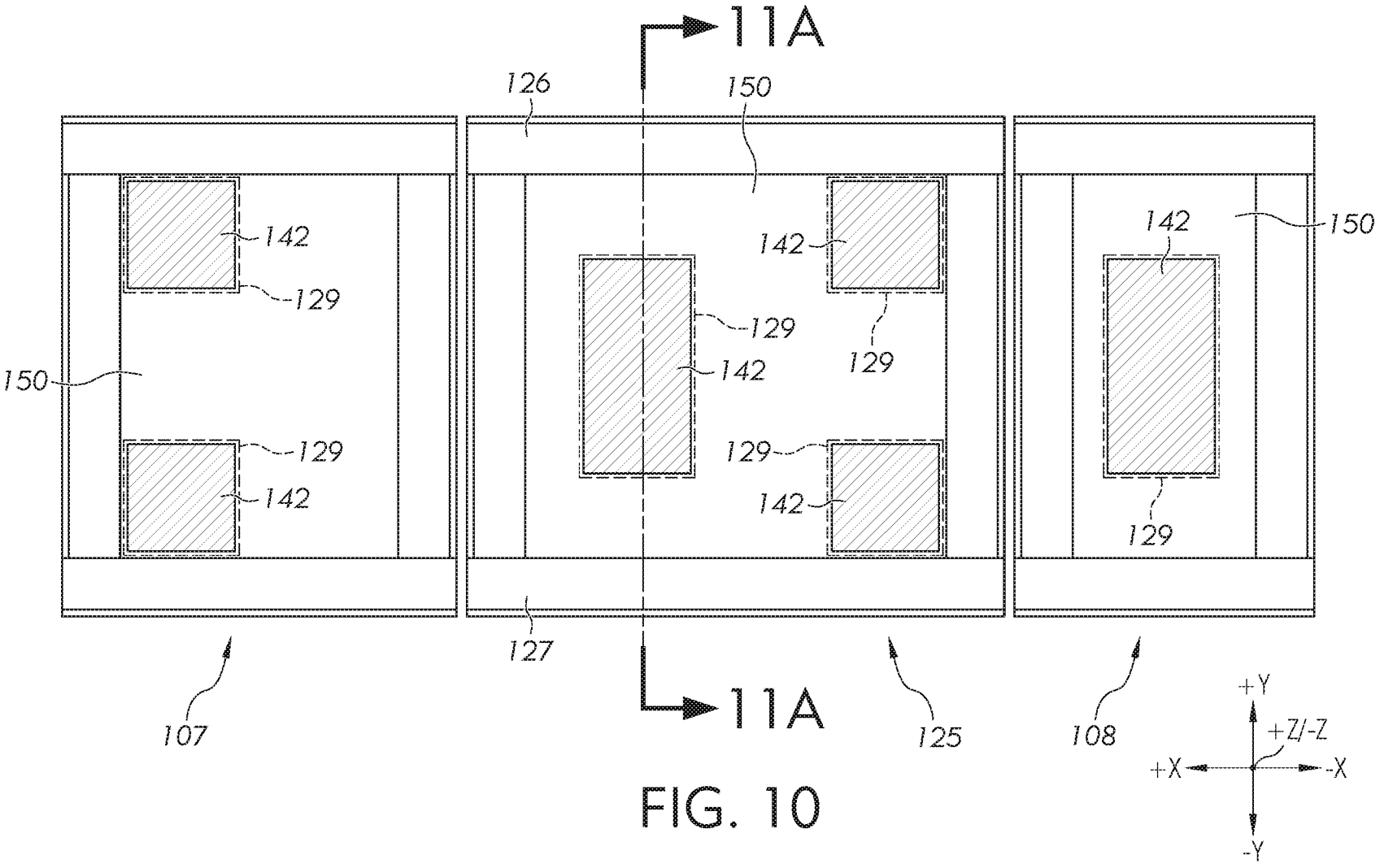
FIG. 10 schematically depicts a bottom view of yet another embodiment of a table top assembly of the person support system of FIG. 1 having one or more cooling features, in accordance with one or more embodiments described herein.
Figure 11A:
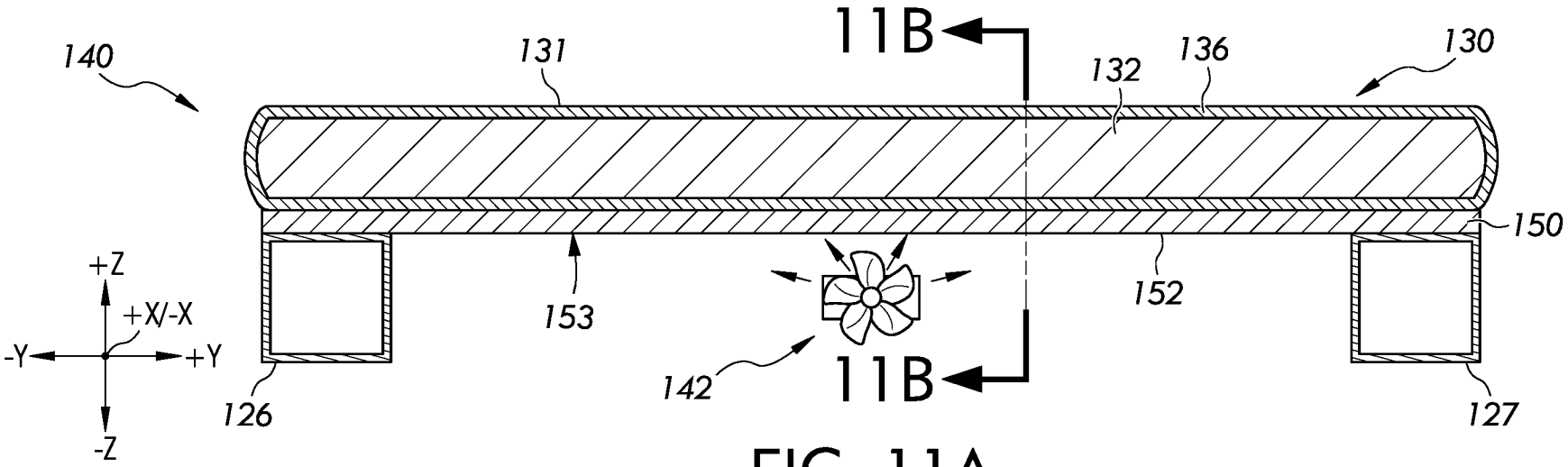
FIG. 11A schematically depicts an embodiment of the cooling features of the table top assembly of FIG. 10, in accordance with one or more embodiments described herein.

Referring to FIGS. 10 and 11A, embodiments of the person support system 101 with the cooling features 140 (i.e., the combination of one or more of a blower, heat transfer plate, thermoelectric cooler, or canister of thermally absorptive material thermally coupled to the deck as described herein) are depicted in which one or more cooling sources 142 (i.e., one or more of a blower, heat transfer plate, thermoelectric cooler, or canister of thermally absorptive material as described herein) are thermally coupled directly to the bottom surface 152 of the deck 150 of the person support system 101, such as the bottom exterior surface 153 of the deck 150. In operation, heat from the top surface 154 of the deck 150 is conducted vertically downward (i.e., −Z direction of the coordinate axes in FIG. 11A) through the deck 150 to the cooling source 142, where the heat is absorbed and/or dissipated. As shown in FIG. 10, the cooling sources 142 may be thermally coupled to the bottom surface 152 of the deck 150 at positions vertically aligned (i.e., +/−Z direction of the coordinate axes in FIG. 11A) with the targeted areas (e.g., scapular area, sacral area, buttocks, heals, head, or other area) of the subject supported by the person support system 101. Although FIG. 10 shows two cooling sources 142 used for each of the scapular area and heals of the subject, it should be understood that a single cooling source 142 may be used to cool each of these areas. Likewise, for other areas, such as the sacral area, buttocks, or head, one or a plurality of cooling sources 142 may be used to provide cooling to the portions of the top surface 154 of the deck 150 that support these areas of the subject.

Figure 11B:
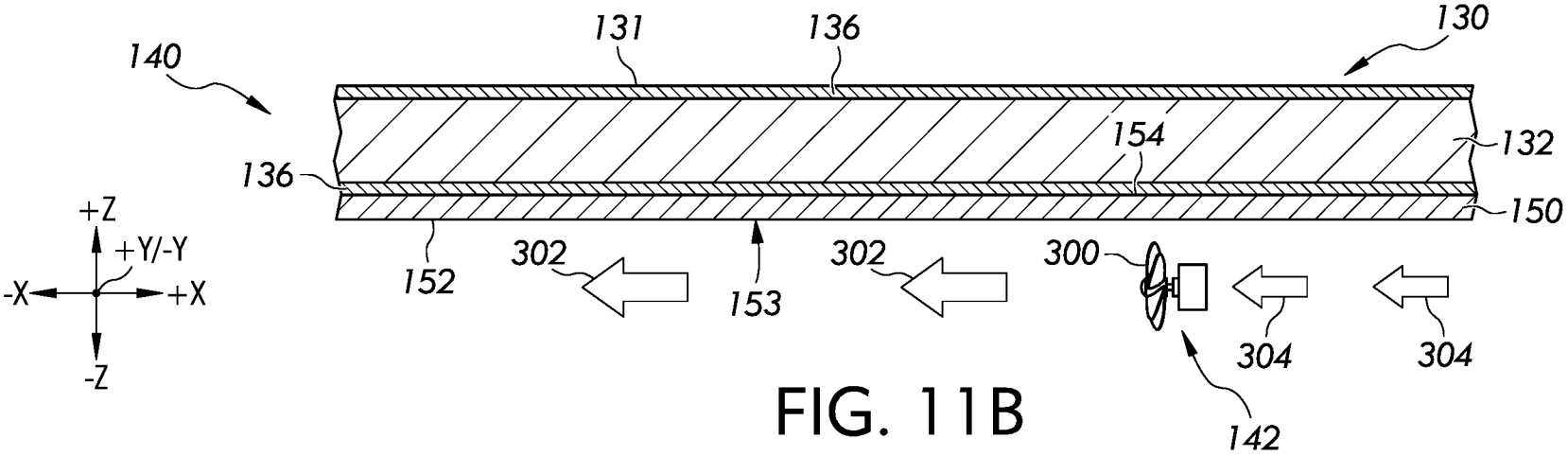
FIG. 11B schematically depicts a cross-section of the cooling feature of FIG. 11A, in accordance with one or more embodiments described herein.

Referring to FIGS. 11A and 11B, FIG. 11A schematically depicts one embodiment of a cross-section of the side rail 126, deck 150, and support pad 130 of FIGS. 4A and 4B in which a cooling source 142 is thermally coupled to the bottom surface 152 of the deck 150, such as to the bottom exterior surface 153 of the deck 150. In this embodiment, the cooling source 142 comprises a blower 300 positioned underneath the deck 150. The blower 300 may be oriented to the direct an output fluid 302 along the bottom surface 152 of the deck 150. While FIG. 11A schematically depicts the blower 300 as a conventional bladed fan, it should be understood that other blowers are contemplated and possible, including without limitation, centrifugal blowers and the like. Further, while FIG. 11A depicts the blower 300 positioned underneath the deck 150, it should be understood that other configurations are contemplated and possible, including configurations in which the blower 300 is located external to the person support system 101 and the output fluid 302 (e.g., air, schematically depicted with a block arrow) is directed to the bottom surface 152 of the deck 150 with a conduit (not shown).

Referring to FIG. 11B, the blower 300 draws in feed fluid 304 (e.g., air, schematically depicted by a block arrow) and outputs output fluid 302 to create a flow of fluid along the bottom surface 152 of the deck 150, such as along the bottom exterior surface 153 of the deck 150. As the output fluid 302 passes along the bottom surface 152 of the deck 150, heat conducted from the top surface 154 of the deck 150, through the deck 150, to the bottom surface 152 of the deck 150 is dissipated into the ambient air in the space below (i.e., −Z direction of the coordinate axes of FIGS. 11A and 11B) the deck 150 by forced convection, thereby cooling at least a portion of the top surface 154 of the deck 150.

While the feed fluid 304 and the output fluid 302 are described as air in the embodiment depicted in FIGS. 11A and 11B, it should be understood that other fluids are possible and contemplated. For example, in some embodiments the feed fluid 304 may be, for example, an inert gas, such as nitrogen. Alternatively, the feed fluid 304 may be a combination of gases. In embodiments, the temperature of the feed fluid 304 may be reduced by conditioning the feed fluid 304 to increase convection of heat from the bottom surface 152 of the deck 150 and, hence, increase the extraction of heat from the deck 150. In such embodiments, the temperature of the feed fluid 304 may be conditioned by passing the feed fluid 304 over or through dry ice such that the feed fluid 304 is a mixture of, for example, atmospheric air and $CO_2$ or nitrogen and $CO_2$. As another example, the feed fluid 304 may be conditioned by injecting liquid nitrogen into the feed fluid 304 such that the feed fluid 304 is a mixture of, for example, atmospheric air and $N_2$ vapor or nitrogen and $N_2$ vapor. As still another example, the feed fluid 304 may be passed through a heat exchanger in which a phase change of a working fluid flowing through a cooling element draws heat out of the feed fluid 304 flowing past the cooling element to reduce the temperature of the feed fluid 304.

In still other embodiments, the temperature of the feed fluid 304 may be increased to reduce convection of heat from the bottom surface 152 of the deck 150 and, hence, reduce the extraction of heat from the deck 150. For example, in embodiments, the feed fluid 304 may be passed over or through a heater, such as an electrical resistance heater or the like, which increases the temperature of the feed fluid 304 and reduces the convection of heat from the bottom surface 152 of the deck 150.

In still other embodiments, the convection of heat from the bottom surface 152 of the deck 150 may be controlled by controlling the volume flow rate of output fluid 302 flowing across the bottom surface 152 of the deck 150. For example, when more heat extraction from the bottom surface 152 of the deck 150 is desired (i.e., when more cooling of the deck 150 is desired), the volume flow rate of output fluid 302 directed along the bottom surface 152 of the deck 150 may be increased, by, for example, increasing the rotational velocity of the blower 300. Conversely, when less heat extraction from the bottom surface 152 of the deck 150 is desired (i.e., when less cooling of the deck 150 is desired), the volume flow rate of output fluid 302 directed along the bottom surface 152 of the deck 150 may be decreased by, for example, decreasing the rotational velocity of the blower 300.

While FIGS. 11A and 11B schematically depict convection of heat directly from the bottom surface 152 of the deck 150, it should be understood that other embodiments are contemplated and possible. For example, referring to FIG. 12A, the bottom surface 152 of the deck 150, such as the bottom exterior surface 153 of the deck 150, may be thermally coupled to a heat transfer plate 310 comprising a plurality of fins 312. The fins 312 of the heat transfer plate 310 provide greater surface area for convective heat transfer. The heat transfer plate 310, including the fins 312 may be made from a thermally conductive material, such as, but not limited to copper or copper alloys for example, such that the heat transfer plate 310 conducts heat from the bottom surface 152 of the deck 150 to the outer surfaces 314 of the fins 312. The heat transfer plate 310 and/or the fins 312 may be made from other thermally conductive materials, such as the thermally conductive metals, polymers, and/or carbon fibers discussed herein in relation to the deck 150 and side rail 126.

The heat transfer plate 310 may be physically coupled to the bottom surface 152 of the deck 150, such as to the bottom exterior surface 153 of the deck 150, so that heat can be transferred from the bottom surface 152 of the deck 150 to the heat transfer plate 310 through conduction. In some embodiments, the heat transfer plate 310 may be physically coupled to the bottom surface 152 of the deck 150 using one or more fasteners such as screws, clips, rivets, hook-and-loop fasteners (e.g., Velcro® brand hook and loop fasteners), other fasteners, or combinations of fasteners. In other embodiments, the heat transfer plate 310 may be coupled to the bottom surface 152 of the deck 150 using a thermally conductive adhesive, thermally conductive grease, other thermally conductive material, or combinations thereof. In still other embodiments, the heat transfer plate 310 may be received in a bracket (not shown) coupled to the bottom surface 152 of the deck 150. In some embodiments, the heat transfer plate 310 may be formed integral with the bottom surface 152 of the deck 150. The outer surfaces 314 of the fins 312 are thermally coupled to the output fluid 302 from the blower 300 through convective heat transfer.

Figure 12A:
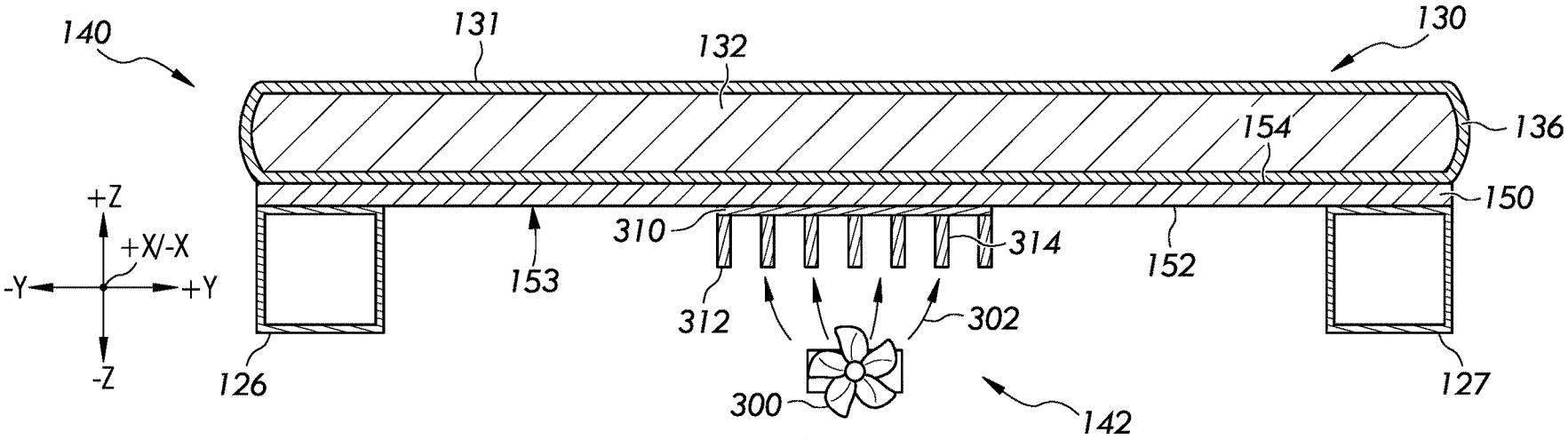
FIG. 12A schematically depicts another embodiment of the cooling features of the table top assembly of FIG. 10, in accordance with one or more embodiments described herein.

In some embodiments, the heat transfer plate 310 thermally couples the bottom surface 152 of the deck 150 to ambient air under the deck 150. In these embodiments, heat is transferred from the fins 312 of the heat transfer plate 310 to the ambient air through convection, radiation, or both convection and radiation. Alternatively, as illustrated in FIG. 12A, the blower 300 may be positioned to direct the output fluid 302 (e.g., air, schematically depicted by arrows in FIG. 12A) across and/or between the fins 312 of the heat transfer plate 310. The heat transfer plate 310 thermally couples the bottom surface 152 of the deck 150 to the output fluid 302 from the blower 300. In operation, the blower 300 draws in feed fluid 304 (FIG. 11B) and outputs output fluid 302 to create a flow of the output fluid 302 across the heat transfer plate 310. As the output fluid 302 flows across the heat transfer plate 310, the output fluid 302 flows between the fins 312 of the heat transfer plate 310. As the output fluid 302 passes between the fins 312 of the heat transfer plate 310, heat conducted from the top surface 154 of the deck 150, through the deck 150, and through the heat transfer plate 310 to the outer surface 314 of the fins 312 is dissipated into the ambient air in the space below (i.e., in the −Z direction of the coordinate axes) the deck 150 by forced convection, thereby cooling at least a portion of the top surface 154 of the deck 150.

Figure 13:
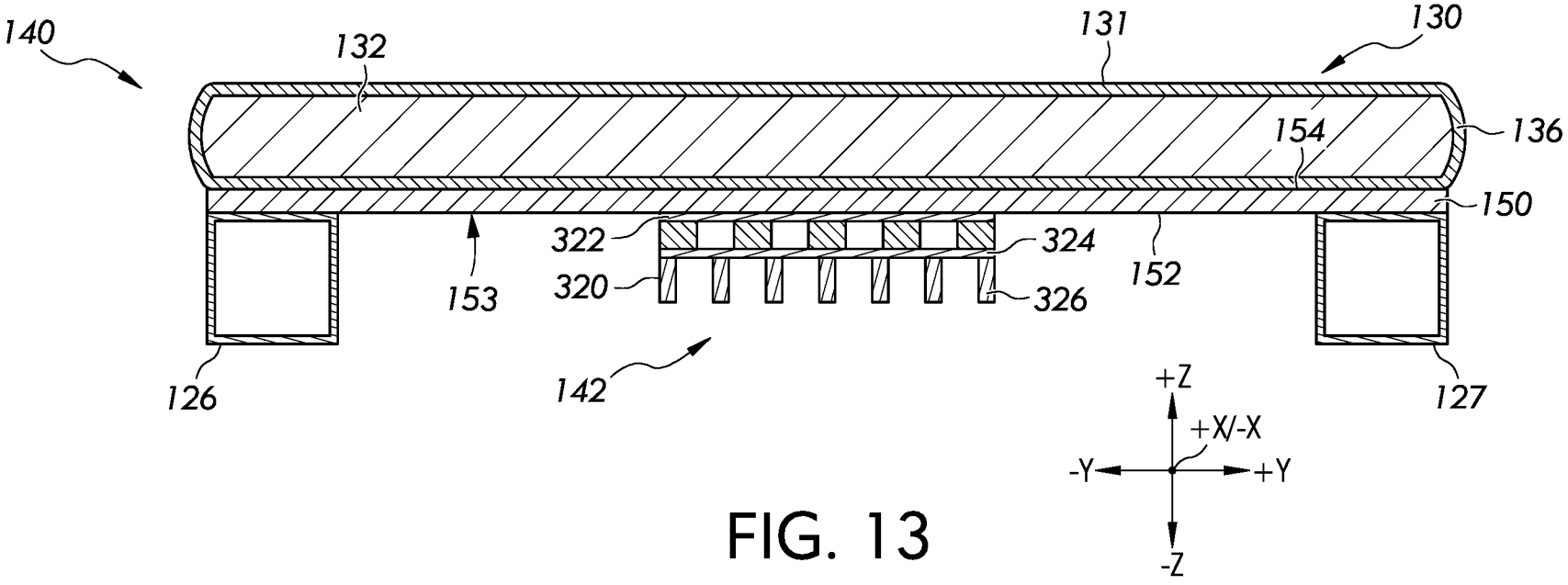
FIG. 13 schematically depicts yet another embodiment of the cooling features of the table top assembly of FIG. 10, in accordance with one or more embodiments described herein.

Referring now to FIG. 13, in some embodiments, the cooling source 142 may be a thermoelectric cooler 320, such as a Peltier cooler for example, thermally coupled to the bottom surface 152 of the deck 150, such as to the bottom exterior surface 153 of the deck 150. As shown in FIG. 13, a cooling plate 322 of the thermoelectric cooler 320 may be thermally coupled to the bottom surface 152 of the deck 150, such as to the bottom exterior surface 153 of the deck 150. The thermoelectric cooler 320 may be operatively coupled to a power source. When the thermoelectric cooler 320 is operatively coupled to a power source and powered on, a temperature differential is created between the cooling plate 322 and a heating plate 324 of the thermoelectric cooler 320 resulting in heat input into the cooling plate 322 being pumped to the heating plate 324 where it may be dissipated to the ambient air. For example, as shown in FIG. 13, in some embodiments, the heating plate 324 of the thermoelectric cooler 320 may include cooling fins 326 to aid in the dissipation of heat from the heating plate 324. In embodiments, the cooling fins 326 may be made from a thermally conductive material, such as copper or copper alloys for example, such that the cooling fins 326 conduct heat from the heating plate 324 of the thermoelectric cooler 320 to the outer surfaces of the cooling fins 326. The cooling fins 326 may be made from other thermally conductive materials, such as the thermally conductive metals, polymers, and/or carbon fibers discussed herein in relation to the deck 150 and side rail 126. The heat may be dissipated from the heating plate 324 and/or the cooling fins 326 by, for example, radiation or a combination of radiation and convection, such as when a fan or blower is used to direct an output fluid over the heating plate 324 and/or cooling fins 326. Accordingly, it should be understood that, in some embodiments, the thermoelectric cooler 320 may further include a fan or blower (e.g., such as blower 300 in FIGS. 11A, 11B, and 12A) to assist with the dissipation of heat from the heating plate 324.

The thermoelectric cooler 320 may be physically coupled to the bottom surface 152 of the deck 150, such as the bottom exterior surface 153 of the deck 150, with the cooling plate 322 thermally coupled to the bottom surface 152 of the deck 150 so that heat can be transferred from the bottom surface 152 of the deck 150 to the cooling plate 322 of the thermoelectric cooler 320 through conduction. In some embodiments, the thermoelectric cooler 320 may be physically coupled to the bottom surface 152 of the deck 150 using one or more fasteners such as screws, clips, rivets, hook-and-loop fasteners (e.g., Velcro® brand hook and loop fasteners), other fasteners, or combinations of fasteners. Alternatively, in other embodiments, the thermoelectric cooler 320 may be coupled to the bottom surface 152 of the deck 150 using a thermally conductive adhesive, thermally conductive grease, other thermally conductive material, or combinations thereof. In still other embodiments, the thermoelectric cooler 320 may be received in a bracket (not shown) coupled to the bottom surface 152 of the deck 150.

In operation, heat conducted from the top surface 154 of the deck 150 is conducted generally downward (i.e., the −Z direction of the axis of FIG. 13) through the deck 150 to the bottom surface 152 of the deck 150. The heat is then conducted from the bottom surface 152 of the deck 150 to the cooling plate 322 of the thermoelectric cooler 320. The heat is then pumped from the cooling plate 322 to the heating plate 324 of the thermoelectric cooler 320 and, thereafter, dissipated. The flow of heat from the top surface 154 of the deck 150 to the heating plate 324 of the thermoelectric cooler 320 results in cooling of at least a portion of the top surface 154 of the deck 150.

In the embodiments depicted in FIG. 13, the amount of heat extracted from the deck 150 and/or the rate of heat extracted from the deck 150 may be controlled by, for example, adjusting the input voltage and/or current into the thermoelectric cooler 320. In embodiments in which a blower (e.g., blower 300 of FIGS. 11A, 11B, and 12A) is used to dissipate heat from the heating plate 324, the amount of heat extracted from the deck 150 and/or the rate of heat extracted from the deck 150 may additionally be controlled by, for example, controlling the volume of output fluid 302 (FIG. 11B) flowing across the heating plate 324 of the thermoelectric cooler 320 by controlling a speed of the blower 300. Alternatively, the amount of heat extracted from the deck 150 and/or the rate of heat extracted from the deck 150 may be controlled by controlling the temperature of the output fluid 302 and/or the feed fluid 304 (FIG. 11B).

Figure 12B:
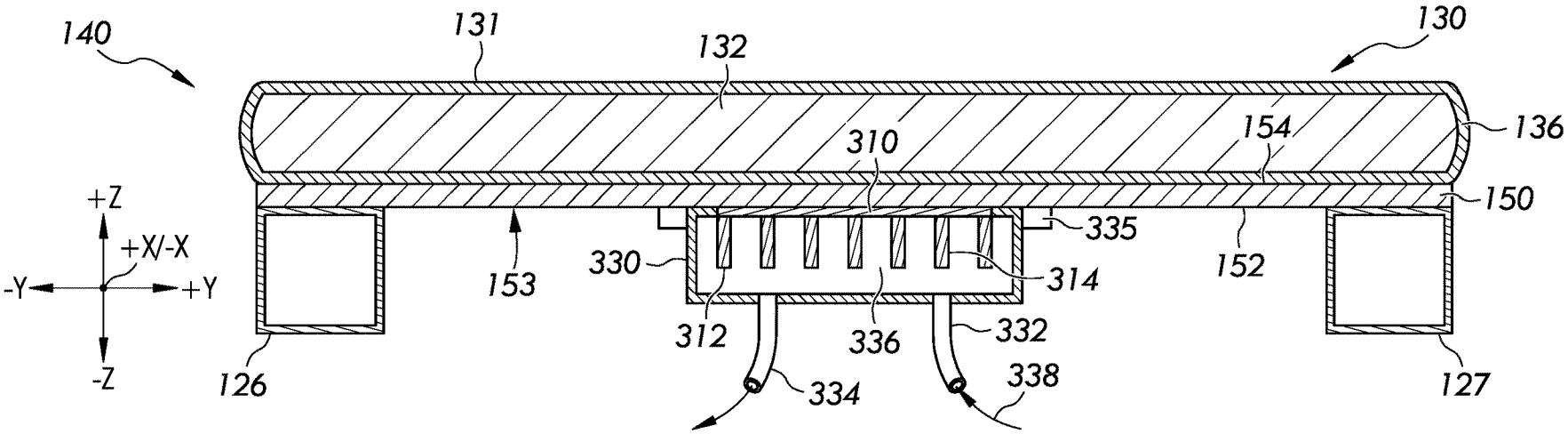
FIG. 12B schematically depicts another embodiment of the cooling features of the table top assembly of FIG. 10, in accordance with one or more embodiments described herein.

Referring now to FIG. 12B, in some embodiments, the cooling source 142 may include an enclosure 330 having a cooling fluid inlet 332 and a cooling fluid outlet 334. In some embodiments, the enclosure 330 may be removably coupled to the bottom surface 152 of the deck 150 and/or the heat transfer plate 310 and positioned to enclose the heat transfer plate 310 that is thermally coupled to the bottom surface 152 of the deck. The enclosure 330 may be coupled to the bottom surface 152 of the deck 150 and/or the heat transfer plate 310 with one or more couplers 335, such as fasteners, clips, brackets, other couplers, or combinations of these for example. A seal (not shown) may be disposed between the enclosure 330 and the bottom surface 152 of the deck 150 and/or the heat transfer plate 310 to create a fluid tight seal between the enclosure 330 and the bottom surface 152 of the deck 150 and/or the heat transfer plate 310. When coupled to the bottom surface 152 of the deck 150, the enclosure 330 and the heat transfer plate 310 combine to form a chamber 336 surrounding the fins 312 of the heat transfer plate 310. The fins 312 of the heat transfer plate 310 extend into the chamber 336. In some embodiments, the heat transfer plate 310 may be integral with the enclosure 330 such that the heat transfer plate 310 forms a top wall of the enclosure 330.

In operation of the enclosure 330, a cooling fluid 338 is introduced to the cooling fluid inlet 332. The cooling fluid 338 may be a cooling gas such as air for example. It should be understood that other fluids are contemplated for use as the cooling fluid 338. For example, in some embodiments the cooling fluid 338 may be an inert gas, such as nitrogen. Alternatively, the cooling fluid 338 may be a combination of gases, such as combinations of nitrogen, carbon dioxide, and/or other gases. In embodiments, the temperature of the cooling fluid 338 may be reduced by conditioning the cooling fluid 338 to increase convection of heat from the outer surfaces 314 of the fins 312 of the heat transfer plate 310, hence, increase the extraction of heat from the deck 150. In such embodiments, the temperature of the cooling fluid 338 may be conditioned by passing the cooling fluid 338 over or through dry ice such that the cooling fluid is a mixture of, for example, atmospheric air and $CO_2$ or nitrogen and $CO_2$. As another example, the cooling fluid 338 may be conditioned by injecting liquid nitrogen into the cooling fluid 338 such that the cooling fluid 338 is a mixture of, for example, atmospheric air and $N_2$ vapor or nitrogen and $N_2$ vapor. As still another example, the cooling fluid 338 may be passed through a heat exchanger (not shown) in which a phase change of a working fluid flowing through a cooling element draws heat out of the cooling fluid 338 flowing past the cooling element to reduce the temperature of the cooling fluid. In embodiments, the cooling fluid 338 may be a liquid capable of absorbing heat transfer from the fins 312 of the heat transfer plate 310 through convection. Examples of cooling fluids 338 include, but are not limited to, water, alcohols (e.g., methanol, ethanol, propanol, isopropanol, etc.), glycols (e.g., ethylene glycol, propylene glycol, etc.), other cooling fluids, and combinations of these. In some embodiments, the cooling fluid 338 is water. Alternatively, in other embodiments, the cooling fluid 338 comprises one or more alcohols. In still other embodiments, the cooling fluid 338 is a glycol.

The cooling fluid 338 passes through the chamber 336 where the cooling fluid 338 contacts the outer surfaces 314 of the fins 312 of the heat transfer plate 310. As the cooling fluid 338 contacts and flows past the outer surface 314 of the fins 312, heat transfers from the outer surfaces 314 of the fins to the cooling fluid 338 through convection. The cooling fluid 338 passes out of enclosure 330 from the cooling fluid outlet 334. The cooling fluid 338 may be discharged to the ambient environment, such as by discharging cooling air or other cooling gas to the ambient air or directing cooling water to a drain. Alternatively, the cooling fluid 338 may be returned to a heat exchanger (not shown) where the heat is transferred out of the cooling fluid 338.

Although FIG. 12B depicts the enclosure 330 enclosing the fins 312 of the heat transfer plate 310, in some embodiments, the enclosure 330 may also be used in conjunction with the thermoelectric cooler 320 depicted in FIG. 13. For example, the enclosure 330 may be positioned to enclose the heating plate 324 of the thermoelectric cooler 320 such that the cooling fins 326 of the heating plate 324 extend into the chamber 336 formed by the enclosure 330 and the heating plate 324. In operation, the cooling fluid 338 is introduced to the cooling fluid inlet 332 of the enclosure 330 and flows through the chamber 336 formed by the enclosure 330 and the heating plate 324 of the thermoelectric cooler 320. The cooling fluid 338 contacts and flows past the cooling fins 326 of the heating plate 324 of the thermoelectric cooler 320. Heat transfers from the cooling fins 326 of the heating plate 324 to the cooling fluid 338. The cooling fluid 338 then flows out of the chamber 336 through the cooling fluid outlet 334 of the enclosure 330.

Figure 14A:
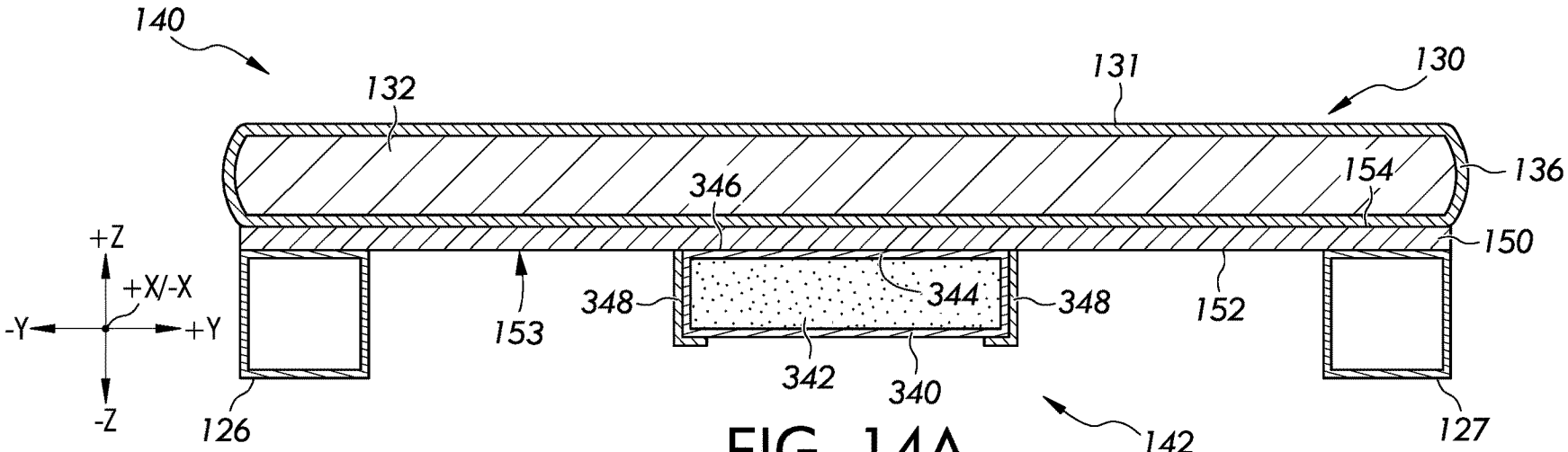
FIG. 14A schematically depicts still another embodiment of the cooling features of the table top assembly of FIG. 10, in accordance with one or more embodiments described herein.

Referring now to FIG. 14A, FIG. 14A schematically depicts one embodiment of a cross-section of the side rail 126, deck 150, and support pad 130 of FIG. 10 in which the cooling source 142 is coupled to the bottom surface 152 of the deck 150, such as to the bottom exterior surface 153 of the deck 150. In this embodiment, the cooling source 142 comprises a canister 340 containing thermally absorptive material 342. The canister 340 is coupled to the bottom surface 152 of the deck 150. In some embodiments, the canister 340 may be constructed from a thermally conductive metal, such as, without limitation, copper or a copper alloy for example such that the canister 340 conducts heat from the bottom surface 152 of the deck 150 to the thermally absorptive material 342 contained in the canister 340. The canister 340 may be made from other thermally conductive materials, such as the thermally conductive metals, polymers, and/or carbon fibers discussed herein in relation to the deck 150 and side rail 126.

The thermally absorptive material 342 contained in the canister 340 may include, without limitation, phase change materials, oils having relatively high heat capacities, dry ice, water ice, liquid nitrogen, or the like. Suitable phase change materials include, without limitation, alkanes having a melting temperature greater than or equal to about 5° C. and less than or equal to about 35° C. Examples of suitable alkanes include, without limitation, tetradecane, pentadecane, hexadecane, heptadecane, octadecane, and nonadecane. Suitable high heat capacity oils include, without limitation, mineral oils, silicon oils, fluorocarbon oils, and the like.

The canister 340 may be thermally coupled to the deck 150. In some embodiments, the canister 340 may be positioned against the bottom surface 152 of the deck 150, such as to the bottom exterior surface 153 of the deck 150, such that an outer surface 346 of the canister 340 contacts the bottom surface 152 of the deck 150. The canister 340 may be physically coupled to the bottom surface 152 of the deck 150 so that heat can be transferred from the bottom surface 152 of the deck 150 to the canister 340 through conduction. In some embodiments, the canister 340 may be physically coupled to the deck 150 using one or more fasteners such as screws, clips, rivets, hook-and-loop fasteners (e.g., Velcro® brand hook and loop fasteners), other fasteners, or combinations of fasteners. Alternatively, in other embodiments, the canister 340 may be coupled to the bottom surface 152 of the deck 150 using a thermally conductive adhesive, thermally conductive grease, other thermally conductive material, or combinations thereof. In still other embodiments, the deck 150 may include brackets 348 coupled to the bottom surface 152 of the deck 150. The brackets 348 may be sized to receive the canister 340 and maintain the canister 340 in contact with and/or thermally coupled to the bottom surface 152 of the deck 150.

In operation, heat from the top surface 154 of the deck 150 is conducted generally vertically downward (i.e., the −Z direction of the coordinate axes of FIG. 14) through the deck 150 to the canister 340. From there, the heat is conducted through a wall 344 of the canister 340 and into the thermally absorptive material 342 contained within the canister 340. The heat is absorbed by the thermally absorptive material 342. The flow of heat from the top surface 154 of the deck 150, through the deck 150 and canister 340, and to the thermally absorptive material 342 of the canister 340 results in cooling of at least a portion of the top surface 154 of the deck 150.

In embodiments, heat conduction from the deck 150 to the thermally absorptive material 342 may continue until the heat capacity of the thermally absorptive material 342 is reached and/or an equilibrium temperature is reached between the thermally absorptive material 342 and the top surface 154 of the deck 150, more specifically, a subject supported by the person support system 101. When this occurs, and further cooling is desired, the canister 340 may be removed and replaced with a fresh canister of thermally absorptive material to continue the conduction of heat from the top surface 154 of the deck 150.

Figure 14B:
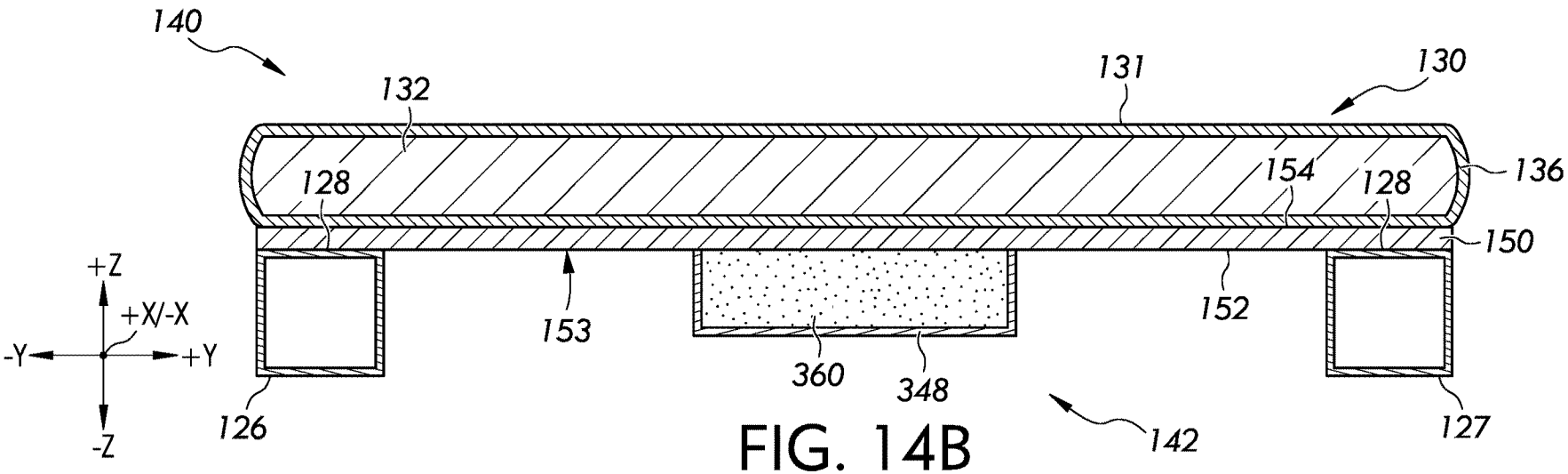
FIG. 14B schematically depicts another embodiment of the cooling features of the table top assembly of FIG. 10, in accordance with one or more embodiments described herein.

Referring now to FIG. 14B, a phase change material 360, such as dry ice or water ice for example, may be positioned within the side rail 126. In embodiments, the phase change material 360 may be thermally coupled to the bottom surface 152 of the deck 150. The phase change material 260 may be directly thermally coupled to the rail 126 without the canister 240 depicted in FIG. 14A. A bracket 362 or tray (not shown) may be coupled to the bottom surface 152 of the deck 150 and the phase change material 360 may be received in the bracket 362 or tray. The bracket 362 or tray may maintain the phase change material 360 thermally coupled to the bottom surface 152 of the deck 150.

Figure 15:
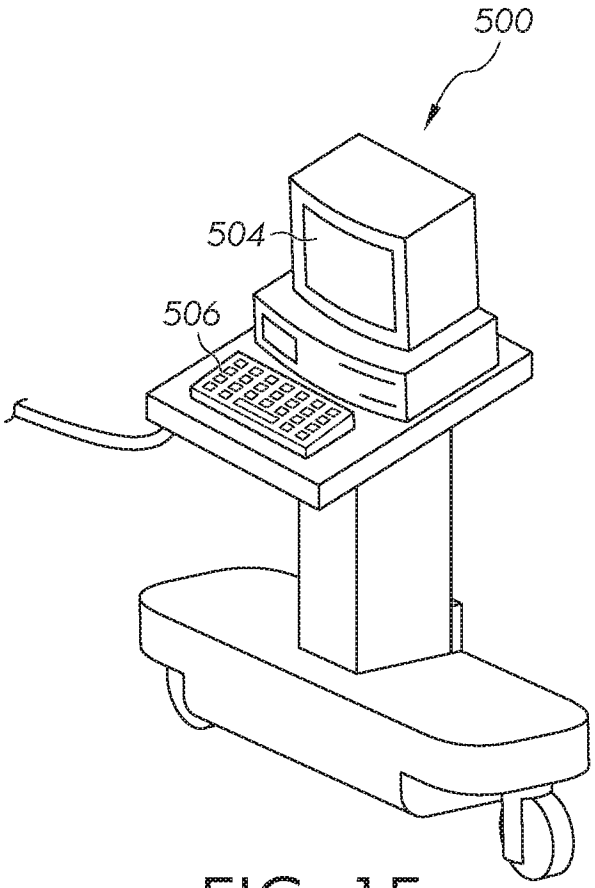
FIG. 15 schematically depicts a control unit of a person support system, in accordance with one or more embodiments described herein.
Figure 16:
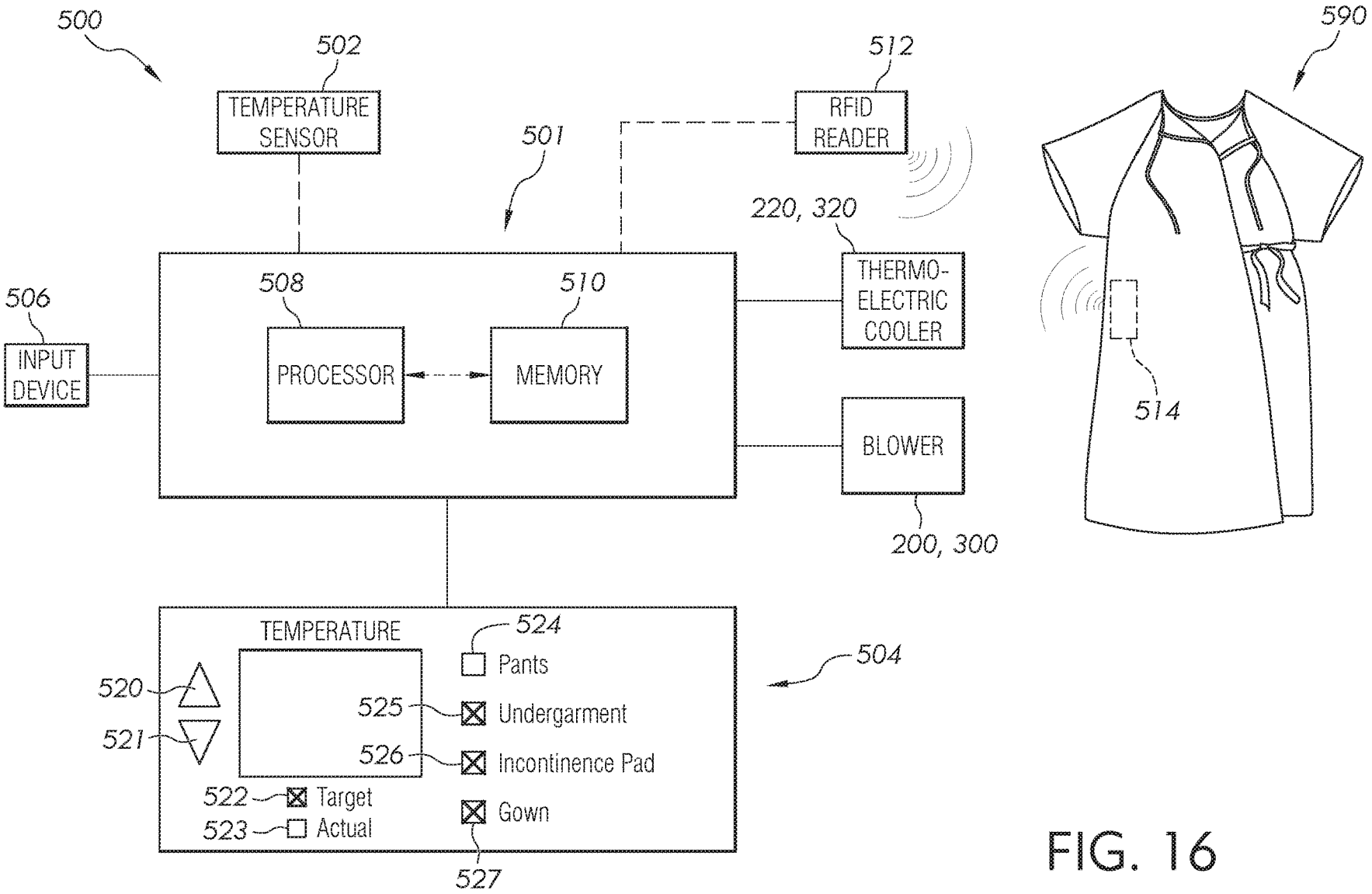
FIG. 16 schematically depicts the interconnectivity of various components of the control unit of a person support system, according to one or more embodiments described herein.

Referring now to FIGS. 1, 2, 3, 15, and 16, in some embodiments described herein, the person support system 101 may further include a control unit 500. FIG. 15 schematically depicts one embodiment of a control unit 500, and FIG. 16 schematically depicts the interconnectivity of various parts of the control unit 500 as well as components communicatively coupled to the control unit 500. In embodiments, the control unit 500 may be used to achieve a desired amount of cooling of the top surface 154 of the deck 150 through control of the cooling sources thermally coupled to the deck 150, as described in FIGS. 10, 11A, 11B, 12, 13, and 14; optionally through the side rails 126, 127, as described with respect to FIGS. 4A, 4B, 5, 6A, 6B, 7A, 7B, 8A, and 8B; and optionally through the thermally conductive cross-members 250 and side rails 126, 127, as described with respect to FIGS. 9A and 9B.

The control unit 500 may be, by way of example and not limitation, a computing device that includes a microcontroller 501 communicatively coupled to a display device 504. The microcontroller 501 may include a processor 508 that is communicatively coupled to a non-transitory memory 510 storing computer-readable and executable instructions, which, when executed by the processor, facilitate cooling of the deck 150 of the person support system 101. That is, in embodiments, when the computer-readable and executable instructions are executed by the processor 508, the control unit 500 regulates the temperature of at least a portion of the top surface 154 (FIG. 3) of the deck 150 (FIG. 3) of the person support system 101. The control unit 500 may enable a user, such as a caregiver, to manually adjust the cooling of the deck 150, as described further herein.

In embodiments, the control unit 500 may include a temperature sensor 502 communicatively coupled to the microcontroller 501. The temperature sensor 502 outputs a signal (i.e., a temperature signal) indicative of the temperature of an object on which it is positioned. In embodiments, the temperature sensor 502 may be communicatively coupled to the microcontroller 501 with wires or, alternatively, wirelessly, such as when the temperature sensor 502 includes an RF transmitter (or transceiver) for transmitting the temperature signal from the temperature sensor 502 and the microcontroller 501 includes an RF receiver (or transceiver) for receiving the temperature signal from the temperature sensor 502.

In embodiments, the temperature sensor 502 may be positioned on the top surface 154 of the deck 150 at a position directly vertically below (i.e., in the −Z direction of the coordinate axes in the figures) a targeted area (e.g., the head, sacral area, the scapular areas, buttocks, heels or the like) of a subject supported by the person support system 101. The temperature sensor 502 may be positioned to detect either the temperature of the skin of the subject or the deck top surface temperature $T_3$ (FIG. 4B). Alternatively, the temperature sensor 502 may be positioned on the top surface 131 (FIG. 3) of the support pad 130 in a region 129 (FIG. 2) corresponding to a targeted area of the subject to be cooled when the subject is positioned on the support pad 130, such that the temperature sensor 502 detects either the temperature of the skin of the subject or the support pad top surface temperature $T_4$ (FIG. 4B). In some embodiments, the temperature sensor 502 may be positioned on the bottom surface 152 of the deck 150 or in the side rails 126, 127. In still other embodiments, the temperature sensor 502 may be positioned directly on the skin of the subject, such as in the head, sacral area, scapular area, buttocks, heels or the like, and held in place with, for example, adhesive or a dressing. In yet other embodiments, the temperature sensor 502 may be positioned in a garment worn by the subject, such as a hospital gown, undergarment, pants, or the like. In embodiments, the temperature signal provided by the temperature sensor 502 to the microcontroller 501 may be used, for example and without limitation, to control the cooling of the top surface 154 of the deck 150 provided by the cooling sources 142, determine proper positioning of the subject with respect to the cooling sources 142 positioned to cool the deck 150, determine if a cooling source 142 is functioning properly and/or providing sufficient cooling, determine if a canister 240, 340 (FIGS. 8A, 14A) should be replaced to provide better cooling, or combinations thereof.

Still referring to FIGS. 1, 2, 3, 15, and 16, in embodiments, the control unit 500 may optionally include an RFID reader 512 communicatively coupled to the microcontroller 501. In embodiments, the RFID reader 512 may be used to identify various accessories associated with the person support system 101 and/or a subject positioned on the person support system 101, which accessories may influence the cooling of the subject with the cooling features 140 of the person support system 101. In embodiments, the RFID reader 512 outputs a signal (i.e., an accessory identification signal) indicative of an identity of an accessory being used in conjunction with the person support system 101. For example, in embodiments, a sheet, pillow, bolster, or blanket (i.e., linens) being used on the person support system 101 may include an RFID tag 514 encoded with the identity of the sheet, pillow, bolster, or blanket. Similarly, garments (e.g., the gown, pants, shirt, undergarment, socks, dressings, patches (i.e., a sacral patch) or the like) worn by the patient may include an RFID tag 514 encoded with the identity of the garment. As another example, any pads or cushions, such as incontinence pads or the like, used in conjunction with the person support system 101 and/or a subject positioned on the person support system 101, may include an RFID tag 514 encoded with the identity of the pad or cushion. In the specific example, depicted in FIG. 16, the accessory 590 is a hospital gown which includes an RFID tag 514 encoded with the identity of the hospital gown. The RFID reader detects the accessory 590 with RFID tag 514, interrogates the RFID tag 514, and outputs an accessory identification signal which, in this embodiment, indicates that the accessory 590 is a hospital gown. In embodiments, the RFID tag 514 may also be encoded with information related to the insulating properties of the accessories, which information may be encoded as a part of the identity of the accessory.

In embodiments, the RFID reader 512 may be communicatively coupled to the microcontroller 501 with wires or, alternatively, wirelessly, such as when the RFID reader 512 includes an RF transmitter (or transceiver) for transmitting the accessory identification signal and the microcontroller 501 includes an RF receiver (or transceiver) for receiving the accessory identification signal from the RFID reader 512.

In embodiments, the control unit 500 may further include an input device 506 communicatively coupled to the microcontroller 501. The input device 506 may be used to input data, operating parameters, and the like into the control unit 500. In embodiments, the input device 506 may be a conventional input device such as a keyboard, mouse, track pad, stylus or the like. In embodiments, the input device 506 may be communicatively coupled to the microcontroller 501 with wires or, alternatively, wirelessly, such as when the input device 506 includes an RF transmitter (or transceiver) for transmitting an input signal and the microcontroller 501 includes an RF receiver (or transceiver) for receiving the input signal from the input device. In embodiments, the input device 506 may be used to, for example, input target cooling temperatures into the control unit 500, input subject data into the control unit 500, control the operation of one or more cooling sources 142 operatively connected to the control unit 500, and the like.

Still referring to FIGS. 15 and 16, in embodiments, the display device 504 is communicatively coupled to the microcontroller 501 and may be used to display data associated with the person support system 101 and, more specifically, data related to the cooling of a subject position on the person support system 101. In some embodiments, the display device 504 may be a touch screen and, as such, may also be used to input data, operating parameters, and the like, into the control unit 500. For example, in the embodiment depicted in FIG. 16, the display device 504 is a touch screen which includes various buttons including up/down arrow keys 520, 521, temperature check boxes 522, 523, and accessory check boxes 524, 525, 526, 527. The temperature check boxes 522, 523 may be used to toggle between the actual temperature (i.e., the temperature measured and indicated by the temperature signal from the temperature sensor 502) and the target temperature (i.e., the temperature input into the control unit by a user). With regard to the target temperature, up/down arrow keys 520, 521 may be used to increase or decrease the target temperature and/or scroll to a different temperature setting. The accessory check boxes 524, 525, 526, 527 may be used to select and/or identify the accessories associated with the subject and/or the person support system 101. In the embodiment shown in FIG. 16, the accessory check boxes 524, 525, 526, 527 are associated with subject-specific accessories (i.e., garments worn by the subject positioned on the person support system 101 and/or used in conjunction with the subject positioned on the person support system 101).

In some embodiments, the microcontroller 501 of the control unit 500 may be communicatively coupled to a cooling source 142, such as the blower 200 (FIG. 5), the blower 300 (FIGS. 11A, 11B, and 12A), a thermoelectric cooler 220 (FIGS. 7A and 7B), and/or a thermoelectric cooler 320 (FIG. 13). The microcontroller 501 is programmed to output a control signal to operate the blower 200, the blower 300, the thermoelectric cooler 220, and/or the thermoelectric cooler 320 based on input received from at least one of the temperature sensor 502, the RFID reader 512, the input device 506, the display device 504, or various combinations thereof.

For example, in embodiments, computer readable and executable instructions stored in the non-transitory memory cause the control unit to receive a temperature signal from the temperature sensor 502 indicative of a measured temperature of the skin of a subject at a specific area or, alternatively, the support pad top surface temperature $T_4$ (FIG. 4B) at the specific area, the deck top surface temperature $T_3$ (FIG. 4B) at the specific area, the side rail top surface temperature $T_2$ (FIG. 4B), and/or the side rail internal surface temperature $T_1$ (FIG. 4B). Thereafter, the control unit compares the measured temperature to a target temperature. If the measured temperature is not equal to the target temperature, the control unit outputs a control signal that adjusts an operating parameter of the cooling source, thereby increasing or decreasing cooling of the deck 150 until the measured temperature is equal to the target temperature.

Figure 6A:
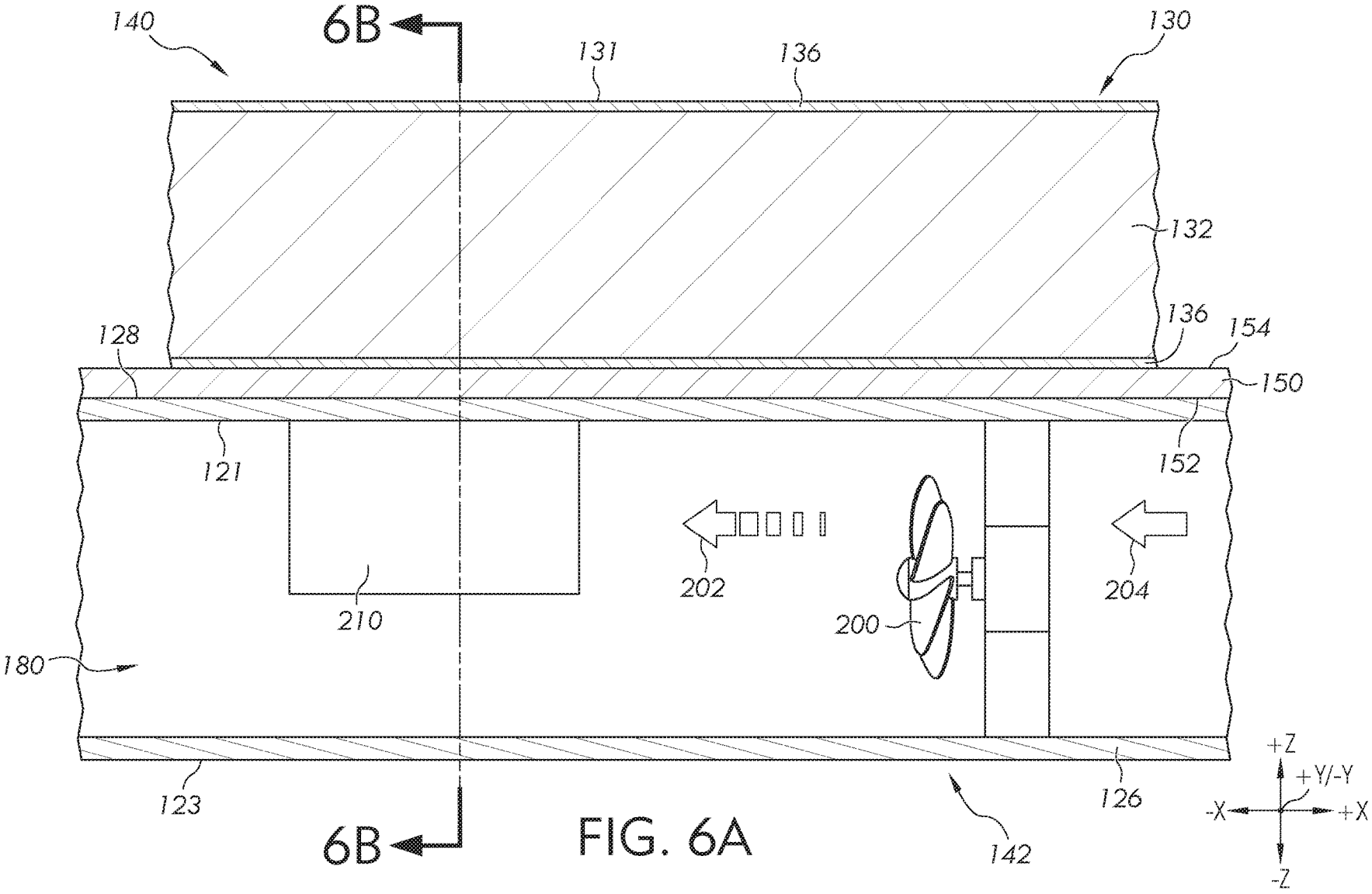
FIG. 6A schematically depicts another embodiment of a cooling feature of the table top assembly of FIG. 4B, in accordance with one or more embodiments described herein.
Figure 6B:
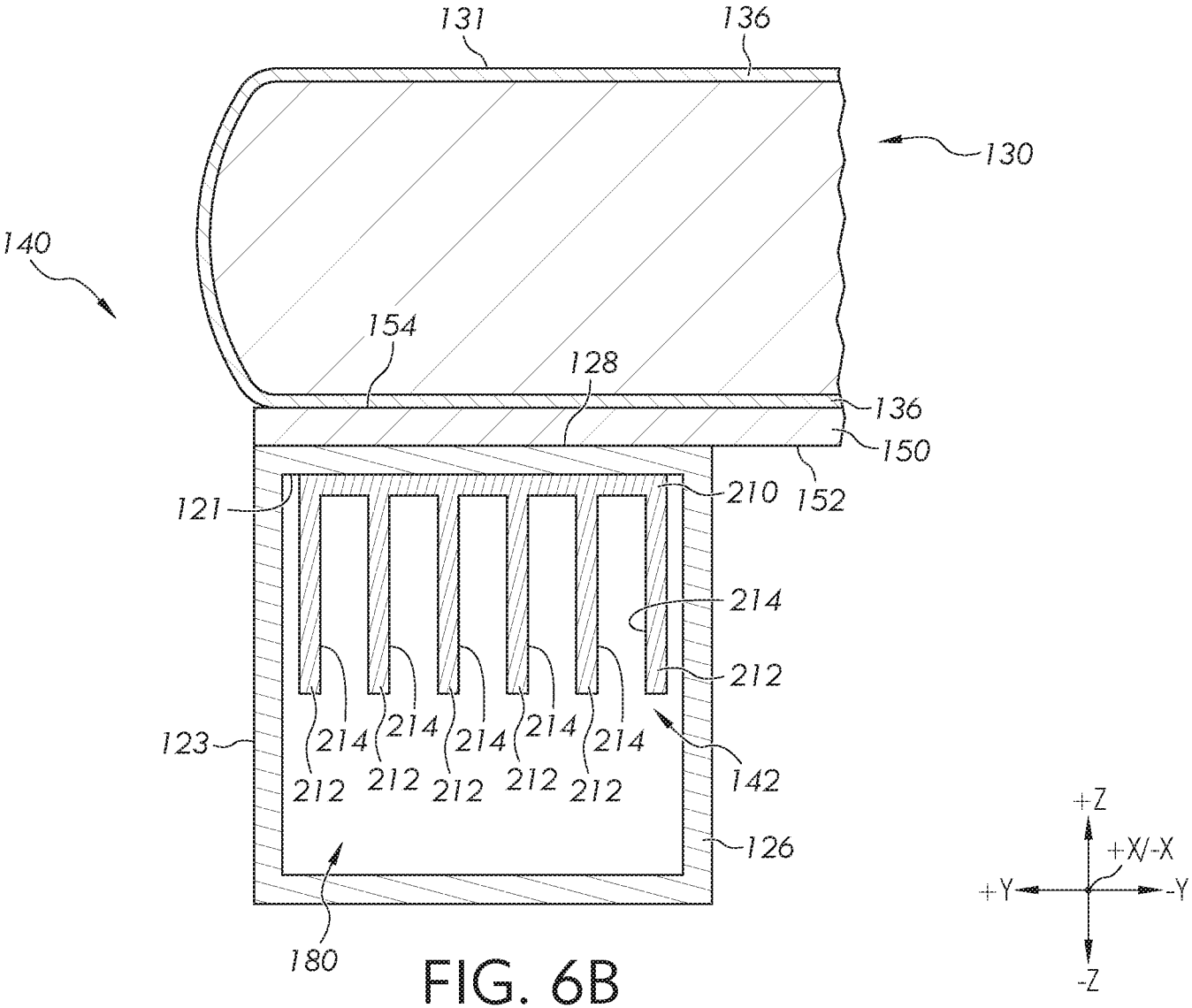
FIG. 6B schematically depicts a cross-section of the cooling feature of FIG. 6A, in accordance with one or more embodiments described herein.

For example and without limitation, when the cooling source 142 is a blower 200 as depicted in FIGS. 5, 6A and 6B and the microcontroller 501 of the control unit 500 determines that the temperature of a subject (i.e., the temperature of a specific portion of the skin of a subject, the deck top surface temperature $T_3$ (FIG. 4B), support pad top surface temperature $T_4$ (FIG. 4B), or other temperature) measured with the temperature sensor 502 (i.e., the measured temperature or the actual temperature) is greater than a target temperature which may, in embodiments, be input in the control unit 500 through the display device 504 and/or the input device 506, the microcontroller 501 sends a signal to the blower 200 to increase the rotational speed of the blower 200 thereby increasing the flow of output fluid 202 through the side rail 126 and increasing the extraction of heat from the top surface 154 of the deck 150.

Similarly, when the cooling source 142 is a blower 300 as depicted in FIGS. 11A, 11B, and 12A and the microcontroller 501 of the control unit 500 determines that the temperature of a subject (i.e., the temperature of a specific portion of the skin of a subject, the deck top surface temperature $T_3$ (FIG. 4B), support pad top surface temperature $T_4$ (FIG. 4B), or other temperature) measured with the temperature sensor 502 (i.e., the measured temperature or the actual temperature) is greater than a target temperature which may, in embodiments, be input in the control unit 500 through the display device 504 and/or the input device 506, the microcontroller 501 sends a signal to the blower 300 to increase the rotational speed of the blower 300 thereby increasing the flow of output fluid 302 across the bottom surface 152 of the deck 150 (including the heat transfer plate 310 of FIG. 12A or the thermoelectric cooler 320 of FIG. 13 coupled to the bottom surface 152 of the deck 150) and increasing the extraction of heat from the top surface 154 of the deck 150.

Conversely, when the microcontroller 501 of the control unit 500 determines that the temperature of the subject (i.e., the temperature of a specific portion of the skin of a subject, the deck top surface temperature $T_3$ (FIG. 4B), support pad top surface temperature $T_4$ (FIG. 4B), or other temperature) measured with the temperature sensor 502 (i.e., the measured temperature or the actual temperature) is less than the target temperature, the microcontroller 501 sends a signal to the blower 200 to decrease the rotational speed of the blower 200 thereby decreasing the flow of output fluid 202 through the side rail 126 and decreasing the extraction of heat from the top surface 154 of the deck 150. When the cooling source 142 is a blower 300 as depicted in FIGS. 11A, 11B, and 12A and when the microcontroller 501 of the control unit 500 determines that the temperature of the subject (i.e., the temperature of a specific portion of the skin of a subject, the deck top surface temperature $T_3$ (FIG. 4B), support pad top surface temperature $T_4$ (FIG. 4B), or other temperature) measured with the temperature sensor 502 (i.e., the measured temperature or the actual temperature) is less than the target temperature, the microcontroller 501 sends a signal to the blower 300 to decrease the rotational speed of the blower 300 thereby decreasing the flow of output fluid 302 across the bottom surface 152 of the deck 150 (including the heat transfer plate 310 of FIG. 12A or the thermoelectric cooler 320 of FIG. 13 coupled to the bottom surface 152 of the deck 150) and decreasing the extraction of heat from the top surface 154 of the deck 150.

Alternatively, when the cooling source 142 is the thermoelectric cooler 220 as depicted in FIGS. 7A and 7B or the thermoelectric cooler 320 as depicted in FIG. 13 and the microcontroller 501 of the control unit 500 determines that the temperature of the subject (i.e., the temperature of a specific portion of the skin of a subject, the deck top surface temperature $T_3$ (FIG. 4B), support pad top surface temperature $T_4$ (FIG. 4B), or other temperature) measured with the temperature sensor 502 (i.e., the measured temperature or the actual temperature) is less than a target temperature, the microcontroller 501 reduces the current and/or voltage supplied to the thermoelectric cooler 220, 320 thereby decreasing the flow of heat through the thermoelectric cooler 220, 320 from the cooling plate 222, 322 to the heating plate 224, 324 and decreasing the extraction of heat from the top surface 154 of the deck 150.

Conversely, when the microcontroller 501 of the control unit 500 determines that the temperature of the subject (i.e., the temperature of a specific portion of the skin of a subject, the deck top surface temperature $T_3$ (FIG. 4B), support pad top surface temperature $T_4$ (FIG. 4B), or other temperature) measured with the temperature sensor 502 (i.e., the measured temperature or the actual temperature) is greater than a target temperature, the microcontroller 501 increases the current and/or voltage supplied to the thermoelectric cooler 220, 320 thereby increasing the flow of heat through the thermoelectric cooler 220, 320 from the cooling plate 222, 322 to the heating plate 224, 324 and increasing the extraction of heat from the top surface 154 of the deck 150.

In some embodiments, temperature measured with the temperature sensor 502 may be used to determine if a subject is appropriately positioned on the person support system 101 to facilitate effective cooling of a specific area of the subject. For example, in one embodiment, the actual temperature measured with the temperature sensor being relatively high when the temperature sensor 502 is applied directly to the skin of the subject may indicate that the subject is not properly positioned on the person support system 101 relative to the positions of the cooling sources 142 (i.e., proper cooling is not taking place). Alternatively, the actual temperature measured with the temperature sensor 502 being at or above normal body temperature may indicate that insufficient cooling is occurring and that the cooling source 142 should be adjusted (when present) or the thermally absorptive materials 242, 342 (i.e., PCMs or the like) exchanged or replaced (i.e., the cooling capacity of the materials is diminished or insufficient).

In embodiments where the side rails 126, 127 and/or the deck 150 are thermally coupled to a passive cooling source such as the canister 240, 340 containing thermally absorptive material 242, 342 as depicted in FIGS. 8A and 14A, the control unit 500 may be utilized to determine the proper thermally absorptive material 242, 342 for the canister 240, 340 for achieving the target temperature based on factors such as, for example and without limitation, the desired target temperature and the weight of the subject. For example, the non-transitory memory 510 of the control unit 500 may contain a look-up-table (LUT) of thermally absorptive materials (e.g., phase change materials, oils, coolant, etc.) that are indexed according to such factors as the target temperature and the weight of the subject. That is, the thermally absorptive materials may be indexed according to the target temperature which they are capable of achieving. In these embodiments, an operator may input the target temperature and the weight of the subject into the control unit 500 through the input device 506 or the display device 504. The processor 508 of the microcontroller 501 compares the input factors to the LUT of thermally absorptive materials and outputs to the display device one or more materials that may be used to reach the desired target temperature. While target temperature and weight of the subject have been provided as examples of factors that may be used to determine the appropriate thermally absorptive materials, it should be understood that other factors are contemplated and possible including, without limitation, the location of cooling (e.g., the sacral area, the scapular areas, buttocks, heels or the like), the ambient temperature, the length of the procedure, the material from which the support pad is formed, the type of accessories associated with the subject positioned on the person support system 101, and/or various combinations thereof.

For example, the control unit 500 may take into account variables that may adversely impact cooling, such as the presence of accessories 590 (e.g., linens, garments, pillows, bolsters, incontinence pad, and the like) in use with the person support system 101 and/or subject which may have an insulating effect. Specifically, any accessories 590 which may be positioned between the skin of the subject and the surface of the support pad(s) may have an insulating effect which diminishes cooling. In this embodiment, the control unit 500 may take into account any accessories 590 being used in conjunction with the person support system 101 and/or the subject positioned on the person support system 101 together with a desired target temperature input in the control unit by a user and adjust either the target temperature and/or the recommended thermally absorptive materials to account for the insulating effects of any accessories 590 that are present.

For example, in embodiments where the side rails 126, 127 and/or the deck 150 are thermally coupled to a cooling source 142 such as a canister 240, 340 containing thermally absorptive material 242, 342 as depicted in FIGS. 8A and 14A, the control unit 500 may be utilized to determine the proper thermally absorptive material for the canister 240, 340 for achieving the desired target temperature based on the desired target temperature and any accessories 590 that may be present. Specifically, a user may input the desired target temperature into the control unit 500 with the input device 506 or the display device 504. The target temperature may be displayed with the display device 504. A user may then input the identity of any accessories 590 that are present using either the input device 506 or the display device 504. Alternatively, the RFID reader 512 may be used to automatically detect the identity of any accessories 590 which include an RFID tag 514. Regardless of the input method, a list of the accessories 590 present may be displayed with the display device 504. In this embodiment the non-transitory memory 510 of the control unit 500 may contain a look-up-table (LUT) of thermally absorptive materials (e.g., phase change materials, oils, coolant, etc.) that are indexed according to the desired target temperature and the identity and insulating properties of various accessories. For example, the LUT may contain a list of thermally absorptive materials and each material may be associated with a combination of insulating properties of various accessories or combinations of accessories and correlated to a target temperature which may be achieved with the thermally absorptive material when the specified accessories are present. The processor 508 of the microcontroller 501 compares the input factors (i.e., the desired target temperature and the identified accessories) to the LUT of thermally absorptive materials and outputs one or more recommended thermally absorptive materials to the display device 504 that may be used to reach the desired target temperature at the surface of the skin in the presence of the identified accessories 590 and/or provide a recommended time schedule for replacing the thermally absorptive material in order to achieve the desired target temperature. Alternatively, the non-transitory memory 510 of the microcontroller 501 may use an algorithm to identify one or more recommended thermally absorptive materials and/or recommended time schedules for replacing the thermally absorptive materials in order to reach the desired target temperature based on the input target temperature and the insulating properties of the identified accessories 590.

For example and without limitation, when the accessory 590 is an incontinence pad, the incontinence pad may provide thermal insulation to the skin of the subject thereby requiring additional cooling to reach the desired target temperature at the surface of the skin. Accordingly, a greater amount of heat withdrawal capacity may be necessary to reach the desired target temperature than if the incontinence pad were not present. In this example, the control unit utilizes the identity of the accessory 590 in conjunction with the target temperature to determine a recommended thermally absorptive material and/or a recommended time schedule for replacing the thermally absorptive material in order to achieve the desired target temperature.

As another example, in embodiments where the side rails 126, 127 and/or the deck 150 are thermally coupled to a cooling source 142, such as a blower 200, 300 (FIGS. 5, 6A, 6B, 11A, 11B, and 12A) and/or a thermoelectric cooler 220, 320 (FIGS. 7A, 7B, and 13), and the microcontroller 501 is programmed to output a control signal to the cooling source 142 to regulate cooling of the deck 150, the control unit 500 may be utilized to adjust the target temperature to account for the insulating effect of any accessories 590 that may be present. Specifically, a user may input the desired target temperature into the control unit 500 with the input device 506 or the display device 504. The desired target temperature may be displayed with the display device 504. A user may then input the identity of any accessories 590 that are present using either the input device 506 or the display device 504. Alternatively, the RFID reader 512 may be used to automatically detect the identity of any accessories 590 which include an RFID tag 514. Regardless of the input method, a list of the accessories 590 present may be displayed with the display device 504. In this embodiment the non-transitory memory 510 of the control unit 500 may contain a look-up-table (LUT) of adjusted target temperatures that are indexed according to the desired target temperature and the identity and insulating properties of various combinations of accessories. For example, the LUT contains a list of adjusted target temperatures associated with one or more target temperatures and a corresponding accessory or combination of accessories. The adjusted target temperature is the actual temperature set point which may be utilized to obtain the desired target temperature at the surface of the skin in the presence of the identified accessories 590. The processor 508 of the microcontroller 501 compares the input factors (i.e., the desired target temperature and the identified accessories 590) to the LUT of adjusted target temperatures and outputs an adjusted target temperature to the display device 504 that may be used to reach the desired target temperature at the surface of the skin in the presence of the identified accessories 590. Alternatively, the non-transitory memory 510 of the microcontroller 501 may use an algorithm to identify an adjusted target temperature in order to reach the target temperature at the surface of the skin based on the input target temperature and the insulating properties of the identified accessories 590. Thereafter, the microcontroller 501 provides control signals to the cooling source 142 (i.e., the blower 200, 300 and/or thermoelectric cooler 220, 320) to adjust an operating parameter of the cooling source 142 and thereby achieve the adjusted target temperature at the surface of the accessory 590 (i.e., at the top surface of the support pad) and, in turn, reach the desired target temperature at the surface of the skin. In this embodiment, the control unit 500 may further utilize the temperature signal from the temperature sensor 502 to control the cooling source in order to both achieve and maintain the adjusted target temperature at the surface of the accessory 590 (i.e., at the top surface 131 of the support pad 130) and, in turn, the desired target temperature at the surface of the subject's skin by controlled heat extraction from the top surface 154 of the deck 150, through the deck 150 and/or side rails 126, 127 to the cooling source 142.

For example and without limitation, when the target temperature is 75° F. and the accessory 590 is an incontinence pad, the incontinence pad may provide thermal insulation to the skin of the subject thereby requiring additional cooling to reach the desired target temperature at the surface of the skin. Accordingly, a greater amount of heat withdrawal capacity may be necessary to reach the desired target temperature at the surface of the skin than if the incontinence pad were not present. In this example, the control unit 500 utilizes the identity of the accessory 590 in conjunction with the desired target temperature to determine an adjusted target temperature at the surface of the accessory 590 (i.e., at the top surface 131 of the support pad 130) such that the desired target temperature is reached at the surface of the skin. The control unit 500 then operates the cooling source 142, in conjunction with the temperature signal from the temperature sensor 502, to achieve and maintain the adjusted target temperature at the surface of the accessory 590 (i.e., at the top surface 131 of the support pad 130) and, in turn, the desired target temperature at the surface of the subject's skin by controlled heat extraction from the top surface 154 of the deck 150, through the deck 150 and/or side rails 126, 127 to the cooling source 142.

In embodiments where the target temperature is adjusted to account for the presence of insulating accessories 590 and/or the type of thermally absorptive materials 242, 342 are selected to account for the presence of insulating accessories 590, the comfort of the patient may be improved by preventing over-cooling. Moreover, the workflow of a user (i.e., a caregiver) may be improved by minimizing the amount of cooling delivered to achieve a specific temperature, thereby decreasing the frequency of user intervention to monitor temperature and/or replace exhausted thermally absorptive materials. Further, by tailoring the operation of the cooling source to deliver only the minimal amount of cooling needed to obtain the desired target temperature may reduce the amount of energy expended on cooling.

Still referring to FIGS. 15 and 16, in embodiments, the control unit 500 may provide a visual indication of the temperature detected by the temperature sensors 502 on the display device 504, as described herein. For example, the visual indication may be a number displayed on a display device 504 of the control unit 500, or in the form of a graph. In some embodiments, a user may view the temperature and manually adjust the cooling source using the input device 506 communicatively coupled to the control unit 500. An adjustment to the cooling source 142 may result in a decrease in the temperature, such as when the adjustment causes an increase in the flow of the fluid through the side rail 126 with the blower 200 and/or across the bottom surface 152 of the deck 150 with the blower 300. An adjustment to the cooling source 142 may also result in an increase in the temperature, such as when the adjustment causes a decrease in the flow of the fluid through the side rail 126 with the blower 200 and/or across the bottom surface 152 of the deck 150 with the blower 300. Similar manual adjustments may be made to increase or decrease the cooling when the cooling source is, for example, a thermoelectric cooler 220, 320.

Referring to FIGS. 4A, 4B, 5, 15, and 16, in still other embodiments, temperature sensors 502 may be included in the side rail 126 or, in embodiments including a conduit for the cooling fluid, in the conduit. Accordingly, the control unit 500 may receive temperature readings from within the side rail 126 in addition to temperature readings from a temperature sensor associated with the subject and/or the top surface 131 (FIG. 4B) of the support pad 130. In such embodiments, the control unit 500 may determine a temperature gradient between the top surface 131 of the support pad 130 and the side rail 126. The flow of the output fluid 202 (FIG. 5) may be increased or decreased in order to increase or decrease the temperature gradient and thus achieve a desired cooling rate. The control unit 500 may determine that an adjustment to the flow of the output fluid 202 should be made by comparing the determined temperature gradient to a predetermined temperature gradient that is pre-set or set by a user and stored in the non-transitory memory 510.

Referring to FIGS. 11A, 11B, 12, 15, and 16, in still other embodiments, temperature sensors 502 may be coupled to the deck 150. The temperature sensors 502 may be coupled to the bottom surface 152 and/or the top surface 154 of the deck 150. Accordingly, the control unit 500 may receive temperature readings from the deck 150 in addition to temperature readings from a temperature sensor associated with the subject. In such embodiments, the control unit 500 may determine a temperature gradient between the top surface 154 of the deck 150 and the cooling source 142. The flow of the output fluid 302 (FIG. 11B) may be increased or decreased in order to increase or decrease the temperature gradient and thus achieve a desired cooling rate. The control unit 500 may determine that an adjustment to the flow of the output fluid 302 should be made by comparing the determined temperature gradient to a predetermined temperature gradient that is pre-set or set by a user and stored in the non-transitory memory 510.

Based on the foregoing, it should be understood that the non-transitory memory 510 includes computer readable and executable instructions which, when executed by the processor 508, cause the microcontroller 501 to receive input signals from the temperature sensor 502, RFID reader 512, input device 506, and/or display device 504 and output signals to at least the display device 504 based on the input signals received. In some embodiments, the microcontroller 501 also outputs control signals to a cooling source 142 such as a blower 200, 300 or a thermoelectric cooler 220, 320 to regulate cooling of a support pad 130.

In embodiments described herein, the focal cooling of at least a portion of the top surface 154 of the deck 150 is achieved by conducting heat from the top surface 154 of the deck 150 and dissipating that heat with a heat sink, either by conduction, convection, radiation, or combinations thereof. The heat conducted away from the deck 150 is, effectively, waste heat. In some embodiments of the person support systems 101 described herein, the heat conducted away from the deck 150 may be recycled and repurposed. For example, the heat conducted away from the deck 150 may be recycled to warm the subject positioned on the person support system 101.

Figure 17:
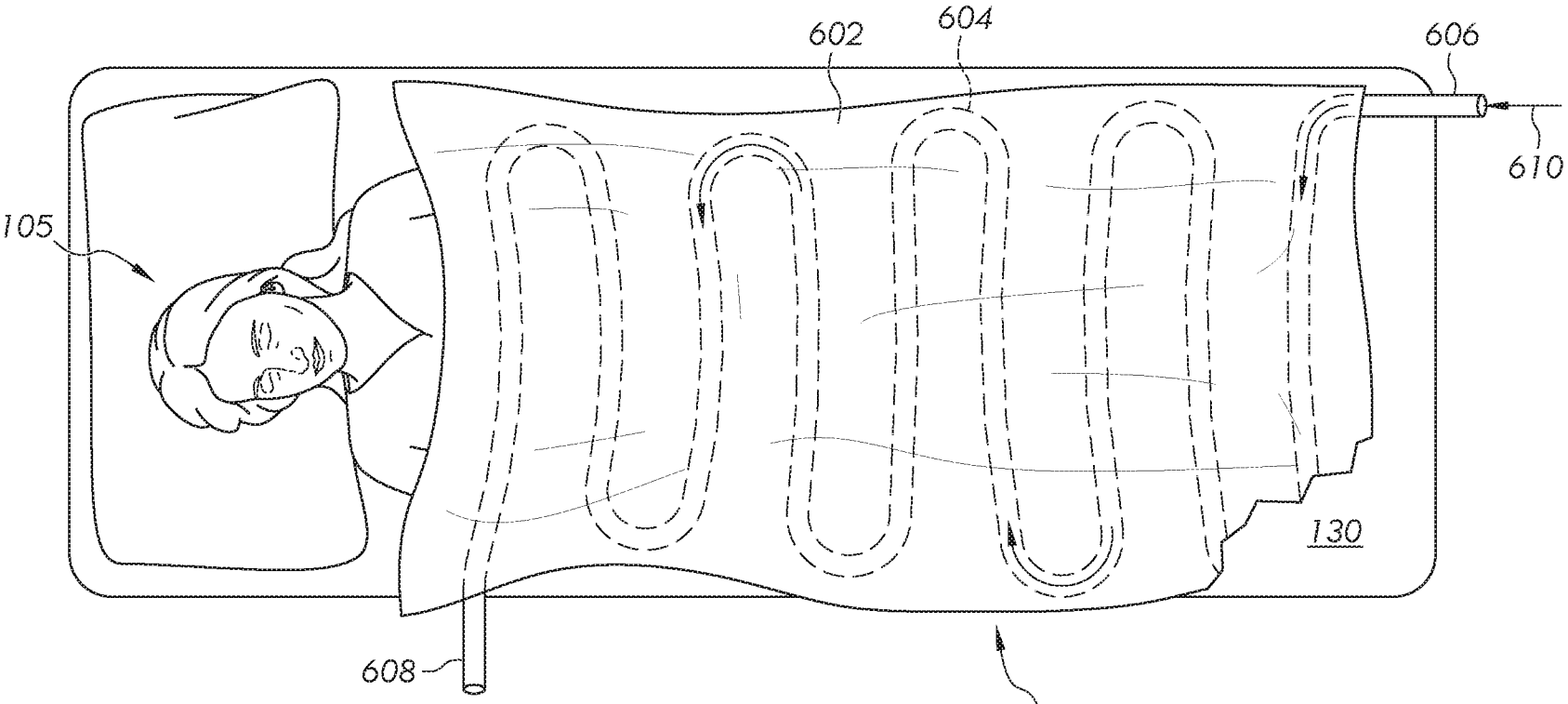
FIG. 17 schematically depicts one embodiment of a warming blanket for use with one or more embodiments of the person support systems described herein.

Referring to FIG. 17 by way of example, a warming blanket 600 is schematically depicted for use in warming a subject 105 positioned on a support pad 130 of a person support system 900. In embodiments, the warming blanket 600 may include a sheet portion 602 which includes a flexible conduit 604. For example, the sheet portion 602 may include multiple plies and the flexible conduit 604 may be disposed between two of the plies. As shown in FIG. 17, the flexible conduit 604 may have a serpentine configuration within the sheet portion 602 of the warming blanket 600. In the embodiment of the flexible conduit 604 depicted in FIG. 17, the flexible conduit includes an inlet 606 for receiving a warming fluid 610 (schematically depicted by arrows) and an outlet 608 for expelling the warming fluid 610.

Figure 18:
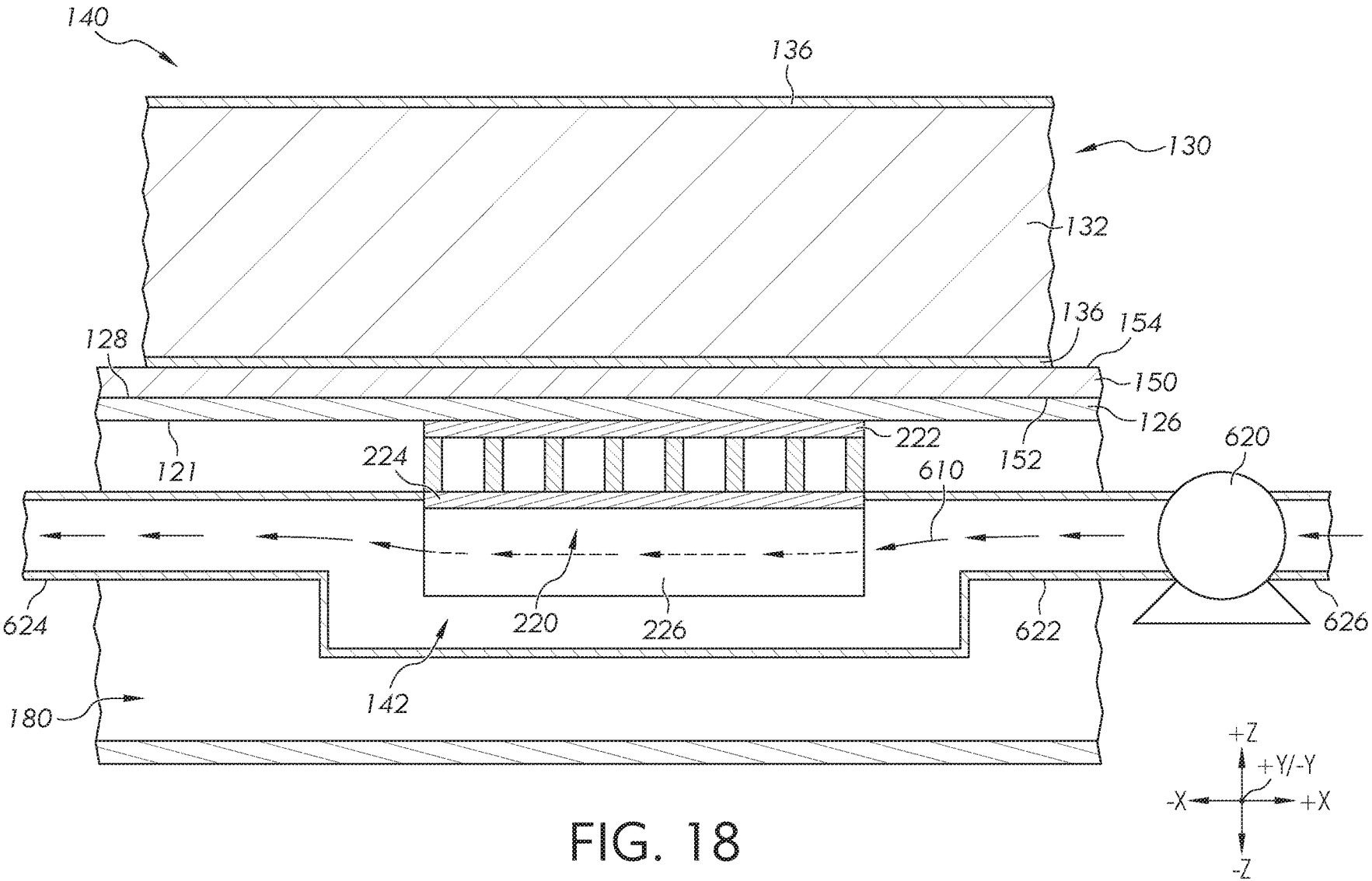
FIG. 18 schematically depicts an embodiment of a system for delivering warming fluid to the warming blanket of FIG. 17, according to one or more embodiments described herein.

Referring now to FIGS. 17 and 18, the side rail 126 of the person support system may include a thermoelectric cooler 220 thermally coupled to the side rail 126, as described herein with respect to FIGS. 7A and 7B. However, in this embodiment, the side rail 126 may further include a frame conduit 622 extending into the interior channel 180 of the side rail 126. The frame conduit 622 is positioned relative to the heating plate 224 of the thermoelectric cooler 220 and directs a flow of warming fluid 610 across the heating plate 224 and the cooling fins 226 extending from the heating plate 224. In the embodiment shown in FIG. 18, the frame conduit 622 is coupled to a pump 620 which circulates the warming fluid 610 through the frame conduit 622. The frame conduit 622 further includes a frame outlet 624 which is fluidly coupled to the inlet 606 of the warming blanket 600 and a frame inlet 626 which is fluidly coupled to the outlet 608 of the warming blanket 600. Accordingly, it should be understood that, in this embodiment, the flexible conduit 604 of the warming blanket 600 and the frame conduit 622 form a closed loop system.

In embodiments, the warming fluid 610 directed through the flexible conduit 604 and the frame conduit 622 may be, for example, a gas such as, without limitation, air or nitrogen. Alternatively, the warming fluid 610 directed through the flexible conduit 604 and the frame conduit 622 may be, for example, a liquid such as, without limitation, water, mineral oil, or the like.

In operation, the thermoelectric cooler 220 conducts heat from the deck 150 as described hereinabove with respect to FIGS. 7A and 7B. Simultaneously, the pump 620 pumps the warming fluid 610 through the frame conduit 622 such that the warming fluid 610 contacts the heating plate 224 and cooling fins 226 of the thermoelectric cooler 220, thereby heating the warming fluid 610. The heated warming fluid 610 exits the frame conduit 622 at frame outlet 624 and enters the inlet 606 of the flexible conduit 604 of the warming blanket 600. The warming fluid 610 is circulated through the flexible conduit 604 of the warming blanket 600 and the heat from the warming fluid 610 is transferred to a subject 105 positioned beneath the warming blanket 600 on the person support system 101, thereby warming the subject 105. The warming fluid 610 exits the flexible conduit 604 at the outlet 608 and is re-circulated into the frame inlet 626 of the frame conduit 622 and through the pump 620. In this embodiment, the flexible conduit 604 of the warming blanket receives the warming fluid 610 from the heating plate 224 of the thermoelectric cooler 220 by convection, specifically forced convection.

While a closed loop embodiment of the warming blanket has been described, it should be understood that an open loop embodiment is contemplated and possible. Referring again to FIGS. 17 and 18, in the open loop embodiment, the frame outlet 624 is coupled to the inlet 606 of the flexible conduit 604. However, the frame inlet 626 is coupled to atmosphere (i.e., open) as is the outlet 608 of the flexible conduit 604. In this embodiment the warming fluid 610 may be air.

In operation, the thermoelectric cooler 220 conducts heat from the top surface 154 of the deck 150 as described hereinabove with respect to FIGS. 7A and 7B. Simultaneously, the pump 620 draws in warming fluid 610 (i.e., air) through the frame inlet 626 of the frame conduit 622 such that the warming fluid 610 contacts the heating plate 224 and cooling fins 226 of the thermoelectric cooler 220, thereby heating the warming fluid 610. The heated warming fluid 610 exits the frame conduit 622 at frame outlet 624 and enters the inlet 606 of the flexible conduit 604 of the warming blanket 600. The warming fluid 610 is circulated through the flexible conduit 604 of the warming blanket 600 and the heat from the warming fluid 610 is transferred to a subject 105 positioned beneath the warming blanket 600 on the person support system 101, thereby warming the subject 105. The warming fluid 610 exits the flexible conduit 604 at the outlet 608 and is expelled to atmosphere. In this embodiment, the flexible conduit 604 of the warming blanket receives the warming fluid 610 from the heating plate 224 of the thermoelectric cooler 220 by convection, specifically forced convection.

Still referring to FIGS. 17 and 18, in another open loop embodiment, the frame outlet 624 is coupled to the inlet 606 of the flexible conduit 604. However, the frame inlet 626 is coupled to atmosphere (i.e., open) and the outlet 608 of the flexible conduit 604 of the warming blanket 600 is plugged. In this embodiment the flexible conduit 604 is perforated along its length between the inlet 606 and the outlet 608. In this embodiment the warming fluid 610 may be air.

In operation, the thermoelectric cooler 220 conducts heat from the top surface 154 of the deck 150 as described hereinabove with respect to FIGS. 7A and 7B. Simultaneously, the pump 620 draws in warming fluid 610 (i.e., air) through the frame inlet 626 of the frame conduit 622 such that the warming fluid 610 contacts the heating plate 224 and cooling fins 226 of the thermoelectric cooler 220, thereby heating the warming fluid 610. The heated warming fluid 610 exits the frame conduit 622 at frame outlet 624 and enters the inlet 606 of the flexible conduit 604 of the warming blanket 600. The warming fluid 610 is circulated through the flexible conduit 604 of the warming blanket 600. As the warming fluid 610 is circulated, the warming fluid 610 exits the flexible conduit 604 through the perforations along its length, thereby transferring heat from the warming fluid 610 to a subject 105 positioned beneath the warming blanket 600 on the person support system 101. In this embodiment, the flexible conduit 604 of the warming blanket receives the warming fluid 610 from the heating plate 224 of the thermoelectric cooler 220 by convection, specifically forced convection.

Still referring to FIGS. 17 and 18, in yet another open loop embodiment, natural convection is used to circulate the warming fluid 610 from the heating plate 224 of the thermoelectric cooler 220 through the flexible conduit 604 of the warming blanket. In this embodiment, the frame outlet 624 is coupled to the inlet 606 of the flexible conduit 604. However, the frame inlet 626 is coupled to atmosphere (i.e., open) as is the outlet 608 of the flexible conduit 604 of the warming blanket 600. In this embodiment the pump 620 is not coupled to the frame conduit 622. In this embodiment the warming fluid 610 is air.

In operation, the thermoelectric cooler 220 conducts heat from the top surface 154 of the deck 150 as described hereinabove with respect to FIGS. 7A and 7B. Simultaneously, warming fluid 610 (i.e., air) in the frame conduit 622 contacts the heating plate 224 and cooling fins 226 of the thermoelectric cooler 220, thereby heating the warming fluid 610 by convection. The heated warming fluid 610 rises and exits the frame conduit 622 at frame outlet 624 and enters the inlet 606 of the flexible conduit 604 of the warming blanket 600. The warming fluid 610 circulates through the flexible conduit 604 of the warming blanket 600 and the heat from the warming fluid 610 is transferred to a subject 105 positioned beneath the warming blanket 600 on the person support system 101, thereby warming the subject 105. The warming fluid 610 exits the flexible conduit 604 at the outlet 608 and is expelled to atmosphere.

Referring to FIGS. 5, 6A, 6B and 17, in an alternative embodiment, the warming blanket 600 may be utilized in conjunction with side rail 126 and blower 200 as depicted in FIGS. 5, 6A, and 6B. Specifically, the inlet 606 of the flexible conduit 604 of the warming blanket 600 may be fluidly coupled to the side rail 126 such that output fluid 202 is directed into and circulated through the flexible conduit 604 of the warming blanket 600 after passing through the side rail 126 and/or passing around the through the fins 212 of the heat transfer plate 210. In this manner, heat conducted from the top surface 154 of the deck 150, through the deck 150, side rail 126, and heat transfer plate 210 is recycled into the warming blanket 600.

While specific reference has been made herein to use of the cooling features 140 in conjunction with person support systems 101 such as surgical tables and/or spine tables, it should be understood that use of the cooling features 140 with other types of person support systems 101 are contemplated and possible. For example, some embodiments of the cooling features 140, such as the embodiments depicted in FIG. 11A, 11B, 12, 13, or 14, may be used in conjunction with stretchers, procedural stretchers, gurneys, cots, wheelchairs, and/or hospital beds.

While various embodiments of cooling features have been shown and described herein in conjunction with person support systems, it should be understood that other applications are contemplated and possible. For example, the cooling features described herein may be used in conjunction with other medical equipment including, without limitation, wheelchairs, stretchers, procedural stretchers, gurneys, cots, hospital beds, and the like or any other medical equipment which utilizes a deck or other support surface on which a subject may be positioned for extended periods of time.

Various embodiments described herein include cooling features in the form of cooling sources thermally coupled to the deck and/or the side rail of a person support system. The cooling features may reduce a temperature of the tissue in contact with the person support system, which may further reduce the likelihood of the subject developing pressure injuries. In various embodiments, the deck, support pad, and/or side rails are made of radiolucent materials to enable the deck, support pad, and/or side rails to be used without interfering with imaging techniques utilized in conjunction with the person support systems on which the support pads are positioned.

Figure 19:
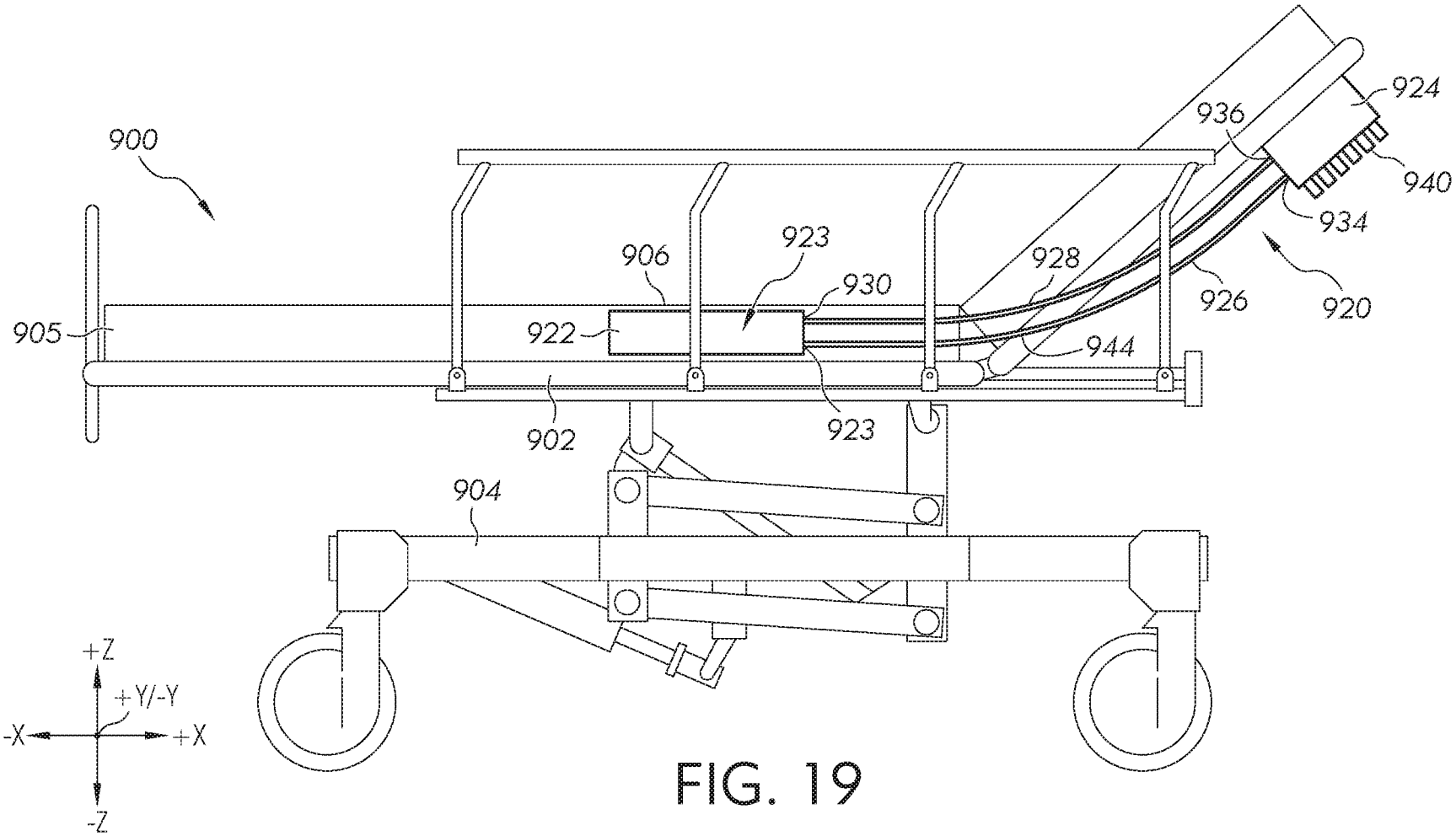
FIG. 19 schematically depicts another embodiment of a person support system having a cooling system, in accordance with one or more embodiments described herein.

Referring now to FIG. 19, another embodiment of a person support system 900, such as a stretcher for example, is depicted having a cooling system 920 for providing focal cooling to the person support system 900 to prevent pressure injuries on a subject supported by the person support system 900. The person support system 900 includes a frame 902 supported by a base 904 and a support pad 905 supported by the frame 902. The frame 902, base 904, and support pad 905 may be similar to the longitudinal frame 125, base 103, and support pad 130 previously discussed herein. Although the support pad 905 is shown in FIG. 19 as extending the entire length of the person support system 900, it should be understood that the support pad 905 may only extend over a portion of the person support system 900. In some embodiments, the support pad 905 may be a mattress, such as a spring mattress or a foam mattress, for example.

The person support system 900 further includes a cooling system 920 to provide focal cooling to an area of a top surface 906 of the support pad 905 that is in contact with a subject supported by the support pad 905. For example, the cooling system 920 may provide focal cooling to an area of the top surface 906 of the support pad 905 in contact with the sacral or buttocks areas of the subject. Contact of the subject with the top surface 906 of the support pad 905 causes heat to accumulate in the support pad 905. The focal cooling provided by the cooling system 920 removes heat accumulated in the support pad 905 and reduces a temperature of the top surface 906 of the support pad 905. Reducing the temperature of the top surface 906 may reduce the skin temperature of the subject, which may reduce the formation of pressure injuries in areas of the subject supported by the support pad 905. In some embodiments, the cooling system 920 may transfer the heat from the support pad 905 to the back side of the person support system 900 where the heat may be dissipated without requiring external power.

As shown in FIG. 19, in one embodiment, the cooling system 920 includes a reservoir 922, a heat exchanger 924, a first fluid conduit 926 extending from the reservoir 922 to the heat exchanger 924, and a second fluid conduit 928 extending from the heat exchanger 924 to the reservoir 922. In embodiments, the reservoir 922 may comprise a woven or non-woven fabric having a coating, such as a urethane coating, polyurethane coating, or the like, which seals the reservoir 922 from moisture and/or liquid permeation. Alternatively, the reservoir 922 may be liquid impermeable membrane made from an elastomer, gel, or other resilient, liquid impermeable material. For example, in embodiments, the reservoir 922 may be a fluid impermeable membrane, such that water and/or biological fluids do not pass through the reservoir 922 to contaminate the cooling fluid in the reservoir 922 and such that the cooling fluid does not leak or escape from the reservoir 922. Suitable materials for the reservoir 922 may include, for example, urethane, polyurethane, vinyl, nylon, Lycra material, other elastomeric materials, or combinations of these materials. In some embodiments, the reservoir 922 may be made from fluid impermeable materials, such as, but not limited to plastic or polyurethane films for example. In some embodiments, the reservoir 922 may be made from a thermally conductive material. The reservoir 922 is sealed to prevent cooling fluid from escaping or leaking from the reservoir 922. The reservoir 922 has an internal volume 923 for containing an amount of a cooling fluid. The reservoir 922 includes a reservoir inlet 930 in fluid communication with the second fluid conduit 928 and a reservoir outlet 932 in fluid communication with the first fluid conduit 926.

Figure 20:
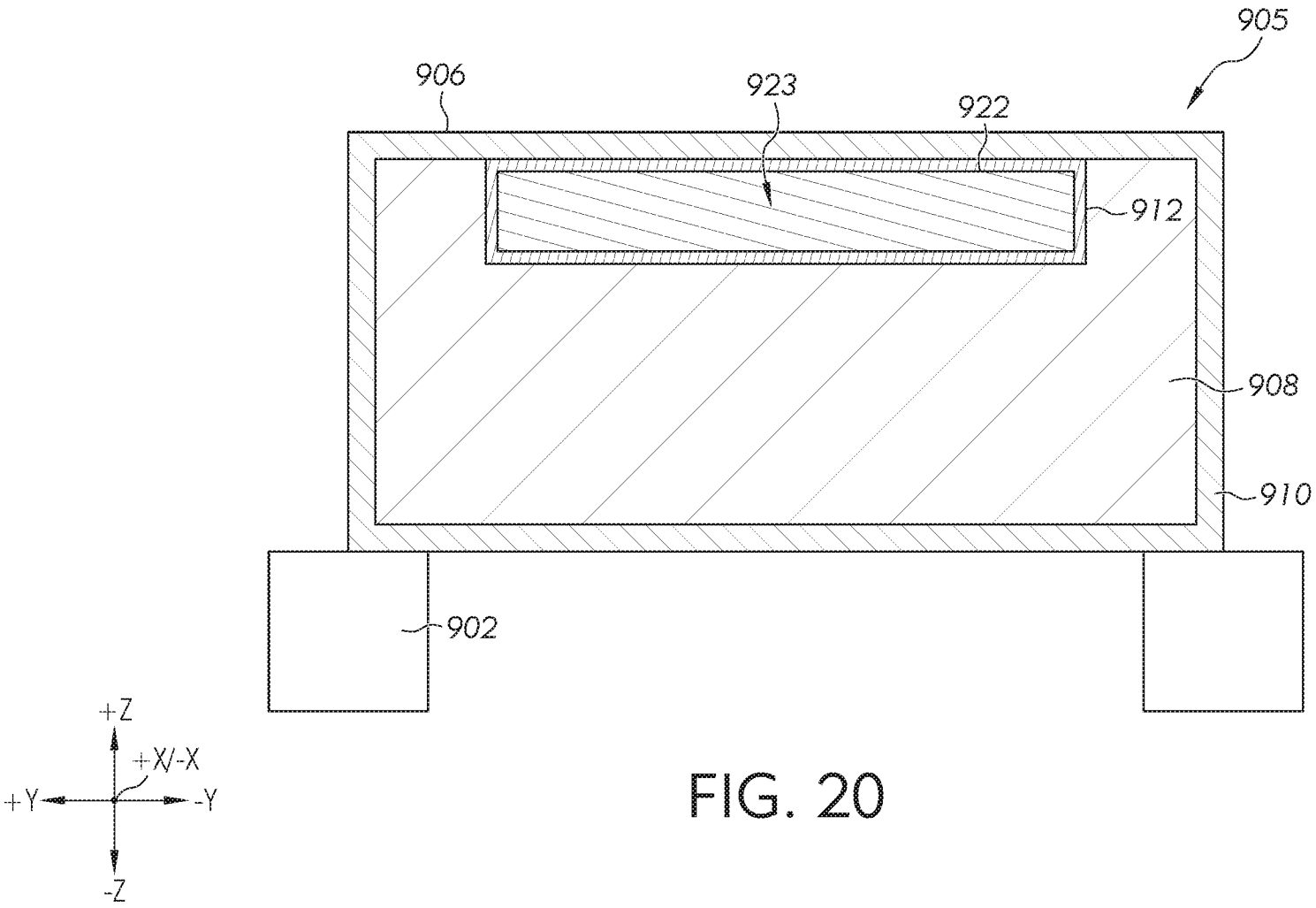
FIG. 20 schematically depicts cross-section of a portion of a support pad of the person support system of FIG. 19, in accordance with one or more embodiments described herein.

In embodiments, the reservoir 922 may be positioned in the support pad 905 of the person support system 900. Referring to FIG. 20, the support pad 905 may include a core part 908 enveloped in a cover 910, as described hereinabove with respect to the support pad 130 illustrated in FIG. 3. However, in these embodiment, the support pad 905 may include at least one recess 912 formed in the core part 908. In FIG. 20, the recess 912 is illustrated as being positioned in an upper part of the support pad 905 (i.e., the part of the support pad 905 in the +Z direction). However, the recess 912 may also be positioned in the middle or bottom portions of the support pad 905. In embodiments, the recess 912 may be located in the core part 908 in, for example and without limitation, areas that correspond to the sacral area, buttocks, scapular areas, and/or heels of a subject when the subject is positioned on the top surface 906 of the support pad 905. In some embodiments, the recess 912 is located in the core part 908 of the support pad 905 in the buttocks area of the subject when the subject is supported by the support pad 905. The recess 912 may be sized and shaped to removably receive a foam plug (not shown) that is formed from the same or similar material as the core part 132. The foam plug may be removed from the recesses 912 and replaced with the reservoir 922, as depicted in FIG. 20. Alternatively, in other embodiments, the reservoir 922 may be positioned on top of or underneath the support pad 905 (i.e., in the +Z or −Z direction of the coordinate axes of FIG. 20, respectively). For example, the reservoir 922 may be positioned on top of or underneath a deck on which the support pad 905 is supported.

Referring back to FIG. 19, the heat exchanger 924 may be positioned vertically higher (i.e., +Z direction of the axis of FIG. 19) than the reservoir 922. In emergency departments, pre-operation rooms, or post-operation rooms, a subject supported by the person support system 900 may spend extended periods of time in a position in which a head portion 914 of the person support system 900 is raised. In embodiments, the heat exchanger 924 may be supported by the head portion 914 such that when the person support system 900 is adjusted to have the head portion 914 slightly raised, then the heat exchanger 924 is positioned vertically higher than the reservoir 922.

The heat exchanger 924 includes a heat exchanger inlet 934 in fluid communication with the first fluid conduit 926 and a heat exchanger outlet 936 in fluid communication with the second fluid conduit 928. The heat exchanger 924 removes heat from the cooling fluid entering the heat exchanger 924. The heat removed by the heat exchanger 924 is then transferred to the ambient air or other heat sink through radiation and/or convection. In some embodiments, the heat exchanger 924 may include a plurality of cooling fins 940. The cooling fins 940 provide increased surface area for transferring heat from the cooling fluid to the ambient air through radiation and/or natural convection. The cooling fins 940 may be made from a thermally conductive material, such as copper or copper alloys for example, such that the cooling fins 940 conduct heat from the cooling fluid to the outer surfaces of the cooling fins 940, where the heat may be transferred to the ambient air or other heat sink through radiation and/or convection. The cooling fins 940 may include other thermally conductive materials, such as the thermally conductive metals, polymers, and/or carbon fibers.

In some embodiments, the heat exchanger 924 may remove heat from the cooling fluid by conduction and then may transfer the heat to the ambient air or other heat sink through natural convection. Alternatively, in other embodiments, the heat exchanger 924 may additionally include a cooling source 942 for removing heat from the cooling fluid and absorbing and/or dissipating the heat to a heat sink, such as the ambient air. The cooling source 942 may include a thermoelectric cooler, a blower or fan, a thermally absorptive material, other cooling source, or combinations of cooling sources 942 as previously describe herein.

As previously discussed, the first fluid conduit 926 extends from the reservoir outlet 932 to the heat exchanger inlet 934, and the second fluid conduit 928 extends from the heat exchanger outlet 936 to the reservoir inlet 930. In some embodiments, the first fluid conduit 926 and/or the second fluid conduit 928 may be disposed within the frame 902 of the person support system 900. In some embodiments, the first fluid conduit 926 and the second fluid conduit 928 may be rigid fluid conduits. In some embodiments, the first fluid conduit 926 and/or the second fluid conduit 928 may be a metal conduit, such as a copper or steel conduit for example. In some embodiments, the first fluid conduit 926 and/or the second fluid conduit 928 may have a mesh disposed within the copper conduit. The mesh may provide additional surface area within the first or second conduits 926, 928 to promote phase change of the cooling fluid. Alternatively, the first fluid conduit 926 and/or the second fluid conduit 928 may be flexible conduits. In some embodiments, the first fluid conduit 926 and/or the second fluid conduit 928 may be made from a woven metal, flexible polymer, rubber, other flexible material, or combinations of these.

In embodiments, the cooling fluid may be a fluid capable of absorbing heat from the support pad 905. Examples of cooling fluids include, but are not limited to, water, alcohols (e.g., methanol, ethanol, propanol, isopropanol, etc.), glycols (e.g., ethylene glycol, propylene glycol, etc.), other cooling fluids, and combinations of these. In some embodiments, the cooling fluid is water. In some embodiments, the cooling fluid comprises one or more alcohols. In still other embodiments, the cooling fluid is a glycol. In some embodiments, the cooling fluid may be a fluid that undergoes a phase change from liquid to gas at a temperature of from 50° F. to 95° F., or from 50° F. to 80° F.

The reservoir 922, heat exchanger 924, first fluid conduit 926, and second fluid conduit 928 form a cooling circuit 944. In operation, heat from the subject transfers to the support pad 905 through contact of the support pad 905 with the subject supported by the person support system 900. Heat from the support pad 905 is then transferred to the cooling fluid in the reservoir 922 through conduction and/or convection. With the heat exchanger 924 elevated vertically relative to the reservoir 922, the heated cooling fluid exhibits a natural buoyancy, which causes the heated cooling fluid to travel in a generally vertically upward direction (i.e., +Z direction of the coordinate axes of FIG. 19) in the cooling circuit 944. Through this natural buoyancy, the heated cooling fluid exits the reservoir 922 through the reservoir outlet 932 and travels through the first fluid conduit 926 to the heat exchanger inlet 934 of the heat exchanger 924. The natural buoyancy of the cooling fluid causes the heated cooling fluid to rise in the first fluid conduit 926 and travel through the first fluid conduit 926 towards the heat exchanger 924, which is positioned vertically higher (i.e., +Z direction of the coordinate axes of FIG. 19). In the heat exchanger 924, heat is removed from the heated cooling fluid, such as by natural convection with ambient air for example, to produce a cooled cooling fluid. The cooled cooling fluid then exits the heat exchanger 924 from the heat exchanger outlet 936 and flows into the second fluid conduit 928. The natural buoyancy of the cooled cooling fluid is less than the heated cooling fluid. Therefore, the cooled cooling fluid tends to flow downward (i.e., −Z direction of the coordinate axes of FIG. 19). The downward movement of the cooled cooling fluid causes the cooled cooling fluid to flow down through the second fluid conduit 928 back to the reservoir 922.

The cooling system 920 described herein provides focal cooling to a portion of the person support system 900 for preventing pressure injuries in a subject supported by the person support system 900. The cooling system 920 is passive such that it may not interfere with current subject transport procedures for transporting the subject using the person support system 900. In some embodiments, the cooling system 920 may not require power or access to other support systems or utilities, which may not be available on certain person support systems 900 such as stretchers, cots, or other support systems. In embodiments, the cooling system 920 may be lightweight such that the cooling system 920 does not significantly affect the weight of the stretcher, and thus impact the mobility of the person support system 900.

In some embodiments, the cooling system 920 may further include a pump (not shown) for moving the cooling fluid through the cooling circuit 944. Additionally, in some embodiments, the person support system 900 may include a control unit, such as the control unit 500 previously discussed in relation to FIGS. 15 and 16 for controlling the cooling system 920 to maintain a target temperature of the skin of the subject and/or the temperature of the top surface 906 of the support pad 130.

Figure 21:
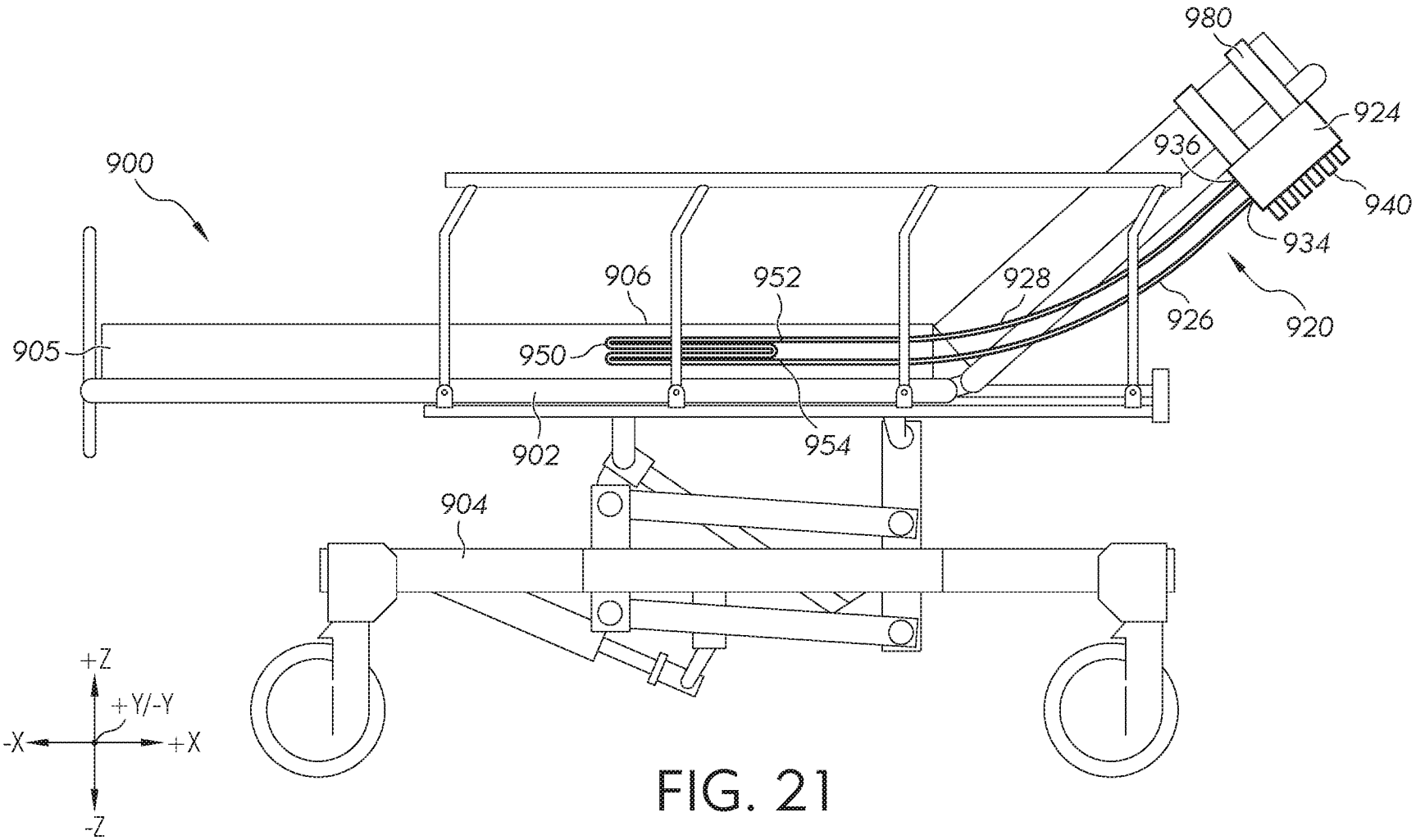
FIG. 21 schematically depicts yet another embodiment of a person support system having a cooling system, in accordance with one or more embodiments described herein.

Referring to FIG. 21, in alternative embodiments of the person support system 900, the cooling system 920 may include a heat transfer conduit 950 disposed within the support pad 905 instead of the reservoir 922 of FIG. 19. The heat transfer conduit 950 in FIG. 21 has an inlet 952 in fluid communication with the second fluid conduit 928 and an outlet 954 in fluid communication with the first fluid conduit 926. The heat transfer conduit 950 is formed into a circuitous path through the support pad 905 to provide increased heat transfer from the support pad 905 through the heat transfer conduit 950 to the cooling fluid flowing through the heat transfer conduit 950. In some embodiments, the heat transfer conduit 950 may be a rigid conduit. Alternatively, in other embodiments, the heat transfer conduit 950 may be a flexible conduit.

In operation, cooled cooling fluid from the heat exchanger 924 passes through the second fluid conduit 928 to the inlet 952 of the heat transfer conduit 950, the cooled cooling fluid then travels through the heat transfer conduit 950. Heat from the support pad 905 transfers through the heat transfer conduit 950 to the cooling fluid to produce a heated cooling fluid. The heated cooling fluid has a greater temperature than the cooled cooling fluid entering the heat transfer conduit 950. The heated cooling fluid exits the heat transfer conduit 950 from the outlet 954 of the heat transfer conduit 950.

The heated cooling fluid exhibits a natural buoyancy, which causes the heated cooling fluid to travel in the generally vertically upward direction (i.e., +Z direction of the coordinate axes of FIG. 21) in the first fluid conduit 926. The natural buoyancy of the heated cooling fluid causes the heated cooling fluid to rise in the first fluid conduit 926 and travel through the first fluid conduit 926 towards the heat exchanger 924, which is positioned vertically higher (i.e., +Z direction of the coordinate axes of FIG. 19). In the heat exchanger 924, heat is removed from the heated cooling fluid to produce a cooled cooling fluid having a temperature less than the heated cooling fluid. The cooled cooling fluid then exits the heat exchanger 924 from the heat exchanger outlet 936 and flows into the second fluid conduit 928. The natural buoyancy of the cooled cooling fluid is less than the heated cooling fluid. Therefore, the cooled cooling fluid tends to flow generally downward (i.e., −Z direction of the coordinate axes of FIG. 21). The downward movement of the cooled cooling fluid causes the cooled cooling fluid to flow down through the second fluid conduit 928 back to the heat transfer conduit 950.

Figure 22:
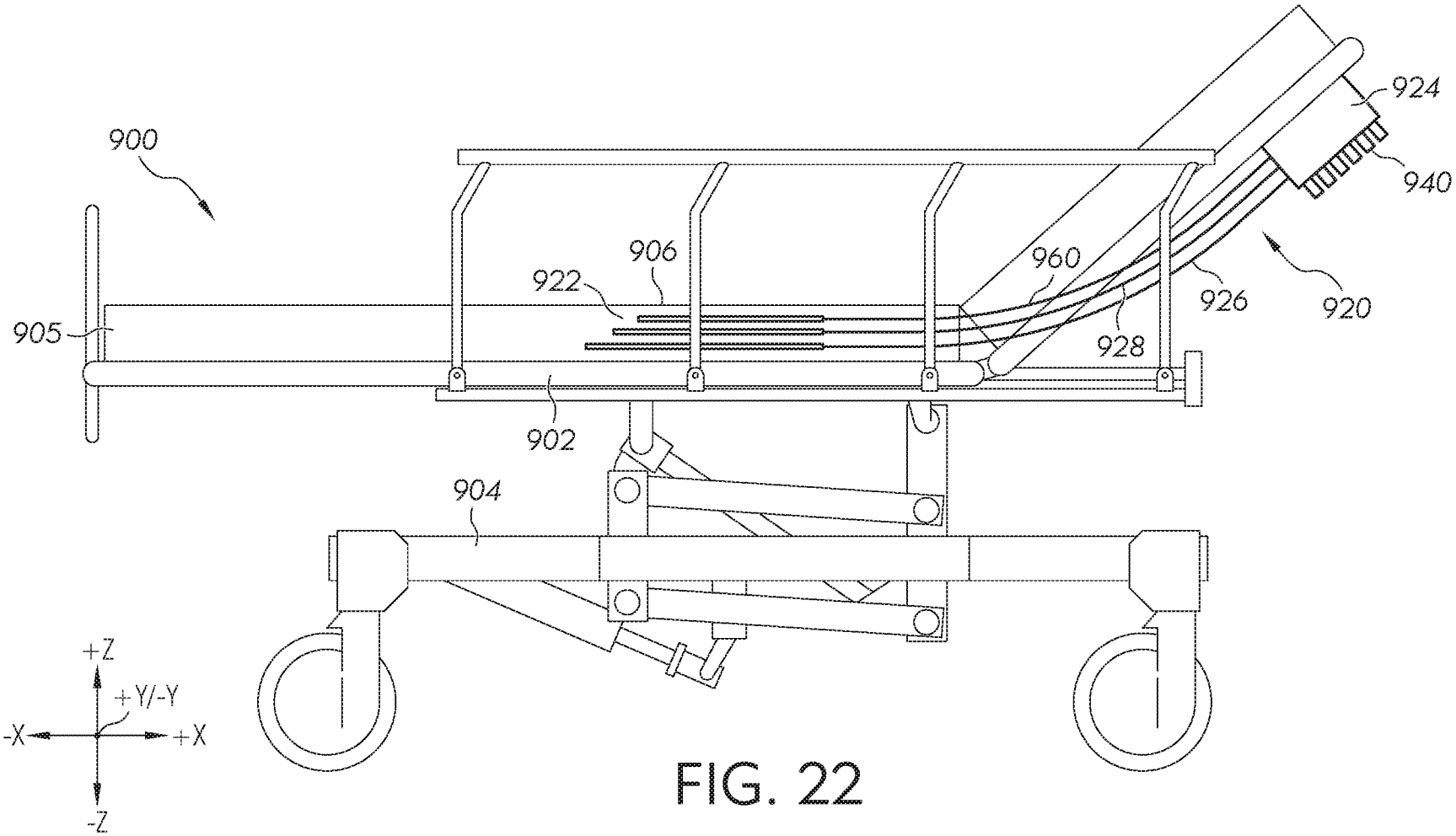
FIG. 22 schematically depicts still another embodiment of a person support system having a cooling system, in accordance with one or more embodiments described herein.

Referring now to FIG. 22, in another alternative embodiment of the person support system 900, the person support system 900 includes the frame 902, base 904, and support pad 905. The cooling system 920 for the person support system 900 comprises one or a plurality of thermally conductive elements 960 extending from the support pad 905 to the heat exchanger 924. The thermally conductive elements 960 may be formed from, for example and without limitation, thermally conductive materials having a thermal conductivity of greater than about 40 W/m*K. For example, the thermally conductive elements 960 may have a thermal conductivity of from about 40 W/m*K to about 2000 W/m*K, from about 60 W/m*K to about 1000 W/m*K, from about 80 W/m*K to about 500 W/m*K, or from about 100 W/m*K to about 300 W/m*K. In one particular example, the thermally conductive elements 960 may be carbon fibers, such as pitch-based carbon fibers. Alternatively, the thermally conductive elements 960 may be polymer fibers or strips, such as polymer fibers or strips formed from ultra-high molecular weight polyethylene, polypropylene, liquid crystalline polymer, polyphthalamide, polycarbonate, or the like. In yet another alternative, the thermally conductive elements 960 may be metallic fibers or wires, such as fibers or wires formed from copper or alloys of copper.

The thermally conductive elements 960 are thermally coupled to the support pad 905 in areas of the support pad 905 contacting an area of the subject, such as the buttocks or sacral area of the subject, such that heat from the support pad 905 is transferred to the thermally conductive elements 960. In some embodiments, the thermally conductive elements 960 may be thermally coupled to the top surface 906 of the support pad 905. Alternatively, the thermally conductive elements 960 may be thermally coupled to an upper portion, middle portion, or lower portion of the support pad 905. The thermally conductive elements 960 extend from the support pad 905 to the heat exchanger 924. In some embodiments, the thermally conductive elements 960 may be disposed within the frame 902 of the person support system 900. Alternatively, the thermally conductive elements 960 may be disposed along an underside of the support pad 905.

The heat exchanger 924 provides cooling to an end of the thermally conductive elements 960 opposite the support pad 905. By cooling the end of the thermally conductive elements 960, the heat exchanger 924 reduces the temperature of the end of the thermally conductive elements 960. This reduced temperature is less than a temperature of support pad 905. The difference in temperature between the end of the thermally conductive elements 960 coupled to the heat exchanger 924 and the ends coupled to the support pad 905 creates a temperature gradient in the thermally conductive elements 960. The temperature gradient in the thermally conductive elements 960 cause heat to be conducted from the support pad 905 along the thermally conductive elements 960 to the heat exchanger 924. The heat exchanger 924 may include cooling fins 940. In embodiments, the heat exchanger 924 may include any of the cooling sources previously discussed herein, including, but not limited to, a blower and/or fan, thermoelectric cooler, thermally absorptive material, other cooling source, or combinations thereof.

The thermally conductive elements 960 conduct heat from the support pad 905 to the heat exchanger 924, where the heat is then absorbed or dissipated into the ambient air or other heat sink. In operation, heat from the subject supported by the support pad 905 is transferred to the support pad 905 through contact of the subject with the support pad 905. Heat from the support pad 905 is then transferred to the thermally conductive elements 960 thermally coupled to the support pad 905. The thermally conductive elements 960 conduct the heat from the support pad 905 to the heat exchanger 924 driven by the temperature gradient between the support pad 905 and the heat exchanger 924. The heat exchanger 924 then absorbs the heat and/or dissipates the heat to the ambient air and/or other heat sink.

Figure 23:
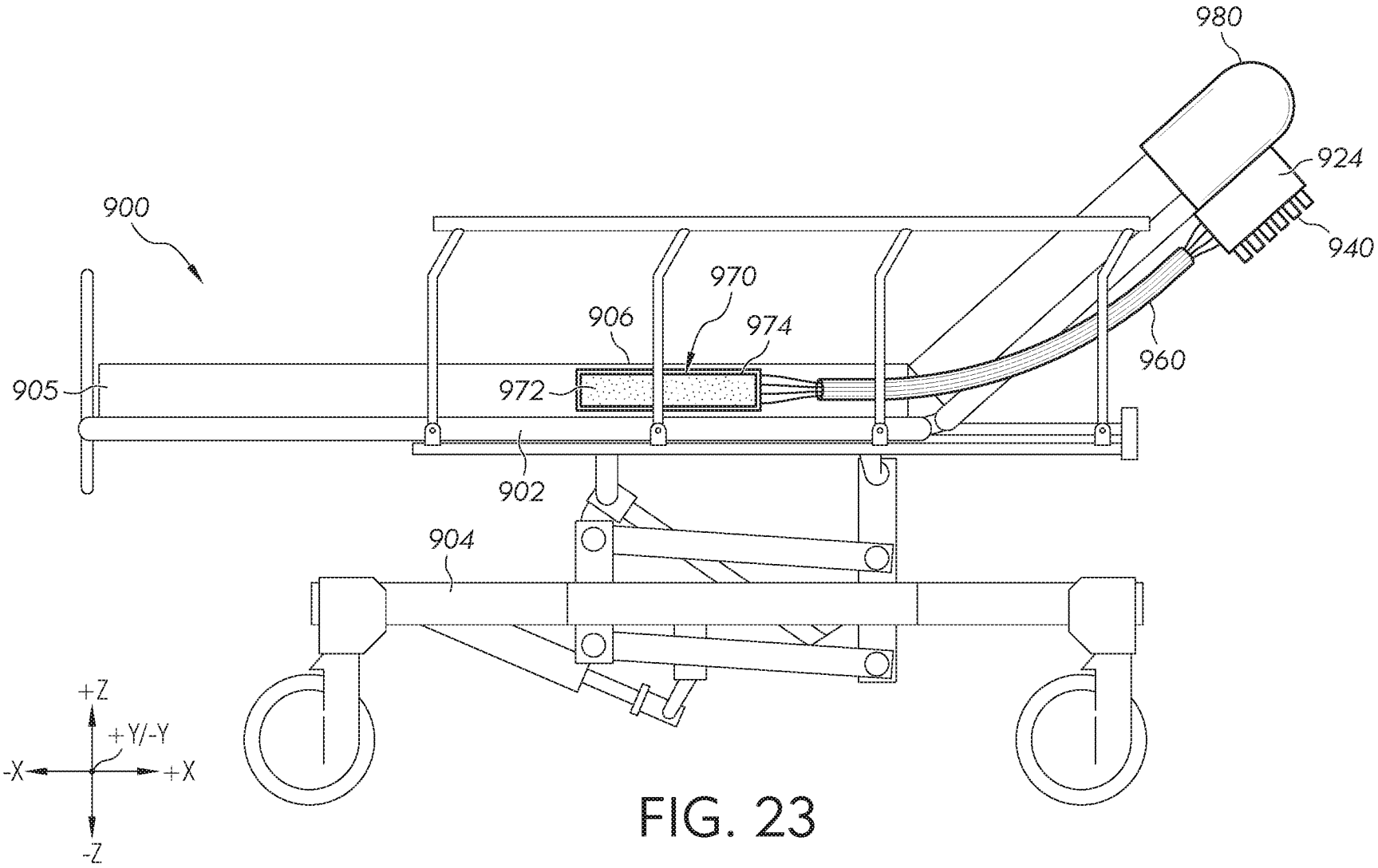
FIG. 23 schematically depicts another embodiment of a person support system having a cooling system, in accordance with one or more embodiments described herein.

Referring now to FIG. 23, another embodiment of the person support system 900 of FIG. 22 is depicted. The person support system 900 in FIG. 23 includes a pad 970 comprising a thermally absorptive material 972 contained within a pad cover 974. The thermally absorptive material 972 contained in the pad 970 may include, phase change materials, oils having relatively high heat capacities, dry ice, water ice, liquid nitrogen, or the like. Phase change materials may include, without limitation, alkanes having a melting temperature greater than or equal to about 5° C. and less than or equal to about 35° C. Examples of suitable alkanes include, without limitation, tetradecane, pentadecane, hexadecane, heptadecane, octadecane, and nonadecane. Suitable high heat capacity oils include, without limitation, mineral oils, silicon oils, fluorocarbon oils, and the like.

The thermally conductive elements 960 may be thermally coupled to the thermally absorptive material 972 in the pad 970 to remove heat absorbed by the thermally absorptive material 972. The thermally conductive elements 960 may be thermally coupled to the thermally absorptive material 972 through one or more couplers, such as the couplers disclosed in co-pending U.S. patent application Ser. No. 15/348,080, filed Nov. 10, 2016, incorporated by reference herein in its entirety.

In operation, heat from the subject supported by the pad 970 is transferred through the pad cover 974 of the pad 970 to the thermally absorptive material 972. The thermally absorptive material 972 absorbs the heat from the subject. Some of the heat absorbed by the thermally absorptive material 972 is then transferred to the thermally conductive elements 960. The thermally conductive elements 960 conduct the heat from the thermally absorptive material 972 to the heat exchanger 924, where the heat is absorbed and/or dissipated to the ambient air or another heat sink. Removal of heat from the thermally absorptive material 972 may prolong the effectiveness of the thermally absorptive material 972 by removing some of the heat absorbed by the thermally absorptive material 972, thereby restoring the capacity of the thermally absorptive material 972 to absorb more heat from the subject.

The cooling systems 920 described relative to FIGS. 19, 21, 22, and 23 may be removably coupleable to the person support system 900 so that the cooling systems 920 may be added to the person support system 900 when needed. For example, in some embodiments, the cooling system 920 may include a harness 980 (FIGS. 21 and 23) for coupling the cooling system 920 to the back of different types of person support systems 900, such as, but not limited to, chairs, wheelchairs, household beds and/or headboards, stretchers, hospital beds, gurneys, cots, operating tables, procedure tables, or other person support structures. In these embodiments, the harness 980 may include straps, pockets, fasteners, clamps, brackets, other structures, or combinations of structures for removeably coupling the cooling system 920 to a person support system 900. As depicted in FIG. 21, in some embodiments, the harness 980 may include a plurality of straps that wrap around an upper portion of the person support system 900 to secure the heat exchanger 924 to the upper portion of the person support system 900. Alternatively, in other embodiments depicted in FIG. 23, the harness 980 may include a pocket that fits over an upper portion of the person support system 900 to secure the heat exchanger 924 to the upper portion of the person support system 900.

The harness 980 may be used to couple the heat exchanger 924 to the person support system 900. The reservoir 922, heat transfer conduit 950, thermally conductive elements 960, pad 970, or combinations of these may be positioned to provide cooling to the person support system 900. In some embodiments, the reservoir 922, heat transfer conduit 950, thermally conductive elements 960, or pad 970 may be positioned on top of (i.e., in the +Z direction of the coordinate axes in the figures) the support pad 905 or other support surface (e.g., mattress, seat, or other surface) to provide cooling directly to the subject supported by the person support system 900. In these embodiments, the reservoir 922, heat transfer conduit 950, thermally conductive elements 960, or pad 970 may be positioned between the support pad 905 or other support surface and the subject supported thereon. Alternatively, in other embodiments, the reservoir 922, heat transfer conduit 950, thermally conductive elements 960, or pad 970 may be positioned underneath the support pad 905 or other support surface (i.e., below the support pad 905 or other support surface in the −Z direction of the coordinate axes of the figures) such that heat is conducted from the subject, through the support pad or other support surface, to the reservoir 922, heat transfer conduit 950, thermally conductive elements 960, or pad 970. The reservoir 922, heat transfer conduit 950, thermally conductive elements 960, or pad 970 may also be insertable into a recess in the support pad 905 or other support surface as shown in FIG. 20.

A first aspect of the present disclosure may be directed to a person support system comprising a longitudinal frame comprising at least one side rail and a deck positioned on the longitudinal frame, the deck comprising a thermally conductive material. The person support system may further comprise a cooling source thermally coupled to the deck, wherein the cooling source draws heat from at least a portion of a top surface of the deck and through the deck thereby cooling the at least a portion of the top surface of the deck.

A second aspect of the present disclosure may include the first aspect, wherein the cooling source is physically and thermally coupled to the at least one side rail, the deck is thermally coupled to the at least one side rail, and the cooling source draws heat from the at least a portion of the upper surface of the deck, through the deck, and through the at least one side rail thereby cooling the at least a portion of the top surface of the deck.

A third aspect of the present disclosure may include either the first or the second aspects, further comprising at least one thermally conductive cross-member thermally coupled to a lower surface of the deck and to a surface of the at least one side rail, wherein the cooling source draws heat from the at least a portion of the top surface of the deck, through the deck, through the at least one thermally conductive cross-member, and through the at least one side rail thereby cooling the at least a portion of the top surface of the deck.

A fourth aspect of the present disclosure may include the first aspect, wherein the cooling source is thermally and physically coupled directly to a bottom surface of the deck, wherein the cooling source draws heat from the at least a portion of the top surface of the deck and through the deck thereby cooling the at least a portion of the top surface of the deck.

A fifth aspect of the present disclosure may include the fourth aspect, wherein the cooling source is thermally coupled to the bottom surface of the deck by a thermally conductive grease or a thermally conductive adhesive.

A sixth aspect of the present disclosure may include either of the fourth or fifth aspects, further comprising a bracket coupled to the bottom surface of the deck, the bracket shaped to maintain the cooling source thermally coupled to the bottom surface of the deck.

A seventh aspect of the present disclosure may include any of the first through sixth aspects, wherein the cooling source comprises a fan oriented to direct an output fluid through the at least one side rail or across a bottom surface of the deck.

An eighth aspect of the present disclosure may include the seventh aspect, wherein the cooling source comprises a heat transfer plate thermally coupled to an internal surface of the at least one side rail or the bottom surface of the deck, the heat transfer plate having a plurality of fins extending therefrom, wherein the fan is oriented to direct the output fluid across the plurality of fins of the heat transfer plate.

A ninth aspect of the present disclosure may include any of the first through sixth aspects, wherein the cooling source comprises a thermoelectric cooler having a cooling plate thermally coupled to a surface of the deck or a surface of the at least one side rail.

A tenth aspect of the present disclosure may include the ninth aspect, wherein a heating plate of the thermoelectric cooler comprises a plurality of cooling fins extending therefrom.

An eleventh aspect of the present disclosure may include either of the ninth or tenth aspects, wherein the cooling source comprises a fan positioned to direct an output fluid across a heating plate of the thermoelectric cooler.

A twelfth aspect of the present disclosure may include the ninth aspect, wherein a heating plate of the thermoelectric cooler comprises a plurality of cooling fins extending therefrom and the cooling source comprises a fan positioned to direct an output fluid across the heating plate of the thermoelectric cooler.

A thirteenth aspect of the present disclosure may include the first or fourth aspects, wherein the cooling source comprises a heat transfer plate thermally coupled to the bottom surface of the deck, the heat transfer plate having a plurality of fins, and an enclosure having a cooling fluid input and a cooling fluid output, the enclosure coupled to the bottom surface of the deck or the heat transfer plate to form a chamber. When a cooling fluid is passed through the chamber from the cooling fluid inlet of the enclosure to the cooling fluid outlet, the cooling fluid contacts the fins of the heat transfer plate thereby transferring heat from the fins to the cooling fluid.

A fourteenth aspect of the present disclosure may include the first or the fourth aspects, wherein the cooling source comprises a thermoelectric cooler having a cooling plate thermally coupled to the bottom surface of the deck and a heating plate, and an enclosure having a cooling fluid input and a cooling fluid output, the enclosure coupled to the bottom surface of the deck or the thermoelectric cooler to form a chamber. When a cooling fluid is passed through the chamber from the cooling fluid inlet of the enclosure to the cooling fluid outlet, the cooling fluid contacts the heating plate of the thermoelectric cooler thereby transferring heat from the heating plate to the cooling fluid.

A fifteenth aspect of the present disclosure may include any of the first through sixth aspects, wherein the cooling source comprises a thermally absorptive material thermally coupled to a bottom surface of the deck or an internal surface of the at least one side rail.

A sixteenth aspect of the present disclosure may include the fifteenth aspect, wherein the thermally absorptive material is contained within a canister thermally coupled to the bottom surface of the deck or an internal surface of the at least one side rail.

A seventeenth aspect of the present disclosure may include the fifteenth or sixteenth aspects, wherein the thermally absorptive material is a phase change material.

An eighteenth aspect of the present disclosure may include any of the first through seventeenth aspects, wherein the person support system is one of an surgical table, a spine table, a hospital bed, a procedural stretcher, a stretcher, a gurney, a cot or a wheelchair.

A nineteenth aspect of the present disclosure may include any of the first through eighteenth aspects, further comprising a control unit communicatively coupled to a temperature sensor, the control unit comprising a processor and a non-transitory memory storing computer readable and executable instructions which, when executed by the processor, cause the control unit to: receive a temperature signal from the temperature sensor indicative of a measured temperature of skin of a subject, the top surface of the deck, or a top surface of a support pad supported by the deck; compare the measured temperature to a target temperature; and adjust an operating parameter of the cooling source when the measured temperature is not equal to the target temperature, thereby increasing or decreasing cooling of the deck until the measured temperature is equal to the target temperature.

A twentieth aspect of the present disclosure may include any of the first through eighteenth aspects, further comprising a control unit communicatively coupled to an input device and a temperature sensor, the control unit comprising a processor and a non-transitory memory storing computer readable and executable instructions which, when executed by the processor, cause the control unit to: receive an input indicative of a target temperature; receive an input indicative of an identity of an accessory; determine an adjusted target temperature based on the target temperature and the identity of the accessory; receive a temperature signal from the temperature sensor indicative of a measured temperature of skin of a subject, of the top surface of the deck, or of a surface of a support pad supported by the deck; and adjust an operating parameter of the cooling source thereby increasing or decreasing cooling of the deck until the measured temperature is equal to the adjusted target temperature.

A twenty-first aspect of the present disclosure may include the twentieth aspect, further comprising an RFID reader communicatively coupled to the control unit, wherein the computer readable and executable instructions, when executed by the processor, further cause the control unit to receive an accessory identification signal from the RFID reader indicative of the identity of the accessory, wherein the accessory identification signal is the input indicative of the identity of the accessory.

A twenty-second aspect of the present disclosure may include the first through sixth aspects, wherein the cooling source comprises thermally absorptive material and the person support system further comprises a control unit communicatively coupled to an input device, the control unit comprising a processor and a non-transitory memory storing computer readable and executable instructions which, when executed by the processor, cause the control unit to: receive an input indicative of a target temperature; receive an input indicative of an identity of an accessory; and determine a recommended thermally absorptive material based on the target temperature and the identity of the accessory.

A twenty-third aspect of the present disclosure may include the twenty-second aspect, further comprising an RFID reader communicatively coupled to the control unit, wherein the computer readable and executable instructions, when executed by the processor, further cause the control unit to receive an accessory identification signal from the RFID reader indicative of the identity of the accessory, wherein the accessory identification signal is the input indicative of the identity of the accessory.

A twenty-fourth aspect of the present disclosure may include either of the twenty-second or twenty-third aspects, wherein the computer readable and executable instructions, when executed by the processor, further cause the control unit to determine a recommended time schedule for replacing the thermally absorptive material to achieve the target temperature.

A twenty-fifth aspect of the present disclosure may be directed to a cooling system for a person support system, the cooling system comprising a reservoir or a heat transfer conduit thermally coupleable to a deck or a support pad of the person support system, a heat exchanger, a first fluid conduit in fluid communication with a heat exchanger inlet and a reservoir outlet or an outlet of the heat transfer conduit, and a second fluid conduit in fluid communication with a heat exchanger outlet and a reservoir inlet or an inlet of the heat transfer conduit. The reservoir or heat transfer conduit, the heat exchanger, the first fluid conduit, and the second fluid conduit form a cooling circuit such that when a cooling fluid is disposed in the cooling circuit and the heat exchanger is positioned vertically higher than the reservoir of the heat transfer conduit, the cooling fluid absorbs heat from the deck or the support pad of the person support system, flows through the first fluid conduit to the heat exchanger, releases heat in the heat exchanger, and flows through the second fluid conduit back to the reservoir or the heat transfer conduit.

A twenty-sixth aspect of the present disclosure may include the twenty-fifth aspect, further comprising a cooling fluid disposed in the cooling circuit. A twenty-seventh aspect of the present disclosure may include the twenty-sixth aspect, wherein the cooling fluid comprises one or more of water, alcohol, or glycol. A twenty-eighth aspect of the present disclosure may include either of the twenty-sixth or twenty-seventh aspects, wherein flow of the cooling fluid through the cooling circuit proceeds through buoyancy forces. A twenty-ninth aspect of the present disclosure may include any of the twenty-fifth through twenty-eighth aspects, further comprising a pump fluidly coupled to the cooling circuit, wherein the pump circulates a cooling fluid through the cooling circuit. A thirtieth aspect of the present disclosure may include any of the twenty-fifth through twenty ninth aspects, wherein the heat exchanger comprises a cooling source. A thirty-first aspect of the present disclosure may include the thirtieth aspect, wherein the cooling source includes one or more of a blower, a heat transfer plate, a thermoelectric cooler, or a thermally absorptive material.

A thirty-second aspect of the present disclosure may include the twenty-fifth through thirty-first aspects, wherein the cooling system is removable from the person support system. A thirty-third aspect of the present disclosure may include the twenty-fifth through thirty-second aspects, wherein the heat exchanger includes a harness for removeably coupling the heat exchanger to a portion of the person support system.

A thirty-fourth aspect of the present disclosure may include the twenty-fifth through thirty-third aspects, wherein the cooling system comprises the reservoir. A thirty-fifth aspect of the present disclosure may include the twenty-fifth through thirty-fourth aspects, wherein the cooling system comprises the heat transfer conduit.

It will be apparent to those skilled in the art that various modifications and variations can be made to the embodiments described herein without departing from the spirit and scope of the claimed subject matter. Thus it is intended that the specification cover the modifications and variations of the various embodiments described herein provided such modification and variations come within the scope of the appended claims and their equivalents.

What is claimed is:

1. A person support system comprising:

a longitudinal frame comprising at least one side rail;

a deck positioned on and supported by the longitudinal frame, the deck comprising a thermally conductive material; and a cooling source physically and thermally coupled to the at least one side rail, wherein the cooling source draws heat from at least a portion of a top surface of the deck, through the deck, and through the at least one side rail, thereby cooling the at least a portion of the top surface of the deck.

2. The person support system of claim 1, further comprising at least one thermally conductive cross-member thermally coupled to a lower surface of the deck and to a surface of the at least one side rail, wherein the cooling source draws heat from the at least a portion of the top surface of the deck, through the deck, through the at least one thermally conductive cross-member, and through the at least one side rail thereby cooling the at least a portion of the top surface of the deck.

3. The person support system of claim 1, wherein the cooling source comprises a fan oriented to direct an output fluid through the at least one side rail.

4. The person support system of claim 3, wherein the cooling source comprises a heat transfer plate thermally coupled to an internal surface of the at least one side rail, the heat transfer plate having a plurality of fins extending therefrom, wherein the fan is oriented to direct the output fluid across the plurality of fins of the heat transfer plate.

5. The person support system of claim 1, wherein the cooling source comprises a thermoelectric cooler having a cooling plate thermally coupled to a surface of the at least one side rail.

6. The person support system of claim 5, wherein a heating plate of the thermoelectric cooler comprises a plurality of cooling fins extending therefrom.

7. The person support system of claim 1, wherein the cooling source comprises a thermally absorptive material thermally coupled to an internal surface of the at least one side rail.

8. The person support system of claim 1, wherein the person support system is one of a surgical table, a spine table, a hospital bed, a procedural stretcher, a stretcher, a gurney, a cot or a wheelchair.

9. The person support system of claim 1, further comprising a control unit communicatively coupled to a temperature sensor, the control unit comprising a processor and a non-transitory memory storing computer readable and executable instructions which, when executed by the processor, cause the control unit to:

receive a temperature signal from the temperature sensor indicative of a measured temperature of skin of a subject, the top surface of the deck, or a top surface of a support pad supported by the deck;

compare the measured temperature to a target temperature; and adjust an operating parameter of the cooling source when the measured temperature is not equal to the target temperature, thereby increasing or decreasing cooling of the deck until the measured temperature is equal to the target temperature.

10. The person support system of claim 1, further comprising a control unit communicatively coupled to an input device and a temperature sensor, the control unit comprising a processor and a non-transitory memory storing computer readable and executable instructions which, when executed by the processor, cause the control unit to:

receive an input indicative of a target temperature;

receive an input indicative of an identity of an accessory;

determine an adjusted target temperature based on the target temperature and the identity of the accessory;

receive a temperature signal from the temperature sensor indicative of a measured temperature of skin of a subject, of the top surface of the deck, or of a surface of a support pad supported by the deck; and adjust an operating parameter of the cooling source thereby increasing or decreasing cooling of the deck until the measured temperature is equal to the adjusted target temperature.

11. A person support system comprising:

a longitudinal frame comprising at least one side rail;

a deck positioned on and supported by the longitudinal frame, the deck comprising a thermally conductive material; and a cooling source physically and thermally coupled directly to a bottom exterior surface of the deck, wherein the cooling source draws heat from at least a portion of a top surface of the deck and through the deck thereby cooling the at least a portion of the top surface of the deck, wherein the cooling source comprises a heat transfer plate having a plurality of fins extending therefrom, a thermoelectric cooler comprising a cooling plate, or a thermally absorptive material.

12. The person support system of claim 11, further comprising a fan and wherein:

the cooling source comprises the heat transfer plate having a plurality of fins extending therefrom;

the heat transfer plate is thermally and physically coupled to the bottom exterior surface of the deck so that the heat transfer plate is parallel to the bottom exterior surface of the deck; and the fan is oriented to direct the output fluid across the plurality of fins of the heat transfer plate.

13. The person support system of claim 11, wherein the cooling source comprises:

the heat transfer plate thermally and physically coupled to the bottom exterior surface of the deck so that the heat transfer plate is parallel to the bottom exterior surface of the deck; and an enclosure having a cooling fluid input and a cooling fluid output, the enclosure coupled to the bottom exterior surface of the deck or the heat transfer plate to form a chamber wherein the plurality of fins of the heat transfer plate are disposed within the chamber;

wherein when a cooling fluid is passed through the chamber from the cooling fluid inlet of the enclosure to the cooling fluid outlet, the cooling fluid contacts the plurality of fins of the heat transfer plate thereby transferring heat from the fins to the cooling fluid.

14. The person support system of claim 11, wherein the cooling source comprises:

the thermoelectric cooler having the cooling plate thermally and physically coupled to the bottom exterior surface of the deck and a heating plate, where the cooling plate is parallel to the bottom exterior surface of the deck; and an enclosure having a cooling fluid input and a cooling fluid output, the enclosure coupled to the bottom exterior surface of the deck or to the thermoelectric cooler to form a chamber;

wherein when a cooling fluid is passed through the chamber from the cooling fluid inlet of the enclosure to the cooling fluid outlet, the cooling fluid contacts the heating plate of the thermoelectric cooler thereby transferring heat from the heating plate to the cooling fluid.

15. The person support system of claim 11, wherein the cooling source comprises the thermally absorptive material thermally coupled to the bottom exterior surface of the deck, wherein the thermally absorptive material is contained within a canister coupled to the bottom exterior surface of the deck so that a surface of the canister is parallel with the bottom exterior surface of the deck.

16. The person support system of claim 11, wherein the cooling source is thermally coupled to the bottom surface of the deck by a thermally conductive grease, a thermally conductive adhesive, or a bracket coupled to the bottom surface of the deck, the bracket shaped to maintain the cooling source thermally coupled to the bottom surface of the deck.

17. The person support system of claim 11, wherein the person support system is one of a surgical table, a spine table, a hospital bed, a procedural stretcher, a stretcher, a gurney, a cot or a wheelchair.

18. The person support system of claim 11, further comprising a control unit communicatively coupled to a temperature sensor, the control unit comprising a processor and a non-transitory memory storing computer readable and executable instructions which, when executed by the processor, cause the control unit to:

receive a temperature signal from the temperature sensor indicative of a measured temperature of skin of a subject, the top surface of the deck, or a top surface of a support pad supported by the deck;

compare the measured temperature to a target temperature; and adjust an operating parameter of the cooling source when the measured temperature is not equal to the target temperature, thereby increasing or decreasing cooling of the deck until the measured temperature is equal to the target temperature.

19. The person support system of claim 11, further comprising a control unit communicatively coupled to an input device and a temperature sensor, the control unit comprising a processor and a non-transitory memory storing computer readable and executable instructions which, when executed by the processor, cause the control unit to:

receive an input indicative of a target temperature;

receive an input indicative of an identity of an accessory;

determine an adjusted target temperature based on the target temperature and the identity of the accessory;

receive a temperature signal from the temperature sensor indicative of a measured temperature of skin of a subject, of the top surface of the deck, or of a surface of a support pad supported by the deck; and adjust an operating parameter of the cooling source thereby increasing or decreasing cooling of the deck until the measured temperature is equal to the adjusted target temperature.

20. A person support system comprising:

a longitudinal frame comprising at least one side rail;

a deck positioned on and supported by the longitudinal frame, the deck comprising a thermally conductive material; and a cooling source comprising a heat transfer plate having a plurality of fins extending therefrom, a thermoelectric cooler, or a thermally absorptive material, wherein:

the heat transfer plate, a cooling plate of the thermoelectric cooler, or a surface of a canister containing the thermally absorptive material is thermally and physically coupled directly to the bottom exterior surface of the deck so that the heat transfer plate, the cooling plate, or the surface of the canister is parallel to the bottom exterior surface of the deck; and the cooling source draws heat from at least a portion of a top surface of the deck and through the deck thereby cooling the at least a portion of the top surface of the deck.

* * * * *